US008746605B2

(12) United States Patent
Tracey et al.

(10) Patent No.: US 8,746,605 B2
(45) Date of Patent: Jun. 10, 2014

(54) SYSTEMS AND METHODS FOR SPOOLING AND UNSPOOLING LINEAR MATERIAL

(75) Inventors: James B. A. Tracey, Austin, TX (US); Mark Rosenau, West Lake Hills, TX (US); Joseph M. Hill, III, Austin, TX (US)

(73) Assignee: Great Stuff, Inc., Austin, TX (US)

( * ) Notice: Subject to any disclaimer, the term of this patent is extended or adjusted under 35 U.S.C. 154(b) by 0 days.

(21) Appl. No.: 13/449,123

(22) Filed: Apr. 17, 2012

(65) Prior Publication Data

US 2013/0015284 A1 Jan. 17, 2013

Related U.S. Application Data

(60) Provisional application No. 61/477,108, filed on Apr. 19, 2011.

(51) Int. Cl.
*B65H 59/38* (2006.01)

(52) U.S. Cl.
USPC ..... 242/390.9; 242/413.5; 242/420.5

(58) Field of Classification Search
USPC ..... 242/390, 390.8, 390.9, 412, 412.1, 242/412.2, 413, 413.1, 413.3, 413.4, 413.5, 242/420, 420.5, 420.6
See application file for complete search history.

(56) References Cited

U.S. PATENT DOCUMENTS

| | | | |
|---|---|---|---|
| 2,039,915 | A | 12/1934 | McCoy |
| 2,262,462 | A | 5/1941 | Margis, Jr. |
| 2,353,639 | A | 11/1941 | Berthold et al. |
| 3,160,173 | A | 12/1964 | Bowen |
| 3,558,026 | A | 1/1971 | Rosen |
| 3,788,575 | A | 1/1974 | Boettcher et al. |
| 4,241,884 | A | 12/1980 | Lynch |
| 4,454,999 | A | 6/1984 | Woodruff |
| 4,537,364 | A | 8/1985 | Pollman et al. |
| 4,565,099 | A | 1/1986 | Arnold |
| 4,655,399 | A | 4/1987 | Harvey |
| 4,666,097 | A | 5/1987 | Tsuge et al. |
| 4,708,301 | A | 11/1987 | Kataoka |
| 4,718,168 | A | 1/1988 | Kerr |
| 4,744,696 | A | 5/1988 | Vidler |
| 4,775,086 | A | 10/1988 | Kataoka |
| 4,787,569 | A | 11/1988 | Kanada et al. |
| 4,852,263 | A | 8/1989 | Kerr |

(Continued)

FOREIGN PATENT DOCUMENTS

| | | |
|---|---|---|
| DE | 556596 | 8/1932 |
| DE | 44 07 195 C1 | 4/1995 |

(Continued)

OTHER PUBLICATIONS

ThomasNet News, Thomas Publishing Company, Wire Pay-Out is suited for traverse wound reels, http://news.thomasnet.com/fullstory/454371 as of Aug. 10, 2004.

(Continued)

*Primary Examiner* — Emmanuel M Marcelo
*Assistant Examiner* — Justin Stefanon
(74) *Attorney, Agent, or Firm* — Knobbe Martens Olson & Bear, LLP

(57) ABSTRACT

Apparatus and methods are disclosed related to spooling and unspooling linear material. Such apparatus and methods can assist the user in deploying and/or retracting linear material.

30 Claims, 30 Drawing Sheets

(56) References Cited

U.S. PATENT DOCUMENTS

| | | | | |
|---|---|---|---|---|
| 4,893,037 | A | 1/1990 | Schwartz | |
| 5,005,777 | A | 4/1991 | Fernandez | |
| 5,160,055 | A | 11/1992 | Gray | |
| 5,294,066 | A | 3/1994 | Lacour | |
| 5,398,911 | A | 3/1995 | Holster | |
| 5,440,820 | A | 8/1995 | Hwang | |
| 5,495,995 | A * | 3/1996 | Dominique et al. | 242/390.1 |
| 5,502,358 | A * | 3/1996 | Lee | 318/6 |
| 5,526,997 | A | 6/1996 | Karczmer et al. | |
| 5,762,282 | A | 6/1998 | Wolner | |
| 5,793,174 | A | 8/1998 | Dkovach et al. | |
| 5,808,824 | A | 9/1998 | Kaniwa et al. | |
| 5,841,259 | A | 11/1998 | Kim et al. | |
| 6,057,658 | A | 5/2000 | Kovach et al. | |
| 6,142,406 | A * | 11/2000 | Newman | 242/390.9 |
| 6,149,096 | A | 11/2000 | Hartley | |
| 6,181,089 | B1 | 1/2001 | Kovach et al. | |
| 6,279,848 | B1 | 8/2001 | Mead, Jr. | |
| 6,369,530 | B2 | 4/2002 | Kovach et al. | |
| 6,474,588 | B2 | 11/2002 | Valverde | |
| 6,474,922 | B2 | 11/2002 | Bachman et al. | |
| 6,536,615 | B2 | 3/2003 | Nishikino et al. | |
| 6,672,529 | B2 | 1/2004 | Cain et al. | |
| 6,782,662 | B2 | 8/2004 | McCartney et al. | |
| 6,913,221 | B2 | 7/2005 | Moon et al. | |
| 6,941,802 | B2 | 9/2005 | Brown | |
| 6,983,907 | B2 | 1/2006 | Ikuta et al. | |
| 6,995,682 | B1 | 2/2006 | Chen et al. | |
| 7,028,989 | B2 | 4/2006 | Flynn et al. | |
| 7,108,218 | B2 | 9/2006 | Chapman et al. | |
| 7,150,425 | B2 | 12/2006 | Banaszkiewicz et al. | |
| 7,150,572 | B2 | 12/2006 | McNestry et al. | |
| 7,159,851 | B1 | 1/2007 | Ross et al. | |
| 7,175,122 | B2 | 2/2007 | Bui et al. | |
| 7,185,881 | B2 | 3/2007 | Drarvik et al. | |
| 7,207,746 | B1 | 4/2007 | Legun | |
| 7,331,436 | B1 | 2/2008 | Pack et al. | |
| 7,350,736 | B2 | 4/2008 | Caamano et al. | |
| 7,364,106 | B2 | 4/2008 | Bui et al. | |
| 7,419,038 | B2 | 9/2008 | Caamano et al. | |
| 7,431,268 | B2 | 10/2008 | Steiner et al. | |
| 7,503,338 | B2 | 3/2009 | Harrington et al. | |
| 7,533,843 | B2 | 5/2009 | Caamano et al. | |
| 7,644,442 | B2 | 1/2010 | Miller et al. | |
| 7,682,094 | B2 | 3/2010 | McNestry et al. | |
| 7,688,010 | B2 | 3/2010 | Caamano et al. | |
| 7,692,393 | B2 | 4/2010 | Caamano et al. | |
| 7,722,268 | B2 | 5/2010 | McNestry et al. | |
| 7,748,917 | B2 | 7/2010 | McNestry et al. | |
| D626,818 | S | 11/2010 | Tracey | |
| 7,838,892 | B2 | 11/2010 | Wirth | |
| D632,548 | S | 2/2011 | Tracey et al. | |
| 8,006,958 | B2 | 8/2011 | Starks et al. | |
| 2004/0155137 | A1 | 8/2004 | Sharpe et al. | |
| 2005/0040276 | A1 | 2/2005 | Sharpe et al. | |
| 2005/0082517 | A1 | 4/2005 | Steiner et al. | |
| 2005/0087644 | A1 * | 4/2005 | Kim | 242/390.8 |
| 2006/0000936 | A1 * | 1/2006 | Caamano et al. | 242/390.9 |
| 2007/0194163 | A1 | 8/2007 | Okonsky et al. | |
| 2008/0074893 | A1 | 3/2008 | Ham, II | |
| 2008/0223951 | A1 | 9/2008 | Tracey et al. | |
| 2012/0267466 | A1 | 10/2012 | Tracey et al. | |
| 2013/0171865 | A1 | 7/2013 | Ceraldi et al. | |

FOREIGN PATENT DOCUMENTS

| | | |
|---|---|---|
| DE | 20304085 | 7/2003 |
| EP | 0289475 | 11/1988 |
| EP | 0953536 | 11/1999 |
| EP | 1457450 | 9/2004 |
| FR | 2 630 419 A1 | 10/1989 |
| GB | 946662 | 1/1964 |
| JP | 10-297821 | 11/1998 |
| JP | 11-21022 | 1/1999 |
| JP | 2000-219435 | 8/2000 |
| JP | 2003-221166 | 8/2003 |
| JP | 2004-059302 | 2/2004 |
| JP | 2004-067328 | 3/2004 |
| JP | 2007-070008 | 3/2007 |
| JP | 2007-519508 | 7/2007 |
| WO | WO 95/09123 A1 | 4/1995 |
| WO | WO 98/21138 A1 | 5/1998 |
| WO | WO 2010/015966 A1 | 2/2010 |

OTHER PUBLICATIONS

Warn Industries, The Basic Guide to Winching Techniques, http://www.warn.com/corporate/images/90/TechGuide_PN62885-A2.pdf as of Aug. 24, 2009.

General Machine Products Co., General Machine Products Co., Inc., Terminal Wire Reel, http://www.gmptools.com/nf/80470.htm as of Aug. 24, 2009.

Vimala, P., and K. Narayanan, Indirect Tension Control for Winder, Proceedings of the 2007 International Conference on Embedded Systems & Applications, ESA 2007, Jun. 25-28, 2007, pp. 74-80, CSREA Press, Las Vegas NV.

Ishihara, et al., AC Drive System for Tension Reel Control, Industry Applications, Jan. 1985, pp. 147-153, vol. IA-21-Issue 1.

Vimala, P., and K. Narayanan, Abstract of "Indirect Tension Control for Winder," Proceedings of the 2007 International Conference on Embedded Systems & Applications, ESA 2007, Jun. 25-28, 2007, CSREA Press, Las Vegas NV.

International Search Report and Written Opinion of Jul. 11, 2012 for International Application No. PCT/US2012/034126, filed Apr. 18, 2012 in 13 pages.

International Search Report and Written Opinion of Oct. 18, 2012 for International Application No. PCT/US2012/034128, filed Apr. 18, 2012 in 10 pages.

Nordic, Hose Boss Rewind Assist, found at http://web.archive.org/web/20031212090707/http://www.nordicsystems.com/hoseboss.php, dated Dec. 12, 2003.

International Search Report and Written Opinion mailed Apr. 27, 2006; Appl. No. PCT/US2005/023652; 13 pages.

Communication relating to the results of a partial International Search Report mailed Nov. 12, 2005, in Application No. PCT/US2005/023652, 5 pages.

European Search Report for application No. 10178366.0, dated Oct. 28, 2010.

* cited by examiner

Motor Duty Cycle Control Process

| FIG.7G-1 | FIG.7G-2 | FIG.7G-3 |
|---|---|---|

SYSTEMS AND METHODS FOR SPOOLING AND UNSPOOLING LINEAR MATERIAL

CROSS-REFERENCE TO RELATED APPLICATION

This application claims the benefit under 35 U.S.C. §119 (e) of U.S. Provisional Patent Application No. 61/477,108, filed Apr. 19, 2011, titled "SYSTEMS AND METHODS FOR SPOOLING AND UNSPOOLING LINEAR MATERIAL."

INCORPORATION BY REFERENCE

Certain structures and mechanisms described or otherwise referenced herein are illustrated and described in the following U.S. Pat. Nos. 6,279,848; 7,350,736; 7,503,338; 7,419,038; 7,533,843; D 632,548; and D 626,818, which are hereby incorporated herein by reference in their entireties. Other structures and mechanisms described or otherwise referenced herein are illustrated and described in the following U.S. patent application publications: U.S. Patent App. Publ. Nos. US2007/0194163 A1 and US2008/0223951 A1, which are hereby incorporated herein by reference in their entireties. U.S. patent application Ser. No. 13/448,784, filed Apr. 17, 2012, entitled REEL SYSTEMS AND METHODS FOR MONITORING AND CONTROLLING LINEAR MATERIAL SLACK is also hereby incorporated by reference in its entirety.

BACKGROUND

1. Technical Field

The present disclosure relates generally to systems and methods for spooling and unspooling linear material and, in particular, to a motorized device having a controller for controlling the spooling and/or unspooling of linear material.

2. Description of the Related Technology

Linear material, such as hoses, cords, cables, and the like, can be cumbersome and difficult to manage. Reels and like mechanical devices have been designed to help unspool such linear material from a rotatable spool member or a drum-like apparatus from which it can be deployed and wound upon. Some conventional devices are manually operated, requiring the user to physically rotate the spool member or drum to spool (wind in) the linear material and to pull, without any assistance, when unwinding. This can be tiresome and time-consuming for users, especially when the material is of a substantial length or is heavy, or when the drum or spool member is otherwise difficult to rotate. Other devices are motor-controlled, and can automatically wind in the linear material. These automatic devices often have a gear assembly wherein multiple revolutions of the motor produce a single revolution of the spool member or drum. For example, some conventional automatic devices have a 30:1 gear reduction, wherein 30 revolutions of the motor result in one revolution of the spool member or drum.

However, when a user attempts to pull out the linear material from such a geared device, the user must pull against the increased resistance caused by the gear reduction because the motor spins a number of times for every full revolution of the drum or spool member. Not only does this place an extra physical burden on the user (over and above the burden to unwind a possibly heavy linear material wound on a possibly heavy drum), but the linear material also experiences additional strain because it must withstand the stress of the user pulling on it with a pulling force sufficient force to overcome the increased resistance. Some automatic devices include a clutch system, such as a neutral position clutch, that neutralizes (or de-clutches) the motor to enable the user to freely pull out the linear material. This often requires the user to be at the site of the device to activate the clutch. In addition, clutch assemblies can be expensive and substantially increase the cost of automatic devices. Furthermore, they do not address the issue of the resistance due to the weight of the linear material and the rotational inertia of the drum.

On the other hand, once a user has initiated unwinding of the linear material and overcome the initial resistance, the drum, motor, and linear material will have momentum that will tend to cause continued unspooling even after the user has stopped pulling. This continued unspooling can lead to kinks, undesired slack, and other undesirable results. Some systems include a mechanical brake that engages when the user stops putting tension on the linear material by reacting directly to tautness in the linear material, but such solutions are not necessarily appropriate when the unwinding can be powered by a motor as well as user supplied tension, and generally do not account for scenarios where a user is walking while holding the linear material and/or when natural arm swing causes repeated rising and falling tension.

Also, when linear material is unwound from such a device by pulling it, if the proximal end portion of the linear the material (i.e., the end coupled to the rotatable spool member) is unwound, there is a risk of fatigue, leakage, joint damage, and related or similar issues where the linear material is attached to the device. It is also desirable that such a system address this issue.

Moreover, existing methods of unwinding linear material have encountered issues related to controlling the unwinding of linear material while linear material is unwound from a spool member. Additionally, the linear material experiences significant stress and strain as users repeatedly pull it from the reel, which can result in damage to the linear material. Furthermore, some existing methods of unwinding linear material have consumed significant power. Accordingly, a need exists for improved unwinding of linear material to address one or more of these issues, among others.

In addition, some existing methods of winding linear material have encountered problems related to winding an end portion of the linear material around a spool member. Moreover, in some existing methods of winding linear material, suspending the winding of linear material has been implemented substantially the same way for all circumstances, rather than customizing when winding is suspended based on winding conditions. Accordingly, a need exists for improved winding of linear material to address one or more of these issues, among others.

For the purposes of addressing these issues and for other reasons, it is often desirable to know how much material has been unwound from such a device, how much material remains spooled, or when or if a threshold amount of material has been unwound or remains spooled.

SUMMARY OF CERTAIN INVENTIVE ASPECTS

Accordingly, a need exists for an automatic device that assists a user when attempting to deploy (withdraw, unwind, unspool) a linear material (for example garden or industrial hose, cable, electrical cord, and the like) by pulling it out from the device. The device should preferably assist the user in such a way that the development of slack in the linear material during deployment is limited or prevented. This feature is referred to as "reverse assist", "powered assist", "powered unspooling", and the like. In some instances, the linear material may have a proximal end portion and a distal end portion. The distal end portion is that portion of the linear material which is first deployed from the device during unwinding and, when the linear material is being wound, is the last portion to be wound onto the rotatable spool member. The proximal end portion is at the opposite end of the linear material from the distal end portion and is, e.g., adapted to engage a fitting on the spool member about which the linear material is wound. The automatic device may also assist the user in retracting the linear material (hereinafter also referred to as spooling or winding). In addition, there is a need for an automatic device that limits the opportunities for the proximal end portion of the linear material to be unwound and therefore reduces the risk that pulling out or otherwise unwinding the proximal end portion will result in fatigue, leakage, joint damage, or similarly problematic developments.

In certain embodiments, the automatic device actively assists a user attempting to withdraw linear material from it. For example, the automatic device may sense a back, or reverse, electromotive force (EMF) signal created by the reverse spinning of the motor when the user pulls the linear material from the device. Upon the sensing of the reverse EMF signal, a controller causes the motor to rotate such that the linear material is deployed from the device. In another example, the automatic apparatus may sense the rotational velocity of the spool member or the motor, the former caused initially by a user pulling on the linear material which is wound upon the spool member or by the running of the motor, and the latter caused by powering or running the motor or by the rotation of the spool member coupled to the motor.

Some embodiments include a braking mechanism (or, more simply, a "brake") which, when active, resists or substantially prevents rotation of the spool member in at least the unwinding direction. In certain embodiments the braking mechanism is performed by an aspect of the motor, for example by applying a common mode voltage that causes the motor to cease acting to rotate the spool member and to resist that rotation.

In some embodiments, the motor and braking mechanism (if present) can operate at selectable levels of performance. In one such embodiment, pulse width modulation or other mechanisms are used to adjust the duty cycle of one or both of the motor and any brake. In some embodiments, the duty cycles are adjusted based at least in part on the rates of rotation of the motor or the spool member, the rates at which linear material is being withdrawn, or changes in those rates. For example, while the rate of withdrawal of the linear material is increasing (i.e., withdrawal is accelerating), the duty cycle of the motor is increased and/or the duty cycle of the brake is decreased. Certain embodiments include maximum rates of rotation or withdrawal which, if reached, will result in one or both of a cessation of further increases in the motor's duty cycle and the establishment of a relatively high brake duty cycle. In some embodiments including a braking mechanism with a variable duty cycle, that duty cycle is maintained at a minimum level when the linear material is being unwound.

In certain embodiments, a controller monitors the amount of linear material wound by the device or unwound from the device. As the device begins to unwind the proximal end portion of the linear material, the device acts to prevent that proximal end portion from being completely unwound. This result can also be obtained without monitoring amounts of linear material movement, by instead directly detecting the position of a portion of the linear material (e.g., by detecting a device or marking applied or installed onto the linear material at a position selected to facilitate the detection of the onset of the unwinding of the proximal end portion). Preventing complete unwinding of the linear material acts to reduce stress that might otherwise cause joint strain, fatigue, failure, and/or leakage at the connection between the proximal end portion of the linear material and the spool member, and can also facilitate smooth respooling by maintaining some of the linear material on the spool member.

Some embodiments include sensors (e.g., magnetic and/or optical sensors) associated with the spool member, the motor, or a shaft or other member associated with the motor. In some such embodiments, the sensors monitor the rotation of the associated apparatus and, based on the number of revolutions or partial revolutions, can be used to determine how much linear material has been unwound and how much remains in the device (e.g., inside a housing that contains the spool member) or on the spool member. In other embodiments, the sensors directly monitor the movement of the linear material to determine how much linear material has been unwound and how much remains in the device or on the spool member. In various embodiments, the sensors can also be used to determine when a threshold amount of material has been unwound or when a threshold amount of material remains spooled or in the device. In general, references to "monitoring rotation" include monitoring rotational displacement (e.g., the amount of rotation), monitoring rotational speed, or both.

In accordance with certain embodiments, a reel apparatus can include a rotatable spool member configured to unwind a linear material as the spool member rotates in an unspooling direction. The reel apparatus can also include a motor configured to be powered to rotate the spool member in the unspooling direction. In addition, the reel apparatus can include at least one magnetic or optical element on a rotating component. The rotating component can include an output shaft of the motor or being coupled with respect to said output shaft. Additionally, the reel apparatus can include at least one magnetic or optical sensor configured to monitor rotation of the rotating component by detecting instances of the magnetic or optical element passing in proximity to the sensor during rotation of the rotating component. The sensor can be removably attached to the motor. The reel apparatus can further include a controller configured to vary power to the motor to rotate the spool member in the unspooling direction based on changes in a pulling force applied to the linear material. The controller can be configured to detect said changes in pulling force based on a signal from the sensor.

According to some embodiments, an apparatus for spooling a linear material includes a spool member, a motor, and a controller. The spool member can be configured to rotate bidirectionally to spool and unspool the linear material with respect to the spool member. The motor can be configured to rotate the spool member. The controller can be configured to monitor a length of the linear material unspooled from the spool member based on an indicator of movement of the spool member obtained from one or more sensors. The controller can also be configured to cause the motor to spool the linear material around the spool member. In addition, the controller can be configured to reduce a rate of spooling of the linear material when the length of linear material unspooled from the spool member becomes less than a first threshold length. Additionally, the controller can be configured to adjust the rate of spooling of the linear material when the length of linear material unspooled from the spool member becomes less than a second threshold length, wherein the second threshold length is less than the first threshold length.

In accordance with various embodiments, a method of winding a linear material can include monitoring an amount of the linear material unwound from a spool member. The method can also include winding the linear material around the spool member at a first velocity. Further, the method can include winding the linear material around the spool member at a second velocity when the amount of the linear material unwound from the spool member is less than a first predetermined amount, wherein a magnitude of the second velocity is less than a magnitude of the first velocity. The method can additionally include winding the linear material at a third velocity when the amount of the linear material unwound from the spool member is less than a second predetermined amount, wherein the second predetermined amount is less than the first predetermined amount, and wherein a magnitude of the third velocity is greater than the magnitude of the second velocity.

A number of embodiments can include a method that includes unwinding a linear material from a rotatable spool member of a reel mounted on a mounting surface so that an unwound length of the linear material equals a ground contact length at which a distal end of the linear material reaches a ground surface below the mounting surface. A user's command is received when the unwound length of the linear material equals the ground contact length. The method can also include responding to the user's command by setting a docking length based on the ground contact length. The method can further include unwinding the linear material from the spool member so that the unwound length of the linear material exceeds the docking length. Additionally, the method can include rotating the spool member in a wind-up direction to being winding the linear material around the spool member; rotating the spool member in the wind-up direction at a second winding rate when the unwound length of the linear material becomes equal to or less than a crawl length that is greater than the docking length, the second winding rate being less than the first winding rate; and rotating the spool member in the wind-up direction at a third winding rate when the unwound length of the linear material becomes equal to or less than the docking length, the third winding rate being greater than the second winding rate.

Some embodiments relate to a reel apparatus that includes a spool member configured to rotate bidirectionally to spool and unspool the linear material with respect to the spool member. The reel apparatus can also include a motor configured to rotate the spool member. The reel apparatus can further include a controller configured to: obtain a motor signal indicative of a torque that is exerted upon the spool member and not produced by the motor; and cause one or more sensors to activate in response to sensing that the motor signal satisfies a threshold, the one or more sensors configured to generate an indicator of movement of the spool member.

According to various embodiments, a method of activating one or more sensors is provided. The method can include monitoring an indicator of a reverse EMF associated with a motor, the motor configured to rotate a spool member to selectively wind and unwind a linear material. In addition, the method can include detecting when a tension of the linear material exceeds a threshold based at least in part on the indicator of the reverse EMF associated with the motor. The method can also include activating a sensor in response to said detecting. The sensor can be configured to detect instances of a magnetic and/or optical element passing in proximity to the sensor during rotation of a rotating component on which the magnetic and/or optical element is disposed. The rotating element can comprise the spool member or another member that rotates when the spool member rotates. The method can further include monitoring rotation of the spool member based at least in part on data generated by the sensor.

For purposes of summarizing the disclosure, certain aspects, advantages, and novel features of the inventions have been described herein. It is to be understood that not necessarily all such advantages may be achieved in accordance with any particular embodiment of the inventions. Thus, the inventions may be embodied or carried out in a manner that achieves or optimizes one advantage or group of advantages as taught herein without necessarily achieving other advantages as may be taught or suggested herein.

DETAILED DESCRIPTION OF CERTAIN EMBODIMENTS

The headings provided herein are for convenience only and do not necessarily affect the scope or meaning of the claims.

Reel Apparatus

Figure 1:
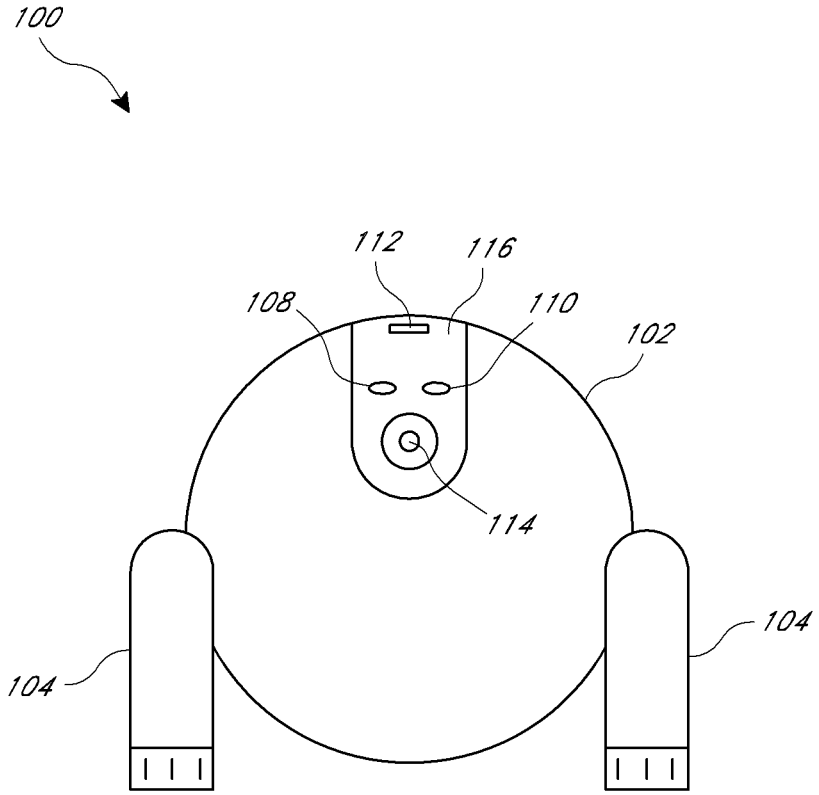
FIG. 1 illustrates a front elevation view of an illustrative embodiment of an automatic device.

FIG. 1 illustrates an automatic device 100 according to one embodiment. The illustrated automatic device 100 is structured to spool a water hose, such as used in a garden or yard area. Other embodiments of the automatic device 100 may be structured to spool air or pressure hoses, cables, electrical cords, other cords, or other types of linear material and may be adapted to be used in home, commercial, or industrial settings. It will be understood that the reel apparatuses described herein need not include the linear material. For example, any of the reel apparatuses described herein may not include linear material that is wound or unwound about a spool member.

The illustrated automatic device 100 comprises a body 102 supported by a base formed by a plurality of legs 104 (e.g., four legs of which two legs are shown in FIG. 1). Alternatively, the body 102 can be supported by a support structure as shown in U.S. Design Pat. Nos. D 632,548 and D 626,818. The body 102 advantageously houses several components, such as a motor, a gear assembly, a braking mechanism, control circuitry such as a brake or controllers, a rotatable spool member onto which the linear material can be wound (such as a spool, reel, drum, or the like), portions of the linear material wound onto the spool member, and the like. The body 102 is preferably constructed of a durable material, such as a hard plastic. In other embodiments, the body 102 may be constructed of a metal or other suitable material. In certain embodiments, the body 102 has a sufficient volume to accommodate a spool member that winds up a standard garden hose of approximately 100 feet in length. In other embodiments, the body 102 is capable of accommodating a standard garden hose of greater than 100 feet in length, such as 140 feet or more. Embodiments can vary as to linear material capacity, as may be suitable for use with smaller or larger amounts of linear material or with similar lengths of linear material with a smaller or larger diameter.

The illustrated legs 104 support the body 102 above a surface such as the ground (e.g., a lawn) or a floor. The legs 104 may also advantageously include wheels, rollers, or other devices to enable movement of the automatic device 100 on the ground or other supporting surface. In certain embodiments, the legs 104 are capable of locking or being affixed to a certain location to prevent movement of the automatic device 100 relative to the supporting surface.

In certain embodiments, a portion of the body 102 is moveably attached to the base to allow a reciprocating motion of the automatic device 100 as the linear material is wound onto the internal device. One example of a reciprocating mechanism is described in more detail in U.S. Pat. No. 7,533,843.

The illustrated device 100 also comprises an interface panel 106, which includes a power button 108, a select button 110 and an indicator light 112. The power button 108 controls the operation of the motor, which controls the spool member and in some embodiments also controls other components, such as a brake, of the device 100. For example, pressing the power button 108 activates the motor when the motor is in an off or inactive state. In certain embodiments, in order to account for premature commands or electrical glitches, the power button 108 may be required to be pressed for a predetermined time or number of times, such as, for example, at least about 0.1 second before turning on the motor. In addition, if the power button 108 is pressed and held for longer than a predetermined time, e.g., about 3 seconds, the automatic device 100 may turn off the motor and/or generate an error signal (e.g., activate the indicator light 112) inasmuch as this might signify a problem with the unit or that the button is being inadvertently pressed, such as by a fallen object, for example.

If the power button 108 is pressed while the motor is running, the motor is turned off. In certain embodiments, the power button 108 may be required to be pressed for more than a predetermined amount of time, e.g., about 0.1 second to turn off the motor.

The illustrated interface panel 106 also includes the select button 110. The select button 110 may be used to select different options available to the user of the automatic device 100. For example, a user may depress the select button 110 to indicate the type or size of linear material used with the device 100. In other embodiments, the select button 110 may be used to select a winding (spooling) speed for the device 100.

The illustrated indicator light 112 provides information to a user regarding the functioning of the device 100. In an embodiment, the indicator light 112 comprises a fiber-optic indicator that includes a translucent button. In certain embodiments, the indicator light 112 is advantageously structured to emit different colors or to emit different light patterns to signify different events or conditions. For example, the indicator light 112 may flash a blinking red signal to indicate an error condition.

In other embodiments, the device 100 may comprise indicator types other than the indicator light 112. For example, the automatic device 100 may include an indicator that emits an audible sound or tone.

Although the interface panel 106 is described with reference to particular embodiments, the interface panel 106 may include more or less buttons usable to control the operation of the automatic device 100. For example, in certain embodiments, the automatic device 100 advantageously comprises an "on" button and an "off" button.

Also, the interface panel 106 may include one or more buttons to control the operating of any braking mechanism of a particular embodiment, and the select button 110 or other interface components may allow users to review and configure parameters for the operation of any such braking mechanism.

Furthermore, the interface panel 106 may include other types of displays or devices that allow for communication to or from a user. For example, the interface panel 106 may include a liquid crystal display (LCD), a touch screen, one or more knobs or dials, a keypad, combinations of the same or the like. The interface panel 106 may also advantageously include an RF receiver that receives signals from a remote control device.

The automatic apparatus 100 may be powered by a battery source. For example, the battery source may comprise a rechargeable battery. In an embodiment, the indicator light 112 is configured to display to the user the battery voltage level. For example, the indicator light 112 may display a green light when the battery level is high, a yellow light when the battery life is running out, and a red light when the battery level is low. In certain embodiments, the automatic apparatus 100 is configured to shut down the motor when the linear material is in a fully retracted state and the battery voltage dips below a certain level, such as, for example, about 11 volts. This may prevent the battery from being fully discharged when the linear material is spooled out from the device 100.

In addition to, or instead of, using battery power, other sources of energy may be used to power the automatic device 100. For example, the device 100 may comprise a cord that electrically couples to an AC outlet. In other embodiments, the automatic device 100 may comprise solar cell technology or other types of powering technology.

As further illustrated in FIG. 1, the automatic device 100 comprises a port or aperture 114. The port 114 provides a location on the body 102 through or over which a linear material may be spooled and unspooled. In one embodiment, the port 114 comprises a circular shape with a diameter of approximately 1 to 2 inches, such as to accommodate a standard garden hose. Other embodiments may have ports with other shapes, such as diamonds or triangles. Some embodiments may have multiple apertures that can be used, or an aperture which can receive an adapter or which is adjustable so as to select a desired shape. In other embodiments, the port 114 may be located on a moveable portion of the body 102 to facilitate spooling and unspooling. In certain embodiments, the port 114 is sized or shaped such that only that portion of the linear material with a particular cross section or of a particular maximum diameter may fit through. In such embodiments, the diameter of the port 114 may be sufficiently small or suitably shaped to block passage of a fitting and/or a nozzle at the end of the linear material, a collar or other device placed around or affixed to the linear material, or a portion of the linear material that is sufficiently large or differently shaped.

A skilled artisan will recognize from the disclosure herein a variety of alternative embodiments, structures and/or devices usable with the automatic device 100. For example, the device 100 may comprises any support structure, any base, and/or any console usable with embodiments described herein.

Figure 2:
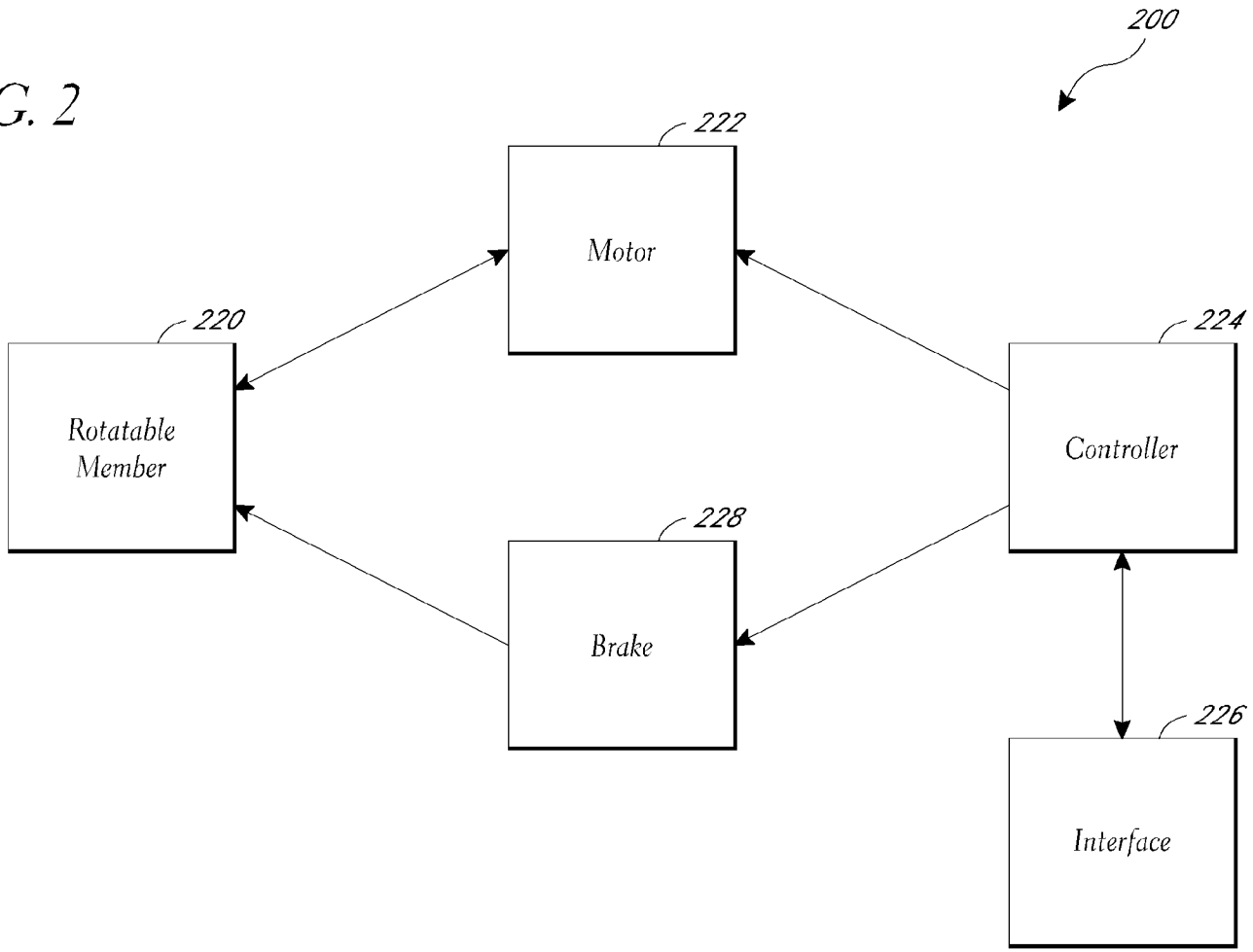
FIG. 2 illustrates a block diagram of an illustrative control system usable by the automatic device of FIG. 1.

FIG. 2 illustrates a block diagram of an illustrative control system 200 usable to control the spooling and/or unspooling of a linear material. In certain embodiments, the automatic device 100 advantageously houses the control system 200 within the housing 102, exposing some or all of the interface 226 via the interface panel 106.

As shown in the block diagram of FIG. 2, the control system 200 comprises a rotatable spool member 220, a motor 222, a controller 224, a brake 228, and an interface 226. In general, the spool member 220 is powered by the motor 222 to spool or unspool linear material, such as a hose. In certain embodiments, the controller 224 controls the operation of the motor 222 or brake 228 based on stored instructions or instructions received through the interface 226. The arrows included in FIG. 2 illustrate a flow of control. For example, the controller 224 can control the motor 222 and the brake 228. The bidirectional arrow between the rotatable spool member 220 and the motor 222 indicates that the motor 222 can control the rotatable spool member 220 and the rotatable spool member 220 can control the motor 222. Similarly, in certain embodiments, the control interface 226 and the controller 224 may control each other. The complete data flow of certain embodiments of the control system 200 is not shown in FIG. 2. For example, the controller 224 may obtain data from the motor 222 and/or the brake 228 according to some embodiments.

In certain embodiments, the spool member 220 comprises a substantially cylindrical drum capable of rotating on at least one axis to spool or unspool linear material. In other embodiments, the spool member 220 may comprise other devices suitable for winding or unwinding a linear material, including spool members that are non-cylindrical or that have a non-contiguous surface onto which the linear material is spooled.

In an embodiment, the motor 222 comprises a brush DC motor (e.g., a conventional DC motor having brushes and having a commutator that switches the applied current to a plurality of electromagnetic poles as the motor rotates). The motor 222 advantageously provides power to rotate or assist with the rotation of the spool member 220 in the unwinding direction, so as to deploy the linear material off of the spool member 220. Preferably, the rotation of the spool member 220 caused by the motor 222 complements efforts by a user to deploy the linear material by pulling on it and thereby reduces the amount of effort the user must exert ("forward assist"). The motor 222 may provide power to rotate the spool member 220 inside the automatic device 100 to spool the linear material onto the spool member 220. This spooling may cause some or all of the linear material to retract into the body 102, or to otherwise accumulate on or near the spool member 220.

In an embodiment, the motor 222 is coupled to the spool member 220 via a gear assembly. For example, the automatic device 100 may advantageously comprise a gear assembly having an about x:1 gear reduction, wherein about "x" revolutions of the motor 222 produces about one revolution of the spool member 220, and wherein "x" is within about 20 to 40, and preferably approximately 28 to 32. In other embodiments, other gear reductions may be advantageously used to facilitate the spooling or unspooling of linear material. In yet other embodiments, the motor 222 may comprise a brushless DC motor, a stepper motor, or the like.

In certain embodiments, the motor 222 operates within a voltage range between about 10 and about 15 volts and consumes up to approximately 250 watts. Under normal load conditions, an embodiment of the motor 222 may exert a torque of approximately 120 ounce-inches (or approximately 0.85 Newton-meters) and operate at approximately 2,500 RPM (corresponding to the spool member 220 rotating, for example, at approximately 800-900 RPM, depending on the gear ratio). Preferably, the motor 222 also is capable of operating within an ambient temperature range of approximately about −25° C. to about 50° C., allowing for a widespread use of the device 100 in various types of weather conditions and climates. In some embodiments, the motor can operate at a variable rate. In preferred embodiments, the motor has an operational maximum rotational velocity in the range of approximately 2000 RPM to 3500 RPM, preferably approximately 2800 RPM. This maximum may be the result of physical properties of the motor 222, power supply, or other components of the device 100. It may also be a "soft" limit implemented mechanically or in the software or circuitry of automatic device 100, such as by the means discussed below.

In certain embodiments, the motor 222 advantageously operates at a rotational velocity selected to cause the spool member 220 to completely retract a standard 100-foot garden hose within a period of approximately 20 to approximately 45 seconds, preferably approximately 30 seconds. However, as a skilled artisan will recognize from the disclosure herein, the retraction time may vary according to the type of motor used, the type and length of linear material spooled by the automatic device 100, and other properties of the device 100.

In certain embodiments, the motor 222 is configured to retract linear material at a maximum velocity in the range of 0.5 to 2 meters per second. In certain preferred embodiments, the motor 222 is configured to retract linear material at a maximum velocity of approximately 1 meter (approximately 3-4 feet) per second. At a given motor 222 rotation rate, the retraction velocity of the linear material may be proportional to the diameter of the layers of linear material wound on the spool member 220. Thus, as linear material is unwound from the spool member, a single revolution of the spool member may unwind decreasing amounts of linear material. For example, in an embodiment with a 100 foot garden hose completely wound around the spool member, a first revolution of the spool member may deploy approximately 48 inches of material, while the last allowed revolution may deploy approximately 24 inches of linear material. A similar relationship holds when winding in the linear material: the more linear material that has been wound around the spool member, the more material that is spooled with the next revolution of the spool member. To maintain the retraction velocity below a selected maximum velocity, the motor 222 may advantageously operate at different speeds during a complete retraction of the linear material. Thus, in order to achieve a relatively high velocity when the linear material is initially retracted, yet stay below a maximum velocity as the diameter of the spool of linear material on the device 100 increases, the rotational velocity (e.g., the RPM) of the spool member 220 decreases as more linear material is spooled onto the device 100.

The motor 222 of certain embodiments operates during linear material deployment with operational characteristics similar to those it has during retraction. For example, in some embodiments the motor 222 operates at a maximum rotational velocity of approximately 2800 RPM during deployment. Embodiments may have higher or lower maximum rotational velocities of the motor 222, and the gearing ratio of the embodiment, the type of linear material, and the nature of the intended use of the embodiment are all factors that may influence the properties of the motor 222 used and the maximum rotational velocity allowed.

Powered Assist

Certain elements and aspects of a preferred device 100 are illustrated in U.S. Pat. No. 7,350,736, to Caamano et al. Some such embodiments include a motor 222, a spool member 220, and a controller 224 and implement powered assisted deployment, "docking" functionality whereby the automatic device reduces its rotational speed during the winding of a distal end portion of the linear material about the spool member, and/or other functionality described in those patents. Certain structures and mechanisms described herein and not shown in the drawings are illustrated in those patents.

In certain embodiments, the automatic device 100 includes a powered-assist function to reduce the effort required by a user to pull (unspool) linear material from the spool member 220 within the automatic device 100. When the user pulls on the linear material, the pulling causes the internal spool member 220 to rotate, which in turn causes the motor 222 to rotate. The powered-assist function counteracts at least a portion of the effect of the gear reduction of the automatic device 100. Gear ratios can be difficult to overcome for a user, and even in embodiments with a neutral clutch, the inertial resistance to rotation of the spool member 220, motor 222, and other components may be significant. Some embodiments of the device 100 may have gear ratios that are on the order of 30-1, such as 31.5-1. Others may have considerably higher or lower gear ratios, as is appropriate for that embodiment.

If the motor is initially inactive or rotating at a rate that is less than that which would be caused by the user's pull alone, the controller 224 may detect that the user is pulling by assessing the response of different elements of the device 100. For example, the pull may increase the tension on the linear material, cause the linear material to deploy at a rate higher than that which would result if the only force acting on the spool member 220 were the motor 222, cause the motor 222 to begin rotating or to rotate at a higher rate than it was previously, or likewise cause the spool member 220 to begin rotating or to rotate at a faster rate than it was previously. The powered-assist process begins when the controller 224 determines, by detecting these or other responses, that the linear material is being pulled to unspool the linear material from the automatic device 100.

These responses can be detected in various ways. For example, in certain embodiments wherein the motor 222 comprises a brush DC motor, the controller 224 senses a reverse EMF to determine when the linear material is being pulled. When the motor 222 is inactive, the controller 224 does not provide power to the motor 222. As the user pulls on the linear material, the turning of the brush DC motor generates a detectable reverse EMF, which is sensed by the controller 224. Some embodiments may respond to the similarly detectable reverse EMF that results from the user's pull ultimately causing the motor to rotate faster than it would if relying only on its own power.

The user's pull can be detected in a variety of ways. For example, various sensor apparatuses and/or mechanical mechanisms can be used to count the revolutions or fractions of revolutions of the spool member 220 over a fixed period. For example, one or more magnets on portions of the spool member 220 or the motor 222 (e.g., on a motor output shaft) can be used to count the number of revolutions using Hall Effect sensors or other sensors that detect changes in a magnetic field. In some embodiments, the sensor apparatus comprises optical sensors which detect light emitted from or reflected by one or more light sources placed on portions of the spool member 220 or the motor 222. In some embodiments, a sensor apparatus is disposed on the spool member 220 or motor 222 output shaft and one or more signal sources (e.g., magnets or lights sources) are disposed on a non-rotating portion. In certain embodiments, the automatic device 100 monitors the current applied to or drawn by the motor 222, and determines the speed of the motor 222 based on the measured current. By determining the speed of the motor 222 and by keeping track of the time during which the motor 222 operates at a particular speed, the controller 224 in the automatic device 100 is able to calculate the number of revolutions of the motor 222. With a known gear ratio, the rotational velocity of the motor 222 can readily be determined from the rotational velocity of the spool member 200, and vice versa.

Once the controller 224 senses the pulling of the linear material, such as by detecting at least a threshold rotational velocity of the motor 222 or the spool member 220 (or a rotational displacement above a threshold fraction of a revolution) in the unwinding or unspooling direction, the controller 224 causes the motor 222 to rotate in the unspooling direction. This powered rotation of the motor 222 causes rotation of the spool member 220, which unspools portions of the linear material such as by ejecting it from the automatic device 100 via the aperture 114. The user's pull continues to exert an influence on the rotation of the spool member 220 and motor 222, and in preferred embodiments is not completely overwhelmed by the power of the motor 222 called for by the controller 224. In certain embodiments, if the controller 224 is initially in a sleep mode, the detection of this pulling causes it to enter an active mode.

In certain preferred embodiments, the motor 222 is controlled such that even when it is powered, it does not cause the spool member 220 to rotate faster than the spool member 220 would rotate under the influence of the user's pull alone. The motor thus gives the user the impression of having to exert less effort and still allows such embodiments to detect when the user has ceased or decreased pulling, because that will result in a decrease in one or more of the rotational velocity of the spool member 220, the deployment rate of the linear material, or the rotational velocity of the motor 222 (which in such an embodiment may be powered by both the torque applied to the associated spool member 220 by the user and by the power directed to the motor). Detecting this decrease can be done using mechanisms related to those used to detect the initial pull, described above. Embodiments may decrease the rotational velocity of the motor 222 in response detecting these events. This may be done, for example, by reducing the duty cycle of a pulse width modulated motor 222 or by reducing the power provided to the motor 222.

In preferred embodiments, the motor 222 is controlled such that as the user increases the force with which she pulls the linear material, power to the motor and hence the rotational velocity of the spool member 220 due to the motor 222 (and not just directly due to the user's pull) also increases. Again, detecting an increase in the torque applied to the spool member 220 by the user can be accomplished by detecting the results of that increase, e.g., a higher rate of deployment of the linear material, a higher rotational velocity of the spool member 220, or a higher rotational velocity of the motor 222, as described above. It is highly preferable that embodiments which increase the rotational velocity of the motor 222 in this fashion also limit power (e.g., electrical power) provided to the motor 222 as described above so that at least a portion of the rate of deployment of the linear material (and the rate of rotation of the spool member 220 and the motor 222) is due to the user's pull and not the other power to the motor 222 alone.

Some embodiments, including some of those that otherwise control the motor 222 so as to allow the device 100 to remain sensitive to changes in the user's pull, may occasionally power the motor with an initial "kick". For example, preferred embodiments of the device 100 kick the motor 222 when the device 100 is at rest and a user's pull is detected. This kick, the powered rotation of the motor 222 in the unspooling direction for a period of time, compensates, in whole or in part, for the resistance to rotation of the spool member 220, motor 222, and other components of the device 100, and contributes to a user having the impression that the linear material and apparatus 100 offer no or little resistance. For example, if the device 100 detects that the rotational velocity of the motor 222 is on the order of 50 or 100 RPM (or, for example, that the rate of deployment of the linear material has increased from approximately 0 to approximately 0.5 or 1 inches per second, or that the rotational velocity of the spool member 220 has increased from approximately 0 to some comparably small but significant value such as a value in the range of approximately 1 to approximately 4 revolutions per minute) then the device 100 may cause the motor 222 to be powered at up to the maximum power allowed by the embodiment for a period of time. Most of the energy of the kick is expended overcoming the rotational inertia of the spool member 220, the motor 222, and associated linear material and components. Once the spool member 220 and motor 222 have started rotating at sufficient rates, the initial kick has served the purpose of helping the user overcome the resistance of the spool member 220 to rotation. In preferred embodiments, the inertia of the components of the apparatus 100 will be overcome to a suitable degree in approximately 3 seconds or less, at which point the initial 'kick' will end. Some embodiments may terminate the kick after a fixed period of time, such as the aforementioned three seconds. Other embodiments may terminate the kick when a particular amount of linear material has been deployed (typically at least approximately two or three feet) or a threshold rate of deployment of the linear material is reached. That threshold rate is preferably less than the rate at which a hypothetical user is expected to withdraw the linear material by pulling. For example, the kick may terminate when the rate of deployment is one foot per second. Given the known relationship in some embodiments between the rate of deployment of the linear material, the rotational velocity of the spool member, and the rotational velocity of the motor, embodiments may use any of these values, measured as discussed above, to determine when to end the kick. Other embodiments, as stated, may kick for a predetermined amount of time. In preferred embodiments, the parameters that control the length of the kick are configurable. More preferably, these parameters, like the other predefined parameters, can be set using the user interface or remote control. In some embodiments, parameters are adjusted by making physical changes to the circuitry, such as by adding or removing jumpers on circuit boards.

Although described with reference to particular embodiments, the skilled artisan will recognize from the disclosure herein a wide variety of alternatives to the powered-assist process. For example, in certain embodiments, the device advantageously supports a "forward" or "kick" interface command to activate the automatic device 100 to operate the motor 222 in the unspooling direction to unwind the linear material from the spool member 220 within the automatic device 100. This interface command may be parameterized by user configurable values such as the amount of linear material to be deployed or the period of time to kick. This interface command may also be sent by remote control.

Figure 3:
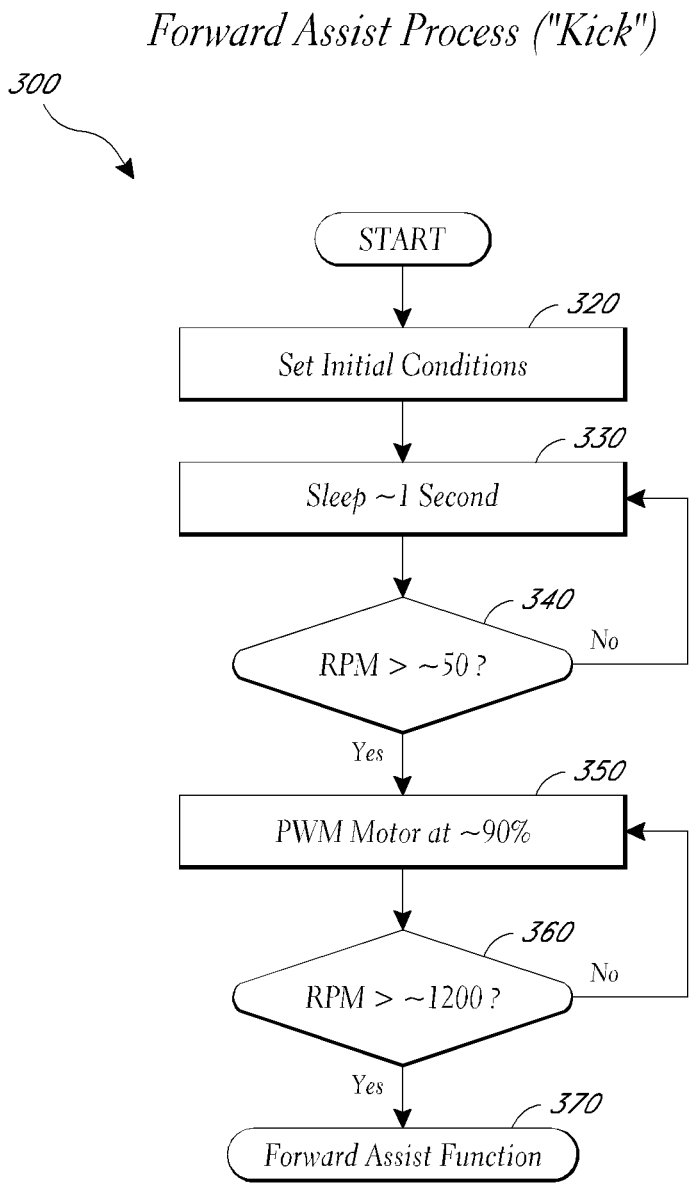
FIG. 3 illustrates a flow chart of an illustrative embodiment of a process which "kicks" or initiates assisted unspooling process usable by the control system of FIG. 2.

An embodiment of the kick process is illustrated in FIG. 3. The process 300 can start when the unit 100 is powered on or reset, for example. At operation 320 initial conditions are set. This may include reading predefined values and thresholds from memory or other storage, or obtaining them from a user, in some cases via prompts which are responded to via a remote control or the user interface or a user's separate computer. Examples of such values include the properties discussed above that determine the length of the kick. They may also include initial duty cycle details and the parameters to be used during the brake and motor duty cycle processes discussed below. Some embodiments may set the brake 228 duty cycle to a relatively high value such as approximately 90% or 100%. Preferred embodiments set the brake duty cycle to 0 and the motor duty cycle to 0 during operation 320. After the initial conditions are set, the process sleeps for a period of time, such as 1 second, in operation 330. Other embodiments may sleep for different times, and this value can be configurable in some embodiments. One of skill will be aware that this operation could be omitted or could be performed after the RPM is tested, as in operation 340. In operation 340 the rotational velocity (of the motor 222 in this embodiment) is tested. If it is less than approximately 50 RPM (or any other defined velocity), the controller goes back to sleep (or, in some embodiments, may perform other functions external to this process). If it is more than approximately 50 RPM (or other defined velocity), then at operation 350 the motor is powered at approximately 90% (or other defined or determinable value) of its duty cycle. Again, in different embodiments this value, like the 50 RPM, may vary, and in some embodiments they are configurable. The illustrated process terminates the kick if the motor's rotational velocity exceeds approximately 1200 RPM (or other defined velocity), which is tested for at operation 360. If it does, then this example process proceeds to invoke a forward assist function at operation 370. That forward assist function may, for example, act to limit the rotational velocity of the motor as described above or it may be the adaptive duty cycle process disclosed below. If the rotational velocity is not in excess of the threshold in operation 360, then the motor continues to be powered at 90% (or other value), per operation 350. A variety of means for testing the RPM in operation 360 can be used, and the test may be conducted at brief predefined intervals, such as 100 milliseconds or less. The rotational velocity of the motor may also be monitored so that the illustrated process 300 is interrupted or alerted when the rotational velocity of the motor exceeds the threshold so that the process referred to in operation 370 can commence. Some embodiments may interrupt a process such as the illustrated process 300 in order to prevent the device 100 from exceeding its operational or user-experience parameters.

Controlling the Motor During Powered Assist

The automatic device 100 need not retract or deploy linear material at a constant rate. For example, the spool member 220 may rotate at a constant RPM throughout the deployment process. In such an embodiment, the rate of deployment may decrease as more linear material is unspooled from the device 100 because, if the embodiment is one in which the linear material is coiled about the spool member 220, later revolutions of the spool member 220 unspool less linear material than earlier revolutions because the diameter of the spooled linear material on the spool member 220 decreases. In other embodiments, such as those in which the linear material is deployed using a spool member 220 but in which not-yet-deployed linear material is not stored around that spool member 220, a relatively constant rotational velocity of the spool member 220 may result in a relatively constant rate of deployment of the linear material. Such an embodiment may be used, for example, in association with a linear material which it is inappropriate to store spooled around the spool member 220, such as exposed active electrical wire, or when a linear material or its contents react adversely to the pressure that may result when layers of the linear material are wound on top of each other. In such an embodiment, linear material which is not yet deployed to the user may be stored in an appropriate mechanism within or associated with the device 100, or may be provided to the device 100 from an external source. Such an embodiment may still operate as otherwise described in this disclosure, but only a limited amount of the linear material is on the spool member 220 at any time. That amount may range, for example, from a fraction of the spool member's circumference to an amount sufficient for three or more revolutions of the spool member 220.

In a particularly advantageous embodiment, the rotational velocity of the motor 222 adjusts in a controlled manner to obtain a desired rotational velocity of the spool member 220, rotation of the motor 222, or deployment of the linear material. One reason such an embodiment is desirable is that it helps to alleviate the development of excess slack during deployment of the linear material and thereby reduces the risk of associated problems. In an illustrative embodiment without this feature, a user may grasp a portion of the linear material in her hand and begin to move away from the device 100. If the user is walking or jogging then while her torso (for example) is moving away from the device 100 at a substantially constant or even increasing rate, her hand holding the linear material may be stationary, may be moving away from the device 100 at a slower rate than her torso, or may be moving closer to the device 100. Slack may develop inside and outside the body of the apparatus 100 during each stride, particularly in embodiments which feature implementations of a powered assist that do not account for this aspect of the human gait. This aspect of the human gait may also affect the user experience and increase wear and tear on components of the apparatus 100 if not accounted for. For example, certain embodiments may react poorly to the repeated "jerking" on the linear material: periods of rapidly falling tension (culminating in moments of little or no tension) followed by periods of rapidly increasing tension. The human gait is not the only source of this type of variation. For example, an individual unspooling the linear material by pulling it with a hand over hand motion may cause a similar effect.

Slack or excess deployment can be a problem both inside the device 100 and outside it. Outside the device 100, excess linear material may coil, kink, or knot, for example. This can have a deleterious effect on the utility of the linear material (for example, by impeding the flow of a liquid through a hose), present a safety hazard (users may trip over excess material or get tangled in loops), and affect the operation of the device 100 (for example, by preventing the linear material from being retracted through the aperture during spooling). Inside the device 100 (or proximate to the spool member 220), excess deployment can also be problematic because, for example, the unwanted looseness may impede the operation of device 100 components and may cause kinks or knots which prevent the linear material from being deployed through the aperture 114 or from being efficiently or predictably spooled or unspooled from the spool member 220.

In addition to experiencing problems associated with slack, automatic devices with implementations of powered-assist functionality other than those disclosed herein may overreact or underreact in response to variations in a user's pulling force on the linear material, such as the variations associated with the human gait, causing the motor to start and stop frequently or otherwise overwhelming the operational limitations of the components. Users may experience this as more frequent increases or reductions in the resistance to their pulling efforts.

Preferred embodiments of an automatic device 100 address or overcome this type of variation in pull. For example, an embodiment may feature a motor electrically powered according to a variable duty cycle, such as that caused by pulse width modulation (PWM) in accordance with well-known techniques. In particular, the controller 224 of such an embodiment may control the speed of the motor 222 by varying the duty cycle of the DC current applied to the motor 222. With appropriate components, the same effect can be obtained for AC current.

Such an embodiment of an automatic device 100 adjusts the duty cycle of the motor 222 in accordance with the rate of change in the rotational velocity of the motor 222. When the rotational velocity of the motor 222 in the unspooling direction increases, the duty cycle of the motor is set to a value that depends on the rate of increase of the motor velocity—i.e., its acceleration. The correlation between the detected acceleration and the resulting duty cycle can be implemented in software or circuitry and may, for example, be calculated algorithmically or determined using lookup tables or circuits.

An automatic device 100 need not measure the rotational velocity of the motor or spool member, or the rate of change of these measures, on a continuous basis. For example, in a preferred embodiment the rotational velocity of the motor is measured at intervals, such as every 100 milliseconds. If the rotational velocity at a first time is lower than at the next time, the motor is accelerating and the motor is set to operate at a higher duty cycle. For example, the controller in an embodiment may be configured to operate in accordance with the process 400 set out in FIG. 4, which is now described.

A first rotational velocity of the motor, RPM1, is measured at block 410. After waiting a defined time delay (for example, 100 milliseconds) at block 415, the rotational velocity is again measured and stored as RPM2 at block 420. Optionally, an embodiment may cut short this process upon detection that the rotational velocity of the motor exceeds a preconfigured maximum value (for example, such as 2800 RPM) at block 425. If it does, then the duty cycle of the motor is not increased but may be reduced, set to substantially zero, or maintained at its current level. Preferably, the duty cycle is set to substantially zero to avoid operating the motor when it is running at or near the maximum rotational velocity. Although the test at block 425 is shown as applying to RPM2, in some embodiments a similar test is performed after measuring RPM1, and some embodiments test both RPM1 and RPM2 in such a manner.

In the next series of operations of the illustrated process, if RPM2 exceeds RPM1 by approximately a first defined amount (e.g., 200 revolutions per minute) at block 430, the duty cycle of the motor is set to a first corresponding value (e.g., approximately 90%) at block 435. If RPM2 does not exceed RPM1 by the first amount at block 430, but exceeds RPM1 by approximately a second defined amount that is smaller than the first amount (e.g., 100 RPM) at block 440, the duty cycle of the motor is set to a second corresponding value (e.g., approximately 80%) at block 445. If RPM2 does not exceed RPM1 by the second amount at block 440, but exceeds RPM1 by approximately a third defined amount that is smaller than the second amount (e.g., 50 RPM) at block 450, the duty cycle of the motor is set to a third corresponding value (e.g., approximately 70%) at block 455. Different differences and different duty cycles may be appropriate in different contexts. In some embodiments, these values are adjustable, and can be updated via the interface 226, by updating the software, or by using jumpers to modify the circuitry.

If RPM2 does not exceed RPM1 by more than a threshold value (e.g., approximately 50 RPM) at block 450, the motor duty cycle remains at the previous level. In other embodiments, a decreasing or a non-increasing motor velocity causes the motor duty cycle to be set to lower levels or to zero. In particular, some embodiments may reduce the duty cycle of the motor or maintain it at its current level if the acceleration of the motor is below a minimum threshold.

The values used in the illustrated process are values which were found to be effective in testing certain embodiments. These values may vary in different embodiments.

An optional operation of the illustrated process 400 shows that if RPM2 is less than a minimum threshold (such as approximately 50 RPM) at block 460, the duty cycle of the motor is set to zero and, in some embodiments, a brake is fully engaged for a defined amount of time (approximately 3 seconds in the illustrated process) at block 470. This captures the idea that if the motor is rotating below a certain threshold, it is unlikely that a user is pulling on the linear material with an intent to deploy it. In certain embodiments, a motor rotating at 50 RPM corresponds to the linear material being deployed at approximately 0.5 inches per second or approximately 0.056 miles per hour. Dropping below this threshold may optionally trigger a hard brake and bring an end to the powered assist process, returning the device 100 to its sleep state at block 480.

In the illustrated process 400, after the duty cycle of the motor is adjusted, the value of RPM1 can be set to the value of RPM2 at block 485 and/or a brake function, described below, can be invoked at block 490. Then, after a time delay (e.g., approximately 100 milliseconds) at block 415, the process 400 can be repeated. In other embodiments, the brake function is not invoked in this way and, if present, is run in parallel (as discussed below).

It will be understood that the actual RPM need not be recorded or measured. Alternatively, another property indicative of the rotational velocity of the spool member or motor can be used. Similarly, although this description is in terms of the rotational velocity of the motor, other properties such as the rotational velocity of the spool member or the rate of deployment of the linear material could also be used.

Controlling the Brake During Powered Assist

Certain embodiments of a device 100 in accordance with the present disclosure may also include a brake mechanism 228 that can be selectively operated to resist or substantially prevent deployment of the linear material. Preferably, the brake operates to resist the rotation of the spool member 220 or the motor 222. In some such embodiments, the brake mechanism 228 is the motor 222: in certain embodiments, applying a common mode voltage to the motor 222 will cause it to stop rotating and resist future rotation. The brake may also be implemented using a variety of implementations known to those of skill in the art, including mechanical and electromechanical mechanisms for implementing drum and disc brakes and techniques associated with antilock braking mechanisms. For example, disc or drum brakes can be configured to act against the spool member or the motor, and such a brake may be associated with an actuator which is controlled by the controller 224.

In preferred embodiments, the brake 228 has a duty cycle: a percentage of a given period during which it is active. A duty cycle of 100% (or 100) is a brake that is fully engaged for the entire cycle period. A duty cycle of 0% is a brake that is inactive for the entire cycle period. A duty cycle of 50% represents a brake that is engaged for half of the period. Certain embodiments dynamically control the duty cycle of the brake in response to the rate of rotation (rotational velocity) of the motor or rotational member (or the deployment rate of the linear material) and changes in such rates. Such embodiments implement protocols to generally cause the duty cycle of the brake to increase if the rate of change in the rotational velocity of the motor is negative (i.e., the motor is slowing).

Figure 5:
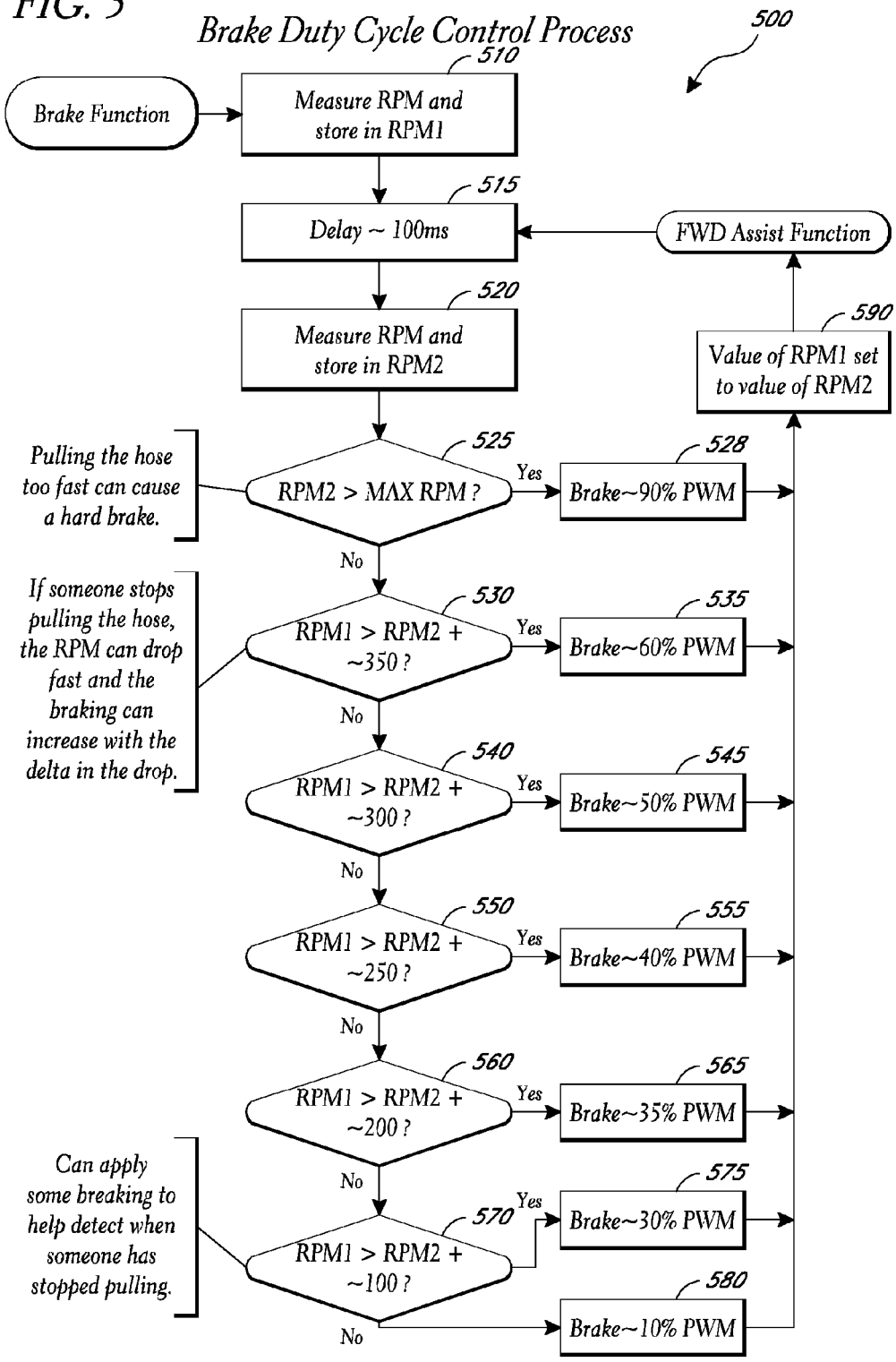
FIG. 5 illustrates a flow chart of an illustrative embodiment of a brake duty cycle control process usable by the control system of FIG. 2.

For example, an embodiment may implement the process 500 illustrated in FIG. 5. A first rotational velocity of the motor, RPM1, is measured at block 510. Optionally, the embodiment may compare RPM1 to a predefined maximum rotational velocity and if RPM1 exceeds that value then the brake duty cycle is set to a relatively high value (e.g., 90%-100%).

A second rotational velocity of the motor, RPM2, is measured at block 520 after waiting for some time interval, such as approximately 100 milliseconds, at block 515. Again, some embodiments may test to see if RPM2 exceeds the specified maximum rotational velocity (for example, 2800 RPM) at block 525. When RPM2 exceed the specified maximum rotational velocity, then the duty cycle of the brake can be set to a corresponding value (e.g., approximately ~90%) at block 528. In a series of cascading tests, the duty cycle of the break is then set based on the difference between each RPM2 and RPM1. If RPM1 exceeds the new rotational velocity, RPM2, by approximately a first defined difference (e.g., 350 RPM) at block 530, then the duty cycle of the brake is set to a first corresponding value (e.g., approximately ~60%) at block 535. Otherwise, if RPM1 exceeds RPM2 by approximately a second defined difference which is less than the first defined difference (e.g. 300 RPM) at block 540, then the duty cycle of the brake is set to a second corresponding value (e.g., approximately 50%) at block 545. Otherwise, if RPM2 is more than approximately a third defined difference (e.g., 250 RPM) less than RPM1 at block 550, then the duty cycle of the brake is set to a third corresponding value (e.g., approximately 40%) at block 555. Otherwise, if RPM2 is more than approximately a fourth defined value (e.g., 200 RPM) less than RPM1 at block 560, then the brake duty cycle is set to a fourth corresponding value (e.g., approximately 35%) at block 565. Otherwise, if RPM2 is more than approximately a fifth defined value (e.g., 100 RPM) less than RPM1 at block 570, then the brake duty cycle is set to a fifth corresponding value (e.g., approximately 30%) at block 575. Otherwise, the brake duty cycle is set to a defined value, such as approximately 10% at block 580. After setting the brake duty cycle, the value of RPM1 can be set to the value of RPM2 at block 590.

Figure 4:
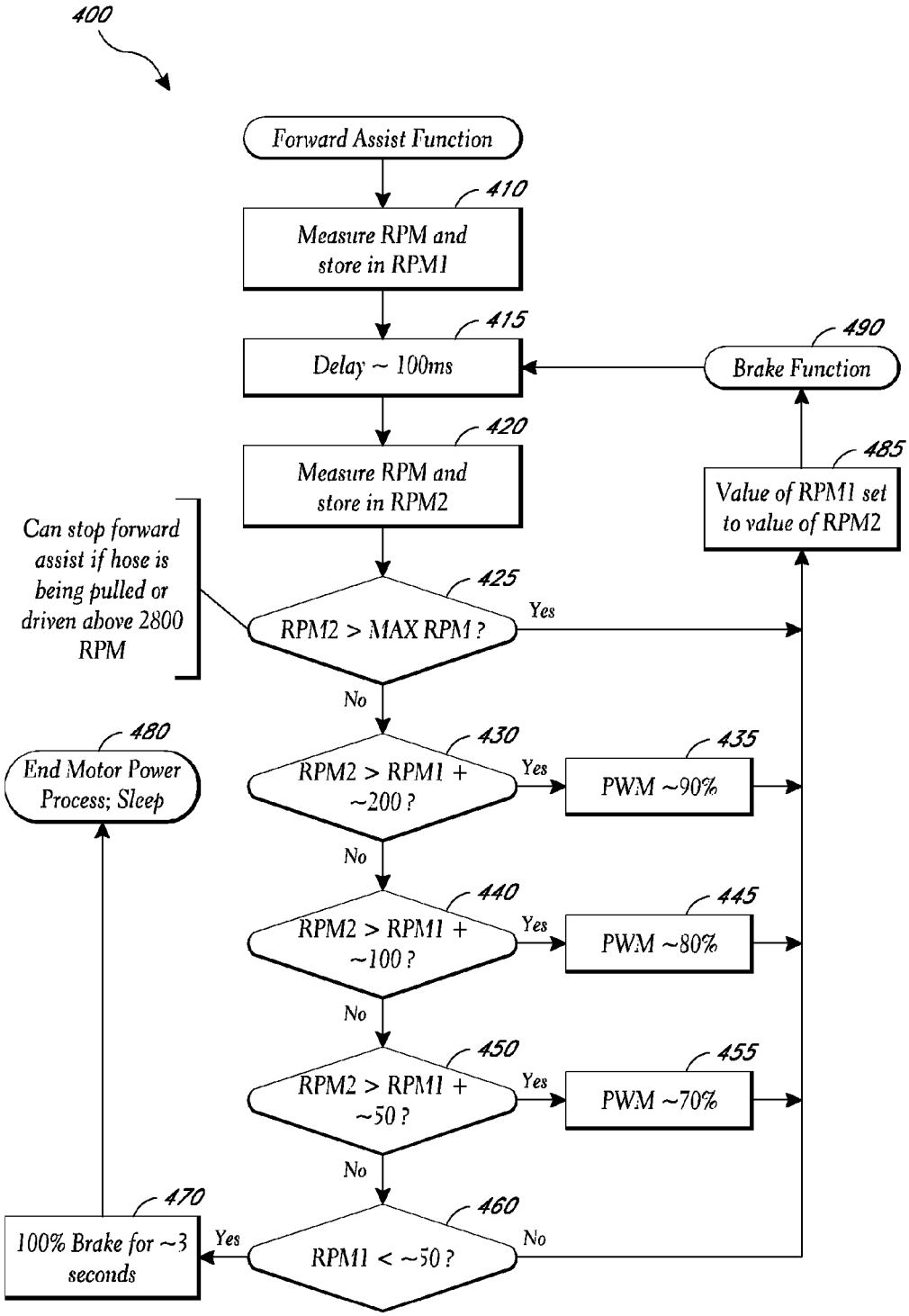
FIG. 4 illustrates a flow chart of an illustrative embodiment of a motor duty cycle control process usable by the control system of FIG. 2.

As with the illustrative motor duty cycle process 400 in FIG. 4, the values in the process illustrated in FIG. 5 are merely illustrative for particular embodiments and were determined by a combination of theory and experiment. Some embodiments implement more adjustment levels for the brake duty cycle control process than for the motor duty cycle control process, as shown. Other embodiments may use more or fewer levels and have the same or different number of tests for the brake and motor duty cycle processes. Embodiments may also use different values for rates of change and for corresponding duty cycles in the brake duty cycle process and the motor duty cycle process. The larger values for difference in rates of rotation in the brake duty cycle as compared to the motor duty cycle (e.g., reacting to differences of 250, 300, and 350 revolutions per minute in the illustrated brake duty cycle process) reflect the observation that in some embodiments the rotational velocity of the motor may drop relatively rapidly (e.g., on the order of 350 revolutions per minute in a 100 millisecond interval) if the user stops pulling on the linear material or substantially decreases the force with which she is pulling.

Some embodiments may control the operation of a braking mechanism 228 and not the operation of the motor 222. Other embodiments may implement control over the motor 222 but not over a braking mechanism 228. Preferred embodiments control both the braking mechanism 228 and the motor 222.

There are a number of ways an embodiment can combine brake control and motor control. For example, some embodiments may simply run the two processes substantially independently and in parallel. Continuing with the example processes of FIGS. 4 and 5, every, e.g., 100 milliseconds the rotational velocity of the motor is regulated by a brake control process and a motor control process. Each then proceeds substantially as described above. For example, if the rotational velocity exceeds the predefined maximum, then the motor duty cycle process sets the motor duty cycle to 0 and the brake duty cycle process sets the brake duty cycle to 90%, substantially simultaneously.

Some embodiments may interleave the duty cycle control processes such that, for example, when the rotational velocity of the motor is first measured it is tested against the maximum RPM. After a time period (e.g. 100 milliseconds), the rotational velocity is again measured, and then it is compared to the previous value according to the process 400 of FIG. 4 or the process 500 of FIG. 5, but not both. After another time period (e.g., 100 milliseconds), the rotational velocity is measured again and a comparison is processed according to the process 400 or 500 that was not run after the previous measurement. This interleaving means that the brake duty cycle and motor duty cycle are each adjusted according to the processes 400, 500 every two time periods (e.g., 200 milliseconds), although the rotational velocity of the motor is measured every single time period (e.g., 100 milliseconds). Certain embodiments may increase the frequency at which the motor's rotational velocity is measured to obtain a preferred update rate for the motor and brake duty cycles.

The brake control process and motor control process can be implemented by a single controller or circuit or by separate circuits or controllers. In particular, if the brake is implemented by setting a common mode voltage across the motor, then the duty cycle of the motor and the duty cycle of the brake may be set by common circuitry or a common controller controlling the motor.

It will be understood that although FIGS. 4 and 5 illustrate processes that take discrete measures of the rotational velocity of the motor and assess the change between earlier and later rates, some embodiments may continuously or substantially continuously measure the acceleration or deceleration of the motor. Such embodiments may, for example, make use of integrators or frequency detectors that measure the rate of the change in the current, voltage, or power drawn by the motor. Other solutions may measure the rate of change in the rotational velocity of the motor through, for example, magnetic, optical, or mechanical sensors associated with processes which continuously calculate the rate of change in the frequency at which the motor or spool member is rotating.

While the above discussion was phrased in terms of measuring the rotational velocity of the motor, it will be understood that embodiments can be built according to this disclosure in which the controllers react to changes in the rotational velocity of the spool member or the rate of deployment of the linear material.

Limiting Powered Assist

As described above, in some implementations, the device 100 can detect a pull on a linear material and cause the motor 222 to rotate the spool member 220 so as to assist with unspooling the linear material. As more linear material is unspooled from the spool member 220, a total mass/weight of the spool member 220 and the linear material spooled thereon can decrease. This reduction in the total mass of the spool member and wound linear material can reduce a magnitude of a pulling force required to unspool the linear material from around the spool member 220. When more than a certain amount of linear material is deployed, the magnitude of the pulling force required to deploy the linear material can be sufficiently small such that powered assist may be less useful. Accordingly, powered assist may consume excess power deploying linear material when there is a relatively small mass of linear material wound around the spool member 220. Alternatively or additionally, powered assist can exert wear and tear on the motor 222 without providing much benefit when a relatively small amount of linear material is wound around the spool member 220.

When a certain amount of linear material is unspooled from the spool member 220, powered assist functionality can be deactivated. Deactivating powered assist in such circumstances can reduce an amount of power consumed by the motor 222 and/or the reel apparatus as a whole. In some embodiments, the controller can implement powered assist for unspooling only an initial portion of a total length of the linear material. Beyond deploying the initial portion, a magnitude of a pulling force required to unspool additional linear material can be small enough such that powered assist may be of reduced and/or limited value. For instance, the power consumed by powered assist may outweigh the benefit of powered assist when linear material is unspooled beyond the initial portion. After deploying the initial portion, power assist can be disabled from further assisting the user in subsequent deployment of linear material.

A "powered assist length" can correspond to an amount of linear material unwound from the spool member 220 beyond which powered assist functionality can be deactivated. Once the powered assist length of linear material is unwound from the spool member 220, a controller, such as the controller 224, can cause powered assist functionality to cease for further unwinding and/or prevent the device 100 from initiating powered assist to unwind additional linear material beyond the powered assist length. In some implementations, the powered assist length can be, for example, within a range of about ⅓ to ½ of the total length of the linear material. The powered assist length can depend on a variety of factors, such as mass of the linear material per unit length, total mass of the reel apparatus, the like, or any combination thereof. The powered assist length can be preprogrammed and stored in non-transitory memory. Alternatively or additionally, the powered assist length can be set at the direction of a user, for example, via a user interface panel and/or a remote control and stored in non-transitory memory.

Integrity of Linear Material Connection

As discussed above, it is desirable for some embodiments of an automatic device 100 to prevent all of the linear material from being unwound from the device 100 and to instead ensure that at least a portion of the linear material remains wound around the spool member 220 or within the device 100.

In certain embodiments, the controller 224 determines the number of revolutions of the spool member 220 in the unspooling direction by, for example, monitoring the current applied to the motor 222 or counting the number of revolutions of the spool member with optical or magnetic sensors, so that the length of linear material extracted from the device 100 is known. This value is compared to the known total length of the linear material or to a predetermined value for the maximum length of linear material to allow to be deployed. When that value is reached, a braking mechanism 228 is made active. In some embodiments, the duty cycle of the brake is gradually increased as that maximum deployable length is approached so that the user does not experience a sudden imposing of the brake. For example, at a first threshold, such as with 10 feet remaining before the maximum length is reached, the brake is engaged at a first duty cycle, such as 60%. As the amount of remaining length drops, the brake's duty cycle can be increased. In some embodiments the brake is fully engaged when the maximum deployable length is reached; in other embodiments the brake may operate at a relatively high duty cycle of, for example, approximately 90% or higher.

The length of linear material deployed from the spool member 220 is determinable from the number of revolutions of the spool member 220 and the diameter of the potentially multi-layer spool of linear material on the spool member 220. Thus, as the linear material is deployed, the controller 224 is able to determine when a sufficient length of linear material is deployed such that only the proximal end portion (e.g., the last 15 feet) of the linear material remains spooled about the spool member. When the controller 224 makes this determination, the controller 224 reduces the duty cycle of the PWM pulses to reduce the rotational velocity of the motor 222, preferably to zero. In some embodiments, the controller also activates the brake, as discussed in the previous paragraph.

In other embodiments, lengths other than approximately fifteen feet may be retained as undeployable. For example, the particular length may be set and/or adjustable by the user through, e.g., the interface panel 106. In one embodiment, powered assist is terminated and the brake is enabled when 95 feet of a 100 foot spool of linear material have been deployed.

Embodiments may prevent or substantially prevent further deployment in a variety of other ways. For example, as previously discussed, the number of revolutions can be used to determine the length of linear material deployed or remaining spooled. The number of revolutions of the motor can also be calculated using a variety of electrical and mechanical means as previously disclosed and as known to one of skill in the art. Other embodiments, instead of deriving length of linear material from observed proxies such as the revolutions of the spool member or motor, may compare those revolution counts to predetermined maximum value for the number of revolutions of the spool member or motor, as appropriate. Other embodiments, instead of indirectly measuring the length of linear material deployed, may measure it directly, such as by counting the number of even spaced indicators on the linear material that have passed a sensor or using a variety of other methods known to those of skill in the art for determining the length of linear material that has passed through an aperture, such as by using a single indicator as is disclosed in U.S. Pat. No. 5,440,820 to Hwang.

Rotation Sensors

Figure 8:
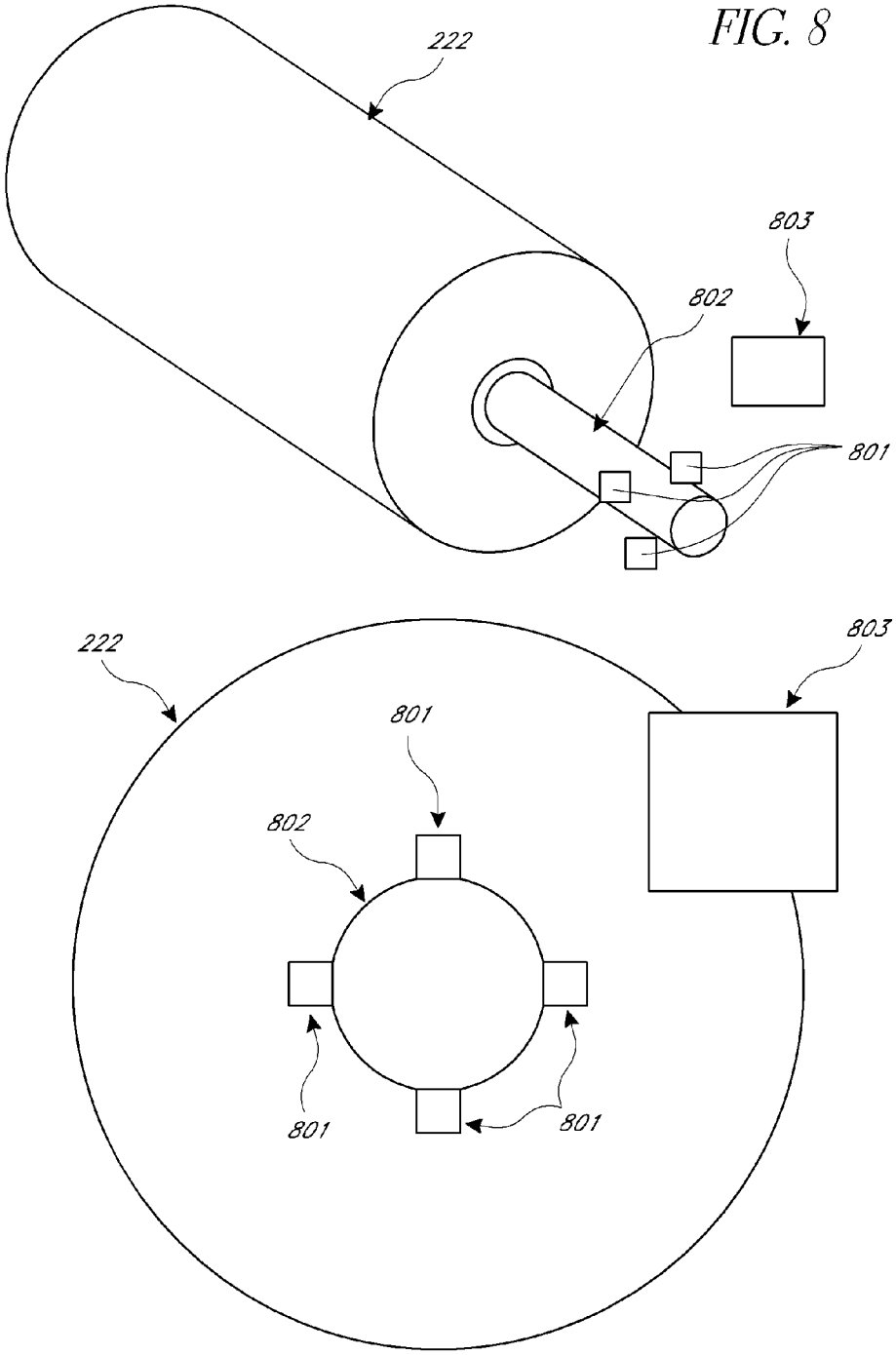
FIG. 8 illustrates an embodiment of a sensor apparatus associated with a motor.
Figure 9:
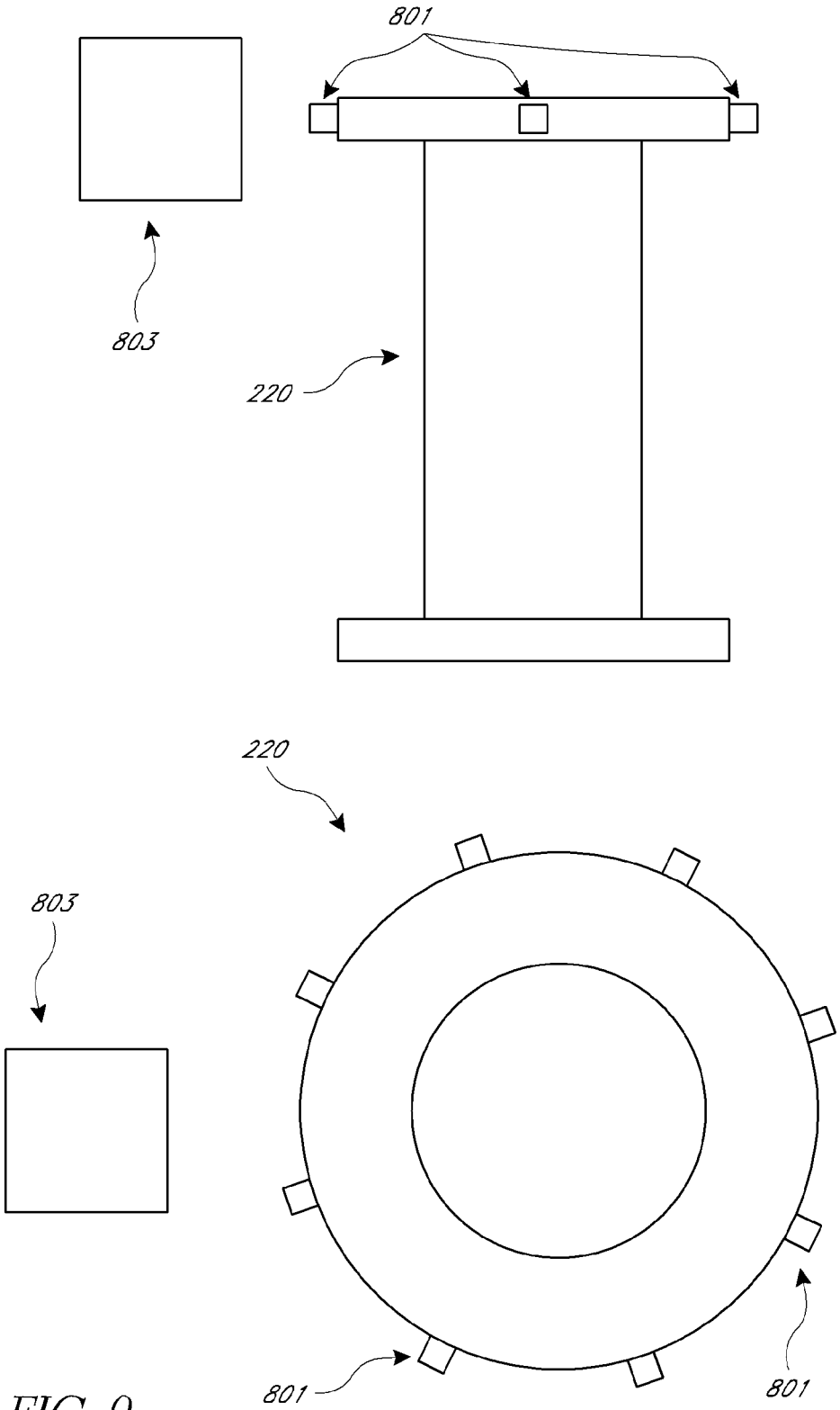
FIG. 9 illustrates an embodiment of a sensor apparatus associated with a spool member.

FIGS. 8 and 9 are illustrative examples of embodiments that monitor the amount of linear material deployed from or remaining on or within a reel device, through the use of sensors such as Hall Effect sensors or optical sensors. As shown in FIG. 8, one or more sources 801, such as magnets, reflectors, or lights, are associated with (e.g., disposed on) a shaft or axle 802 which is operationally rotated (directly or indirectly) by the motor 222. A sensor 803 detects the passage in close proximity of each of the sources 801 as the shaft 802 rotates. For example, when a source 801 passes within about 0.25 inches to 1 inch of the sensor 803, the sensor 803 can detect that a source 801 has passed. The relative positioning of the sensor 803 and the sources 801 is done in accordance with their respective properties, as is known in the art. In some embodiments, this sensor/source mechanism may be wholly or partially integrated with the motor 222 such that when an embodiment of an automatic reel is assembled, a controller 224 is operationally connected to the sensor/source mechanism of the motor 222 and receives, via that connection, signals indicative of the rotation of the motor shaft 802 as measured by the integrated sensors 803 and sources 801. FIG. 8 illustrates two substantially similar embodiments from different perspectives, involving the use of four sources 801. Generally, the more sources 801 that are used, the more precise a measurement of rotational velocity or displacement the sensor 803 can detect, up until the point at which the sources 801 are so close to one another that they interfere with each other and cannot be distinguished by the sensor 803.

Although the embodiments illustrated in FIG. 8 each have a single sensor 803, two or more sensors 803 may be used in some embodiments. Multiple sensors 803 may provide redundancy of measurement, mitigating the risk of failure of one or more of the sensors. For example, circuitry associated with sensor/source mechanism may detect failure of one or more sensors 803 and rely upon input from remaining sensors, may weight data depending on how many sensors 803 report it, or use any of a variety of approaches known to those of skill in the art for achieving redundancy and failure support from multiple inputs. An embodiment may use multiple sensors 803 to determine both a direction and rate of rotation. For example, if after a period of no or substantially no rotation, rotation is detected at a first sensor and then a second sensor, the controller 224 (FIG. 2) may conclude that rotation is likely occurring in one direction. If, after a period of no or substantially no rotation, rotation is detected at the second sensor and then the first sensor, the controller 224 may conclude that rotation is occurring in the opposite direction. Such a period may be a fraction of a second (such as 0.1 or 0.5 seconds, or less) or one or more seconds or minutes (such a 1, 1.5, 2, 5 or 10 seconds, or longer). The period may be predetermined or it may be dynamically established. It may be based in whole or in part on the properties of the sensor/source mechanism, the properties of the motor 222, the configuration of the automatic device 100, a user's preferences, or a combination of some or all of these. Multiple sensors 803 can also be used to determine likely direction of rotation without requiring a preliminary period of no or substantially no rotation. For example, if rotation has been detected by a first sensor and then a second sensor, in that order, and then is detected by the second sensor (again, without an intervening detection by the first sensor) and the first sensor, in that order, it may be likely that rotation has changed direction. Embodiments with multiple sensors 803 may have two, three, four, or more such sensors 803. The sensors 803 may be arranged regularly (e.g., at equal circumferential intervals) around the monitored rotating component containing the sources 801, or may alternatively be grouped closer to each other, as shown in FIG. 12 and FIG. 13.

Control logic and heuristics for a sensor/source mechanism may be contained in software or control circuitry associated with the mechanism. For example, sensor 803 can be interfaced with a microprocessor such as those disclosed herein. In other embodiments, some or all of that logic and heuristics may be in a different controller (which may also use software, hardware, or a combination thereof), such as motor controller 224. A portion of the control logic may be configured to convert observations or data from the one or more sources 803 to data indicative of the rate and/or direction of rotation of the motor 222 or the associated shaft 802. The control logic may do so based on the number and relative positioning of sources 801 and sensors 803. In some embodiments, the control logic may also factor in a predefined relationship between the rate of rotation of the shaft 802 and the motor 222. For example, consider an embodiment with two sensors 803 circumferentially spaced apart by 180° about the shaft 802, and two sources 801 also circumferentially spaced apart by 180° about the shaft 802. In this example, a portion of the control logic might determine that when, over a period of one second, the sensors 803 collectively detected sources 801 four times, then the shaft 802 is rotating at approximately 0.5 to 1.0 revolutions per second (with more information about the initial relative positions of the sensors 803 and sources 801, more precision may be possible). In another example involving the same embodiment, the control logic may observe that it took approximately one second after the first source detection by a sensor 803 for a fourth source detection to be made, and may conclude that the shaft 802 is rotating at approximately 0.5 revolutions per second. A rate and/or direction of rotation of the motor 222 can be determined based on a known or assumed relationship between the rotation of the motor 222 and the rotation of the shaft 802 (which may be one-to-one). In some embodiments, the controller 224 (FIG. 2) receives the output of the sensor(s) 803 and determines, from the sensor output, the rate and/or direction of rotation. In some embodiments, separate control logic (e.g., electronic circuitry and/or a logic chip) provided in conjunction with the sensor(s) 803 and/or source(s) 801 is configured to use the sensor output to determine the rate and/or direction of rotation and to communicate that information to the controller 224.

Another way a configuration of sources 801 and sensors 803 can determine both the amount and the direction of rotation of the shaft 802 (or, as shown in FIG. 9, the spool member 220) and thereby be used to calculate a net amount of rotation is through detection of phase shifting or the like. For example, opto-isolator sensors or other optical sensors will detect not just the passing of the sources, but also the phase shifting of the signals associated with those sources. The phase shift indicates the direction of rotation.

Sources 801 and sensors 803 may be similarly configured with respect to any component of the automatic device 100 if, for example, there is a known relationship between the rotational displacement of the component and the amount of linear material wound or unwound while that component is rotating through the rotational displacement. Just as, in some embodiments, each revolution or portion of a revolution of a motor shaft 802 corresponds to a calculable length of linear material being wound or unwound from the spool member 220, in some embodiments the rotation of elements of a gearbox of device 100 may have a similar relationship such that the sensor-source apparatus is configured to monitor the rotation of a gear operatively coupled with respect to the motor 222 and the spool member 220. Or, as illustrated in FIG. 9, the rotation of the spool member 220 can be monitored using sensors 803 and sources 801. FIG. 9 illustrates the sources 801 mounted on the spool member 220, preferably at positions at which they will typically not be covered by linear material or their detection by sensor 803 not otherwise impeded. In some embodiments, sensors 803 may be disposed on the rotatable component (e.g., the motor shaft 802, spool member 220, or a gear element interposed therebetween), while in some embodiments, including the illustrated embodiments, sources 801 are disposed on the rotatable component.

In general, the number of sources 801 and the number of sensors 803 can vary independently. For example, an embodiment could be configured with multiple sensors 803 and one source 801, or with multiple sensors 803 and multiple sources 801. As stated above, it is typically the case that having more sources 801 or sensors 803 may result in a more precise or finer-grained measurement. Such embodiments may also be more tolerant of failure of one or more sources 801 or sensors 803. It will also be understood that in embodiments where the coupling or engagement between the motor 222 and the spool member 220 is geared, a sensor/source configuration associated with the motor (e.g., as in FIG. 8) or otherwise measuring rotation of the motor's output shaft 802 (as opposed to the spool member 220 or a gear between the shaft 802 and the spool member 220) may be more precise than the same configuration associated with the spool member 220 after the gearing (as in FIG. 9). For example, if two sources 801 are circumferentially spaced apart by 180° about the shaft 802 or spool member 220, and every half revolution can be detected by a single sensor 803, the sensor 803 will be able to report on half revolution increments of the output shaft 802 of the motor 222 (in the embodiment of FIG. 8) or the spool member 220 (in the embodiment of FIG. 9). Suppose that a half revolution of the spool member 220 corresponds to the spooling or unspooling of 12 inches of linear material, depending on factors such as those discussed above, including the amount of linear material currently on the spool member 220 (which affects the spool diameter). A half revolution of the motor shaft 802, if the device 100 has a 30:1 gear ratio, would correspond to the spooling or unspooling of 0.4 inches of linear material. Thus, placing the sensing apparatus on or near the motor shaft 802 may allow a reel device's control system to more finely measure the rotational displacement or velocity, or the linear translation of the linear material. However, there may be operational or production reasons to mount the sensor apparatus in association with the spool member 220, e.g., further from any heat emitted by the motor and closer to the spool member 220 and aperture 114 (FIG. 1).

As mentioned above, sensors 803 and sources 801, be they optical, magnetic, or otherwise, may have their own circuitry for calculating a net number of revolutions in the winding or unwinding direction, which they then make available to a motor controller, or they may send appropriate signals to another component, such as one associated with a motor controller, which is configured to determine such a result from the signals. The motor controller can ultimately use this information, as disclosed herein, to prevent deployment of a proximal end portion of the linear material.

Avoiding "Overspooling"

Overspooling may refer to deploying excess linear material. Overspooling linear material, even in small amounts, can prove problematic. For instance, excess linear material can accumulate inside a housing of a reel apparatus and cause issues with subsequent winding of the linear material. Accordingly, a need exists to avoid overspooling.

In some embodiments, a controller, such as the controller 224, can monitor an indicator of reverse EMF associated with a motor throughout the powered assist process. When the indicator of reverse EMF indicates that a user has stopped pulling on the linear material so as to deploy the linear material from around a spool member, the controller can cause powered assist to cease. However, in some circumstances, linear material may be deployed after powered assist ceases, for example, due to the momentum of the spool member.

A brake can be applied to prevent further unspooling of linear material when rotation of the spool member in the unwind direction is detected when or soon after powered assist has been deactivated. For example, in some implementations, after the controller stops powered assist, rotation sensor(s), such as Hall Effect sensors, can be used to monitor for overspooling by monitoring the rotation of the spool member in the unwind direction. When the sensor(s) and/or the controller detect that linear material is about to or has been overspooled, a brake can be applied to stop continued rotation of the spool member in the unwind direction. Braking can be implemented with any combination of features of the brakes and/or breaking mechanisms described herein, for example, by applying a common mode voltage across the motor, using a mechanical brake, etc. In this way, overspooling can be prevented.

Alternatively or additionally, braking can be applied in response to determining to stop powered assist. For instance, the controller can apply a brake to stop rotation of the spool member in the unwind in response to detecting that a user has stopped pulling on the linear material, for example, based on the indicator of reverse EMF. The brake can be applied around the time the powered assist ceases, for example, anytime from about 2 seconds before to about 2 seconds after stopping powered assist.

"Waking Up" One or More Sensors

As described earlier, one or more sensors 803 can advantageously provide data to the controller 224 for monitoring movement of the spool member 220 and/or the linear material. The movement of the spool member 220 can be monitored in a variety of ways, such as determining a number of revolutions of the spool member 220, a rate at which the spool member 220 rotates, an amount of time for which the spool member 220 rotates, a direction of rotation of the spool member 220, or any combination thereof. The controller 224 can use information related to the movement of the spool member for a variety of purposes, including, for example, determining how much linear material is wound/unwound from the spool member 220 and/or determining the rate at which the linear material is wound/unwound from the spool member 220. Such information can be used in connection with any combination of features described herein, as appropriate. For instance, the data from a sensor 803 can be used in connection with powered assist.

While the sensor 803 can generate useful data related to the movement of the spool member 220, the sensor 803 and related electronics (e.g., at least a portion of the controller 224) can consume energy. This energy consumption can be significant. In some implementations, this can reduce a battery life of a battery associated with one or more components of the control system 200 or any other suitable reel apparatus.

Advantageously, to reduce energy consumption, the sensor(s) 803 and/or related electronics (e.g., the controller 224) of the various embodiments described herein can have a plurality of modes of operation, such as an active mode and a sleep mode. The sleep mode can be entered, for example, when no activity has occurred for a predetermined period of time. The predetermined period of time can be, for example, from about 30 seconds to 2 minutes. The sleep mode can also be entered when a predetermined amount of linear material is wound or unwound. For example, when a maximum amount of linear material is unwound from the spool member, the sensor(s) 803 and/or the controller 224 can enter the sleep mode. As another example, when a maximum amount of linear material is wound around the spool member, the sensor(s) 803 and/or the controller 224 can enter the sleep mode. In yet another example, once the controller verifies that overspooling has been contained within an acceptable limit, then sensor(s) 803 can be deactivated. In some applications, the sensor(s) 803 can be activated at the direction or command of a user, for example, in response to a button push.

In an illustrative example, one or more sensors 803 can generate data for use with powered assist. However, the one or more sensors 803 may be in the sleep mode before powered assist begins. As a result, unless the one or more sensors 803 are activated, they may remain in the sleep mode and the controller 224 will not have access to data from the one or more sensors 803. Alternatively, if the one or more sensors 803 are activated (e.g., powered on substantially always), they may consume unnecessary power. Accordingly, a need exists for waking up the one or more sensors 803 to bring them from the sleep mode to the active mode when certain functionalities can use the data generated by the one or more sensors 803 in a way that maintains low overall power consumption.

The principles and advantages of waking up a sensor can be applied to any number of sensors 803. For example, in an embodiment with four sensors 803, one, two, three, or four such sensors can be activated at any given time. More sensors 803 can be desirable for applications that may benefit from data with greater accuracy. For such applications, the additional power consumption of one or more additional sensors 803 and/or related electronics can be worth the increased accuracy of the data generated by the one or more sensors 803.

Figure 14:
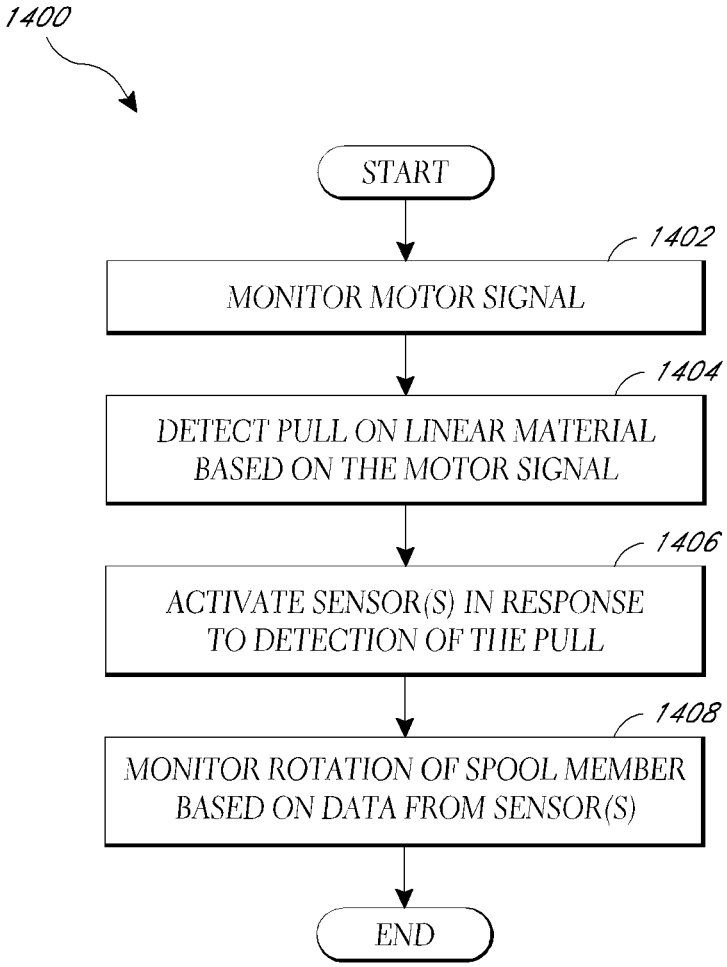
FIG. 14 is a flow diagram of an illustrative method of activating one or more sensors in response to detecting a pull on a linear material according to an embodiment.

Referring to FIG. 14, an illustrative method 1400 of activating one or more sensors in response to detecting a pull on a linear material will be described. Any combination of the features of the method 1400 or any other method described herein may be embodied in a non-transitory computer readable medium and stored in RAM/ROM and/or other persistent non-transitory memory. The computer readable medium may include computer instructions that the controller 224, or any other suitable processor, executes in order to implement one or more embodiments. Moreover, it will be understood that any of the methods discussed herein may include greater or fewer operations and the operations may be performed in any order, as appropriate.

The method 1400 can be implemented, for example, with the automatic device 100, the control system 200, any suitable real apparatus, or any combination thereof. In some embodiments, the method 1400 can be implemented with any combination of features of the sensor apparatuses of FIGS. 8-13. For instance, the method 1400 can advantageously activate one or more Hall Effect sensors according to some embodiments.

At block 1402, a motor signal (e.g., of motor 222 of FIG. 2) can be monitored, for example, while the spool member is at rest. The motor signal can be indicative of, for example, a reverse EMF associated with the motor. A pull on a linear material can be detected based on the motor signal at block 1404. The motor signal may be indicative of a tension of the linear material. In response to sensing that the motor signal satisfies a predetermined threshold, a controller (e.g., the controller 224) can detect a pull on the linear material. For example, when the motor signal indicates that the reverse EMF associated with the motor exceeds the threshold, a pull on the linear material can be detected. In some implementations, the threshold can be set at the direction of a user. According to certain embodiments, a pull can be detected using substantially the same technique as described above in reference to powered assist. In certain applications, the threshold for detecting a pull for purposes of the method 1400 can be higher or lower than for detecting a pull in the context of powered assist.

One or more sensors can be activated at block 1406, in response to detecting the pull on the linear material. The one or more sensors may include, for example, a Hall Effect sensor. The controller can cause the one or more sensors to be activated. This can involve bringing at least one sensor from a sleep mode to an active mode. In some implementations, the one or more sensors can be activated when powered assist begins or shortly thereafter. In other implementations, the one or more sensors can be activated when any suitable application described herein begins or a predetermined period of time thereafter.

Once activated, the one or more sensors can generate data related to movement of the spool member. The generated data can be provided to the controller. Rotation of the spool member can be monitored based on the data from the one or more sensors at block 1408. Monitoring rotation of the spool member can be used for a variety of purposes related to monitoring the motor, the linear material, the spool member, or any combination thereof.

Multistage Docking

Figure 16:
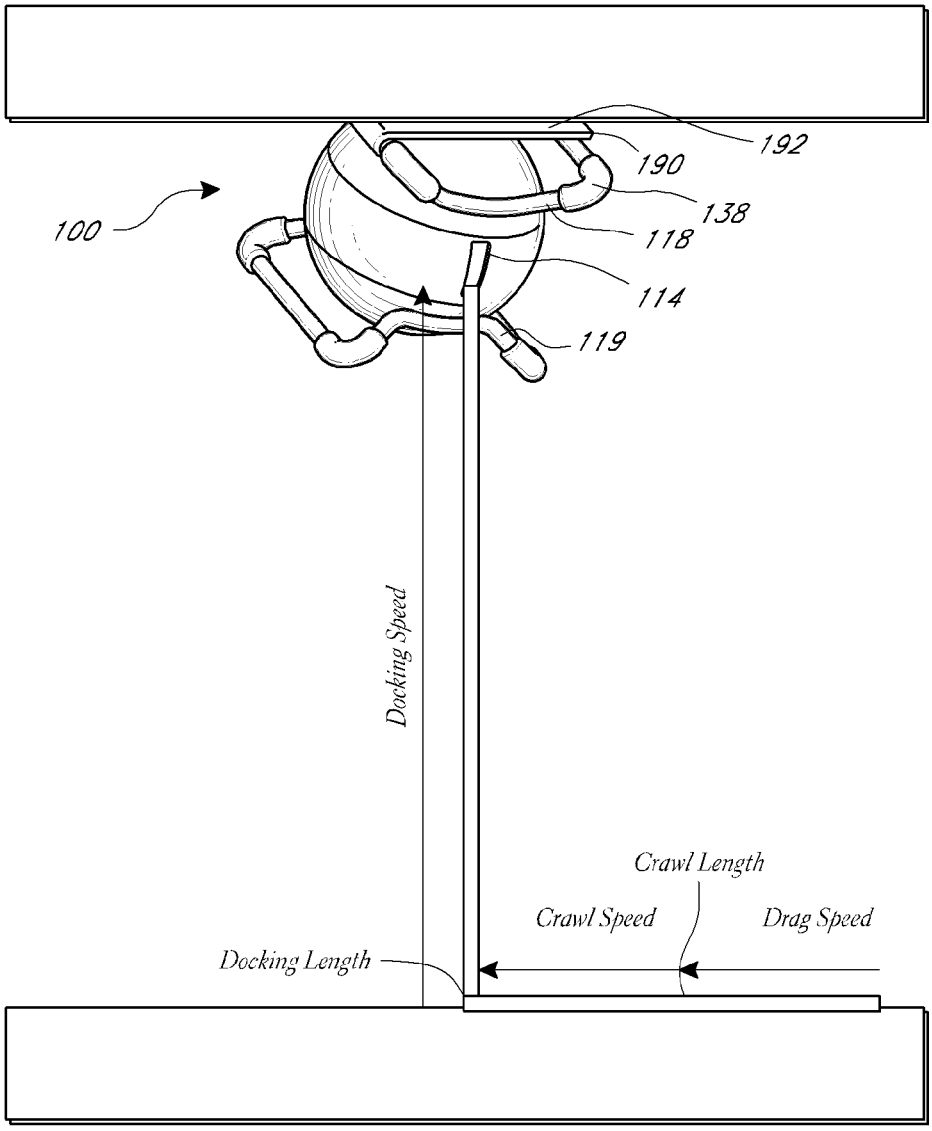
FIG. 16 illustrates an example of an automatic device of FIG. 1 that can wind linear material according to the illustrative method of FIG. 15.

An automatic device 100 can be surface-mounted. For instance, the automatic device 100 may be mounted to a ceiling, a wall, a desktop, a table and/or another surface. One example of a surface mounted automatic device 100 is shown in FIG. 16. In surface-mounted embodiments, the length of an unwound portion of the linear material when a distal end of the linear material reaches the ground surface (or a lower surface other than the ground), especially when the linear material extends substantially along the shortest path from the device 100 to the ground surface (or, perhaps alternatively, the path along which the linear material would extend under gravity), can be referred to as a "ground contact length." As the linear material is spooled such that the unwound portion becomes less than the ground contact length, the linear material loses contact with the ground and may swing back and forth. This may be unsafe, as the swinging linear material could cause bodily injury and/or property damage. In other instances, such as a table mounted automatic device 100, the length of an unwound portion of the linear material when a distal end of the linear material loses contact with the surface upon which the automatic device 100 is mounted, can be referred to as a "surface contact length." In some of these instances (e.g., relatively small tables), any combination of the principles and advantages described herein with reference to the ground contact can alternatively or additionally be applied to the surface contact length. As described earlier, "docking" features related to reducing a rotational speed of a spool member during the winding of a distal end portion of the linear material can reduce swinging of the distal end portion of the linear material. Yet through a multi-stage docking process, swinging of the linear material may be further reduced.

Figure 15:
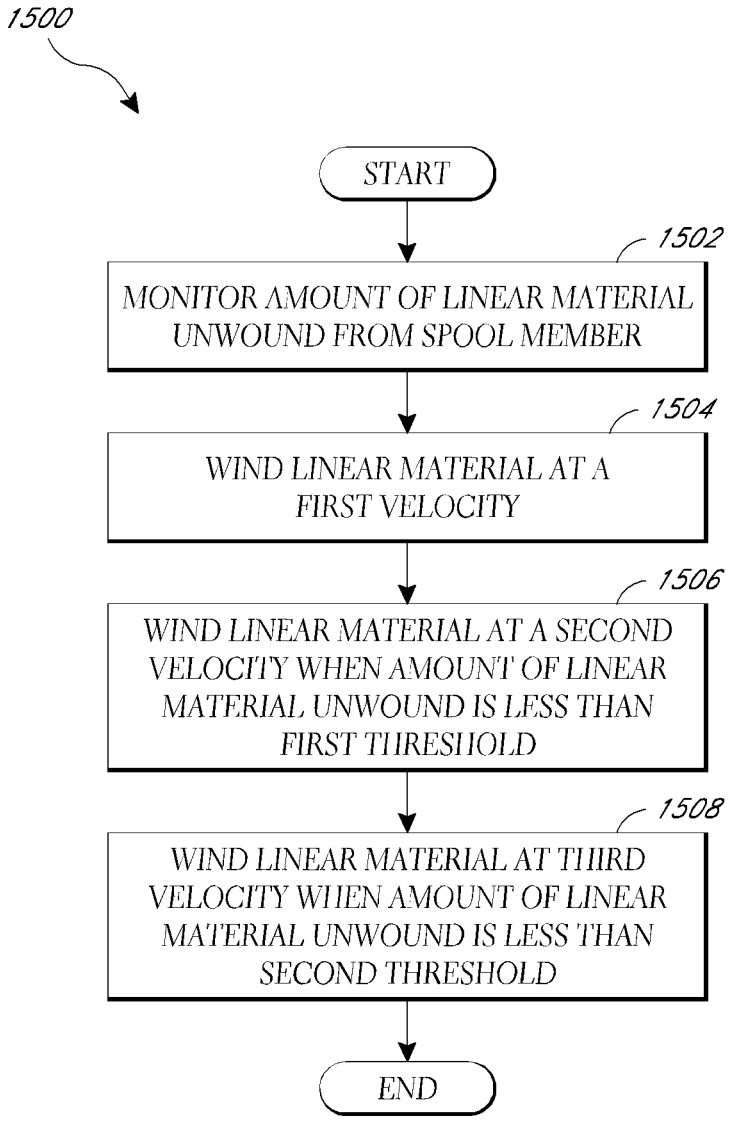
FIG. 15 is a flow diagram of an illustrative method of winding linear material at different speeds according to an embodiment.

Referring to FIG. 15, a flow diagram of an illustrative method 1500 of winding a linear material at different spooling rates will be described. The method 1500 can be implemented with any reel apparatus configured to spool linear material. For instance, the method 1500 can be implemented in connection with a surface-mounted automatic device 100 or any suitable surface-mounted real apparatus configured to spool linear material. In other implementations, the method 1500 can be implemented with a free standing automatic device 100 that is not surface-mounted. In some embodiments, the method 1500 can be implemented with any combination of features of the sensor apparatuses of FIGS. 8-13.

At block 1502, an amount of linear material unwound from a spool member can be monitored. Equivalently, the amount of linear material wound around a spool member can also be monitored. The amount of linear material can be a length and/or a mass, for example. The amount of linear material unwound from the spool member can be determined a variety of ways, for example, using any combination of features described herein. For instance, one or more sensors 803 can generate data indicative of how many times a spool member revolves. From the generated data, a rotational velocity of the spool member and/or a number of revolutions of the spool member can be determined. Such information can be used to determine the amount of linear material unwound from the spool member. It will be understood that the monitoring of block 1502 is preferably conducted on an ongoing basis, including during the subsequent blocks 1504, 1506, and 1508 described below.

A motor can cause the spool member to rotate to wind the linear material. Spooling the linear material can be initiated a number of ways, for example, in response to a user command provided to a controller via an interface and/or a remote control. While the linear material is wound around the spool member, a controller (e.g., a controller 224) can cause the linear material to wind around the spool member at a variety of different rates. These rates can be described in a number of ways, for example, a rate of spooling (amount of linear material per unit time), a rotational velocity of the spool member, and the like. In some implementations, the controller can adjust the rate of winding by adjusting a duty cycle of a pulse provided to the motor using the principles of pulse width modulation.

Linear material can be wound around the spool member at a first velocity (or a "drag speed") at block 1504. The first velocity can represent a rotational velocity of the spool member and/or the amount of linear material spooled per unit time. The first velocity can represent a velocity at which the linear material is wound under typical conditions. In some implementations, the first velocity can range from about 2 to 4 feet per second. While the spool member rotates at the drag speed, the distal end of the linear material may be dragged along the ground, or other lower surface.

When the amount of linear material unwound from the spool member is less than a first predetermined threshold, the linear material can be wound around the spool member at a second velocity (also referred to herein as a "crawl speed") at block 1506. The first threshold can represent an amount of unwound linear material (e.g., a length) that is greater than the ground contact length. The first threshold can be set at the direction of the user, preprogrammed, determined algorithmically, or any combination thereof. Moreover, the first threshold can be set in relation to a second threshold that will be discussed later in connection with block 1508. The second velocity can represent a rotational velocity of the spool member and/or the amount of linear material spooled per unit time. In some implementations, the second velocity can range from about 0.1 to 0.5 feet per second. Thus, the second velocity can be less than 0.5 feet per second in some implementations.

The second velocity can have a magnitude that is less than the magnitude of the first velocity. In this way, a rate of winding of the linear material can be slowed when the amount of unwound linear material is less that the first threshold. Reducing the rate of winding can allow kinetic energy of the linear material to dissipate. For example, kinetic energy can be sufficiently dissipated so as to prevent harmful and/or unwanted swinging of linear material once the linear material loses ground contact. In some implementations, substantially all of the kinetic energy of the linear material can dissipate when the linear material is being wound at the second velocity.

When the amount of linear material unwound from the spool member is less than a second predetermined threshold, the linear material can be wound around the spool member at a third velocity (also referred to herein as a "docking speed") at block 1508. The second threshold can represent an amount (e.g., a length) of unspooled linear material that is equal or nearly equal to (including greater than or less than) the ground contact length. The second threshold can be set at the direction of the user, preprogrammed, determined algorithmically, or any combination thereof. Moreover, the second threshold can be set in relation to the first threshold described in connection with block 1506. The third velocity can represent a rotational velocity of the spool member and/or the amount of linear material spooled per unit time.

The third velocity can have a magnitude that is greater than the magnitude of the second velocity. In this way, a rate of winding of the linear material can be increased when the amount of linear material unwound is less that the second threshold. After kinetic energy of the linear material has dissipated by winding at the second velocity, the linear material can be wound at a higher rate in a way that is less likely to cause injury and/or property damage. In some implementations, the linear material can be wound at the third velocity until substantially all of the linear material is wound around the spool member. For instance, the linear material can be wound at the third velocity until the controller causes the spool member to cease rotation because substantially all of the linear material is wound around the spool member. In some implementations, the third velocity can range from about 1 to 4 feet per second.

Although the method 1500 has been described in connection with three winding rates and two threshold amounts of linear material for illustrative purposes, the principles and advantages of the method 1500 can be applied to methods that include any number of winding rates and/or threshold amounts of linear material.

Referring to FIG. 16, an example of an automatic device 100 configured to wind linear material according to the illustrative method 1500 will be described. It will be understood that any combination of features described with reference to FIG. 16 can be implemented in connection with the method 1500. As illustrated in FIG. 16, the automatic device 100 can be mounted from a surface, such as a ceiling and/or a wall. And, in some implementations, the automatic device 100 can be mounted to two or more surfaces. For instance, the automatic device 100 can be mounted to both a ceiling and a wall. Although the automatic device 100 of FIG. 16 is described in the context of being mounted to a ceiling and/or a wall for illustrative purposes, any combination of features related to multi-stage docking can be applied to other surface-mounted automatic devices 100 and/or non surface-mounted automatic devices 100. For instance, an automatic device 100 configured to perform multi-stage docking can be mounted to a table and/or a floor. Alternatively, an automatic device 100 configured to perform multi-stage docking can be free standing.

The automatic device 100 can be secured to a wall and/or ceiling via a number of ways known in the art. In some embodiments, the automatic device 100 can be mounted to a surface via a mounting element 190. The mounting element 190 can be configured to be secured to a wall or a ceiling, and also configured to support the automatic device by locking onto two of the handle portions 138 of support structures 118 and/or 119 of the illustrated embodiment. The illustrated mounting element 190 includes a generally planar element or plate 192 that can be configured to be mounted to a surface, such as wall and/or ceiling. For example, the planar element 192 can be mounted via nails, screws, nut and bolt combinations, adhesive, and the like. The illustrated mounting element 190 can also include a latch member and a hook member at opposite ends of the planar element 192. The latch member can define a recess that is sized and shaped to receive one of the handle portions 138. The hook member can also be sized and shaped to receive one of the handle portions 138. The mounting element 190 can be configured so that when one of the handle portions 138 is received within the hook member, the automatic device 100 can be rotated about the hook member so that one of the other handle portions 138 partially deflects the latch member and then snaps into the recess thereof, effectively locking the automatic device 100 onto the mounting element 190.

The automatic device 100 can be removably secured to the mounting element 190, as illustrated in FIG. 16. In some embodiments, the mounting element 190 can be locked onto one of the handle portions 138 of the lower support structure 118 and one of the handle portions 138 of the upper support structure 119. In other embodiments, the mounting element 190 can be locked onto both of the handle portions 138 of the upper support structure 119 and/or the lower support structure 118. The automatic device 100 can be configured so that the distance between each of the handle portions 138 of each support structure 118, 119 is substantially equal, so that the mounting element 190 can be removably secured to either support structure, as desired. Further, the distance between a handle portion 138 of the support structure 118 and a handle portion 138 of the support structure 119 on one side of the automatic device 100 can be substantially equal to such distance on the other side of the automatic device 100, so that the mounting element 90 can be removably secured on either side of the automatic device 100, as desired.

Figure 10:
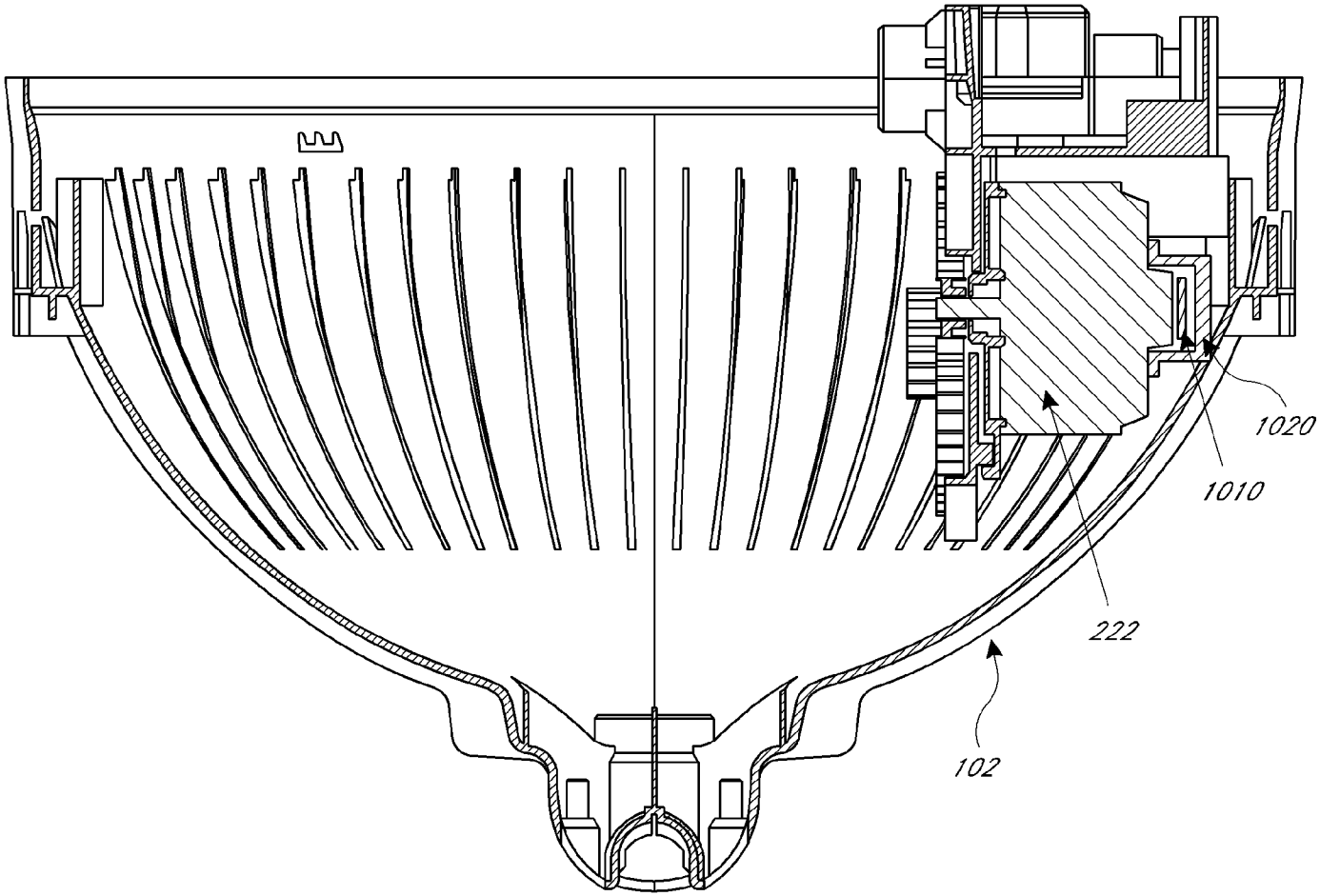
FIG. 10 illustrates an embodiment with a motor having an integrated sensor.
Figure 11:
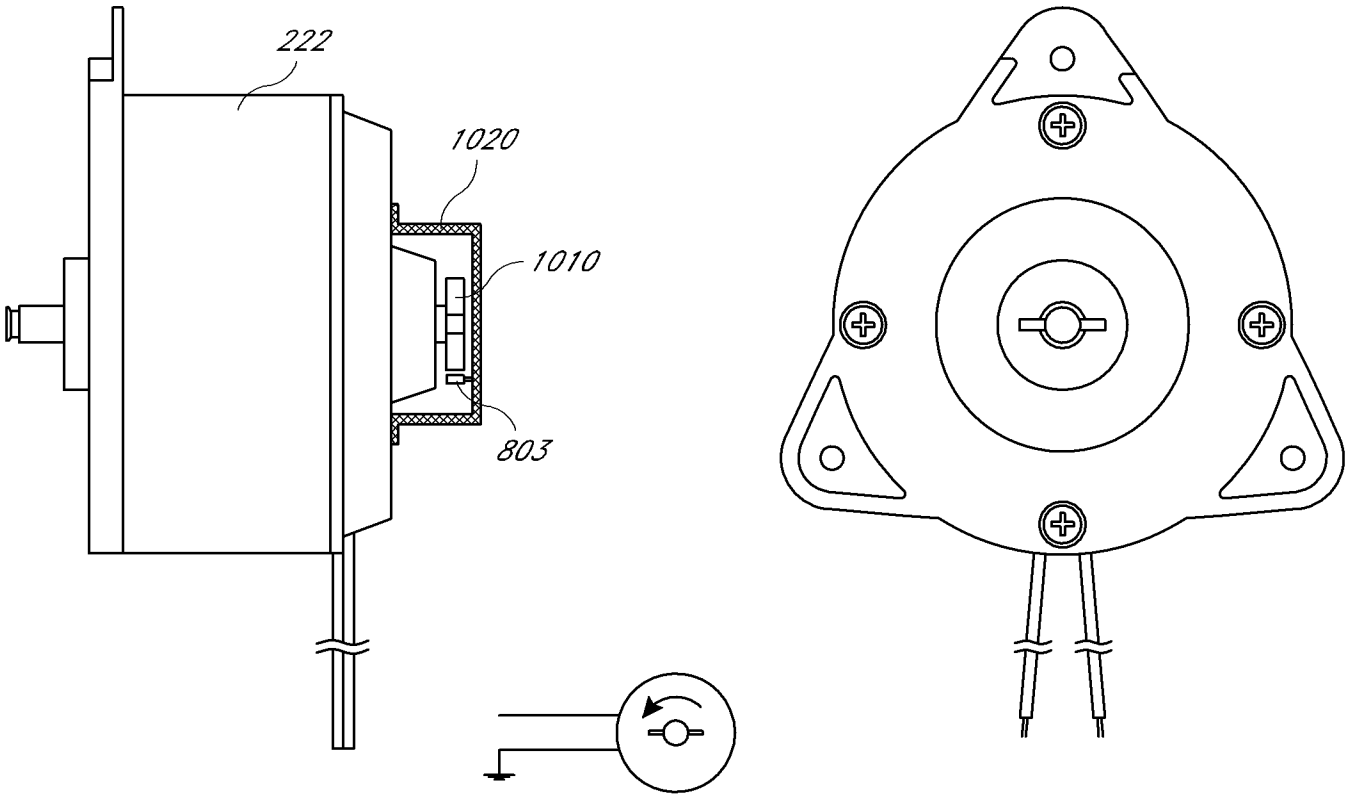
FIG. 11 is a data sheet for a motor that may be used in an embodiment such as that of FIG. 10.

As illustrated in FIG. 16, the automatic device 100 can be mounted to a ceiling via the mounting element 190. Linear material can be unwound and wound from the automatic device 100 through the aperture 114. In an illustrative example, the automatic device 100 can include one or more sensors 803 with one or more sources 801 (FIGS. 8-13) for monitoring the amount of unspooled linear material. In one embodiment, a Hall Effect sensor can detect two magnets mounted on a shaft or axle 180 degrees apart from each other. In other embodiments, any other suitable number of sources 801 can be mounted with respect to the shaft, axle or disc 1010 (FIGS. 10, 11, 13).

The Hall Effect sensor can provide a controller 224 with a rotation indicator each time a magnet passes in proximity to the Hall Effect sensor. For example, when the magnet passes within about 0.25 to 1 inch of the Hall Effect sensor, the Hall Effect sensor can provide the controller with the rotation indicator. The controller 224 can store and/or access computer instructions for multi-stage docking from a non-transitory computer readable medium. The controller 224 can count a number of times that a magnet passes the Hall Effect sensor. For instance, when the linear material is completely wound around the spool member, the count can be zero. The count can represent a number of full and/or partial revolutions of the spool member. Further, the controller can increment or decrement the count based on the direction of rotation of the spool member. Accordingly, the count can correspond to an amount of linear material unspooled from the spool member.

When the linear material is completely unwound, a maximum count can be, for example, fifty-two. The controller can be configured such that the count cannot exceed the maximum count. The maximum count can be used for self calibration. The controller 224 can split the maximum count into a plurality of count segments, for example, six count segments as shown in Table 1.

TABLE 1

| Segment | 1 | 2 | 3 | 4 | 5 | 6 |
|---|---|---|---|---|---|---|
| Counts | 0-7 | 8-15 | 16-23 | 24-31 | 32-39 | >40 |

The plurality of count segments can provide flexibility in adjusting a rate at which a motor causes the spool member to wind the linear material around the spool member. Two or more segments of the plurality of segments can correspond to an equal number of counts. For instance, Segment 1 can correspond to 8 counts and Segment 2 can also correspond to 8 counts. Alternatively or additionally, two or more segments of the plurality of segments can correspond to a different number of counts. For instance, Segment 5 can correspond to 8 counts and Segment 6 can also correspond to 12 counts. In each segment, the linear material can be wound at a different rate. Alternatively or additionally, the linear material can be wound at substantially the same rate for two or more segments. For example, when the linear material is unwound to Segment 6, the linear material can be retracted at a "drag speed." Then when the count reaches Segment 2, the rate of winding can be decreased to a "crawl speed." Finally, when the count reaches Segment 1, the rate of winding can slow to a "docking speed." The docking speed can be a slow speed that allows an end of the linear material to come into contact with a housing 102 of the automatic device 100 at the aperture 114 without slamming into the automatic device 100. For example, the end of the linear material may include an apparatus (e.g., a water-spraying device or a large connector block for one or more electrical device plugs) that is larger than the aperture 114 and unable to pass therethrough.

A "docking length" can correspond to the count at or near winding at the docking speed is initiated. The docking length can correspond to the ground contact length described earlier in reference to the method 1500. For example, the docking length can be equal to the ground contact length. In some implementations, the docking length can be greater than or less than the ground contact length. The docking length can be set to a default value, for example, 8 counts. Alternatively or additionally, the docking length can be programmed at the direction of the user. For instance, when the length of linear material unwound from the spool member is at or near the ground contact length, a user can set the docking length. In some embodiments, the user can provide commands to a controller 224 via an interface panel and/or via a remote control to set the docking length. The controller 224 can store the docking length in memory. In some implementations, the controller 224 can store the count when the user sends a docking length programming command to the controller. Alternatively or additionally, the user can provide commands to the controller 224 via an interface panel and/or via a remote control to set the count to any number up to the maximum count when any amount of linear material is wound/unwound from the spool member.

The controller 224 can also implement a crawl speed functionality. After the docking length is programmed at the direction of the user, the controller 224 can enable the crawl speed functionality in some implementations. This can include programming a "crawl length" of unwound linear material at which winding at the crawl speed can be initiated, for example, by the motor causing the spool member to wind the linear material at a reduced speed. Alternatively or additionally, the crawl speed functionality can be enabled independent of whether the docking length is programmed at the direction of a user.

In one embodiment, the controller 224 can set the crawl length to correspond to a predetermined number of counts (e.g., two counts) greater than the count at the docking length. In addition, the controller can adjust the docking length to correspond to the count at the ground contact length, or to a predetermined number of counts (e.g., two counts) greater than or less than the ground contact length. In this way, the motor can be controlled so as to wind the linear material at the crawl speed between the count corresponding to the crawl length and the count corresponding to the docking length.

Alternatively or additionally, the controller can set the crawl length a variety of other ways, such as setting the crawl length count to be a predetermined number of counts less than or greater than the count at the ground contact length, setting the crawl length at the direction of the user, or using any other suitable method.

In some embodiments, the crawl speed can be slower than the docking speed. In some implementations, winding at the crawl speed can slow the linear material such that substantially all momentum of the linear material is lost. This can prevent a distal end portion of the linear material from swinging uncontrollably when the linear material leaves a ground surface. When the length of unwound linear material reaches the docking length, the motor can cause the spool member to wind the linear material at the docking speed such that the linear material retracts smoothly toward the aperture 114 of the automatic device 110.

Preventing Gravity-Driven Overspooling

In ceiling or wall mounted embodiments, for example, as described with reference to FIG. 16, it can be useful to allow the linear material to hang down to an extent. A user may deploy the linear material such that a distal end that is unwound from a spool member is above the ground or another lower surface. For instance, the user may allow the linear material to hang such that the distal end of the linear material is within reach. However, sometimes gravity can cause more linear material to deploy than desired. This overspooling can be undesirable, for example, as described herein.

In some embodiments, such undesired deployment can be prevented by applying a brake to a motor and/or a spool member so as to prevent further deployment of the linear material while the distal end of the linear material is hanging above the ground or another lower surface. Breaking, such as dynamic braking, can be applied to the motor to prevent overspooling of the linear material. Alternatively or additionally, braking can be implemented to prevent self-unspooling of linear material due to gravity, for example, in a ceiling or other surface mounted application. This braking can also reduce and/or prevent over-spooling of the linear material when a user pulls the linear material so as to deploy the linear material from around the spool member, for example, as described above.

When an external force is applied to a DC motor, the motor can become a generator. The external force can be applied, for example, by a user pulling the linear material and/or by a gravitational pull on free hanging linear material. Braking can include shunting motor leads via external devices, so as to create an electrical load on the motor. The electrical load can, in turn, cause the motor to resist rotating.

Figure 17:
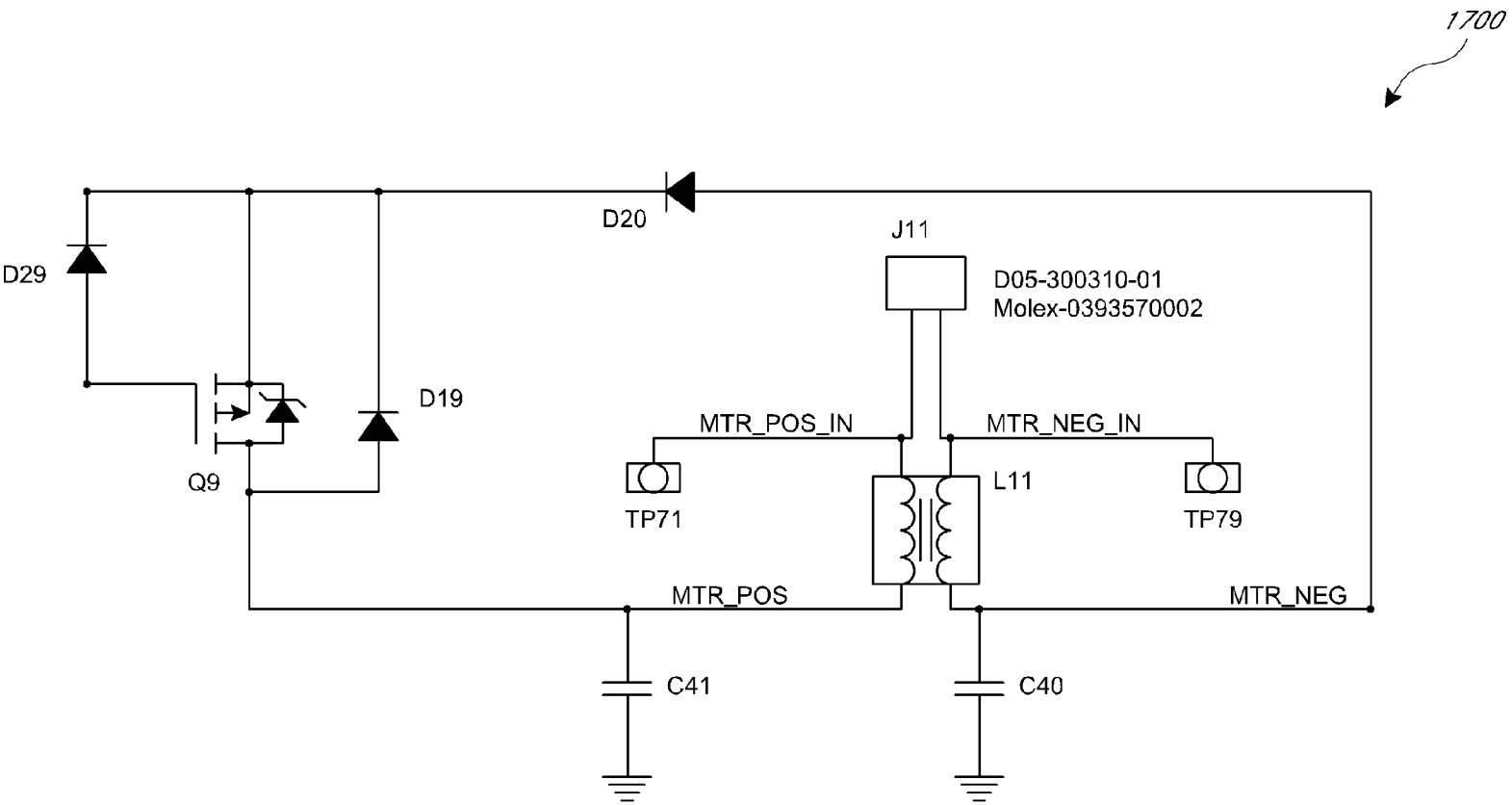
FIG. 17 schematically illustrates an example circuit configured to apply braking to a motor, according to an embodiment.

FIG. 17 schematically illustrates an example circuit 1700 configured to apply dynamic braking to a motor, according to an embodiment. Dynamic braking can be implemented by shorting two motor leads J11 to each other using a motor control circuit that includes a closed loop. The closed loop can include a choke L11, a diode D20, and a field effect transistor Q9. The motor leads J11 can be shorted to each other so as to inhibit rotation of the motor via the closed loop. For example, the field effect transistor Q9 can cause the motor leads J11 to be shorted to each other in response to an external force applied to the motor.

In some implementations, the field effect transistor Q9 can include a break down diode between the source and the gate. When a high voltage (for example, 170 V DC) is applied to the gate and the source of the field effect transistor Q9, the field effect transistor Q9 can pass a current (for example, 3 A) via the break down diode of the field effect transistor Q9 to the choke L11. This can cause the motor leads J11 to be shorted to each other. As a result, the motor leads J11 can be provided with substantially the same voltage level, which can be the common mode voltage. This can provide an electrical load on the motor and consequently inhibit rotation of the motor.

In some embodiments, the motor control circuit can stop dynamic braking in response to a pull on the linear material. For example, a user can pull the linear material until one or more rotation sensors, such as one or more sensors 803, detect sufficient rotation of the spool member. The controller can be configured to turn off dynamic braking in response to detecting rotation of the spool member.

Rewind Suspension Based on Rotation Sensor(s)

Rewind suspension can be initiated and/or modified in a variety of ways, as an alternative to or in addition to the methods described above. In some implementations, detecting that an increased power and/or an excess torque has been applied to a motor may consume additional power and/or be unreliable in some circumstances.

Accordingly, in some implementations, rewind suspension can be initiated based on data generated by one or more sensors configured to detect rotation of the spool member, such as one or more sensors 803. For example, in a device 100 and/or another reel apparatus that includes any combination of features of the sensors 803 described herein, a controller, such as the controller 224, can monitor rotation of the spool member based on data generated by sensor(s). Based on the sensor(s) not detecting an indicator of rotation of the spool member while linear material is being wound around the spool member, the controller can cause the winding of linear material to cease. In some embodiments that employ rotation sensor(s), the controller can cause the motor to stop winding the linear material when the rotation sensor(s) detect that the spool member is not rotating in the winding direction.

For example, when the sensor(s) do not detect that a source, such as a source 801, passes in proximity of the sensor(s) for a predetermined period of time, the controller can cause the motor to stop rotating the spool member in the winding direction. The predetermined period of time can range from, for example, about 400 milliseconds to 1.5 seconds in some implementations. The predetermined period of time can be preprogrammed in non-transitory memory and/or set at the direction of a user, for example, via a user interface panel and/or via a remote control.

As another example, the sensor(s) can detect that the spool member begins to rotate in an unwinding direction while the controller is trying to wind the linear material around the spool member. Such a change in direction of rotation of the spool member can be detected in implementations where two or more sources are associated with the spool member, for example, by monitoring an order in which the two or more sources are detected by the sensor(s). For instance, when the same source passes in proximity to a sensor twice before another source passes in proximity to the sensor, the sensor and/or the controller can detect that the direction of rotation of the spool member has changed. Consequently, the controller can cause winding of linear material to cease.

Motors and Sensor Assemblies in a Reel Apparatus

FIGS. 10 through 13 provide illustrative examples of motor and sensor assemblies that can be used to achieve one or more advantages described herein. Any combination of features described in reference to FIGS. 10 through 13 can be implemented in connection with the principles and advantages of any of the methods or apparatuses described herein, as appropriate.

FIG. 10 illustrates an embodiment including a motor 222 with an integrated sensor/source apparatus. One such embodiment may use a motor 222 such as the 300.B086 from Linix Motor. A datasheet for that motor is in FIG. 11.

In FIG. 10, the integrated sensor/source apparatus comprises a disc 1010 associated with motor 222 via a shaft such as shaft 802 (not visible in FIG. 10, but shown in FIG. 8). The association between the motor 222 and disc 1010 is preferably such that the disc 1010 rotates at the rate and in the direction of the rotation of the output shaft 802 of the motor 222, although certain embodiments may have different operational relationships between the motor 222 and disc 1010. Surrounding the disc is a cap 1020, which serves to protect the disc 1010, the sensors 803, and other components of the motor 222. Cap 1020 is optional. In some embodiments, cap 1020 may be removed from the motor 222. In other embodiments, cap 1020 is substantially permanently attached to the motor 222. Similarly, disc 1010, motor 222, and shaft 802 may be removably or substantially permanently attached to each other, by appropriate means known to those of skill in the art.

Figure 12A:
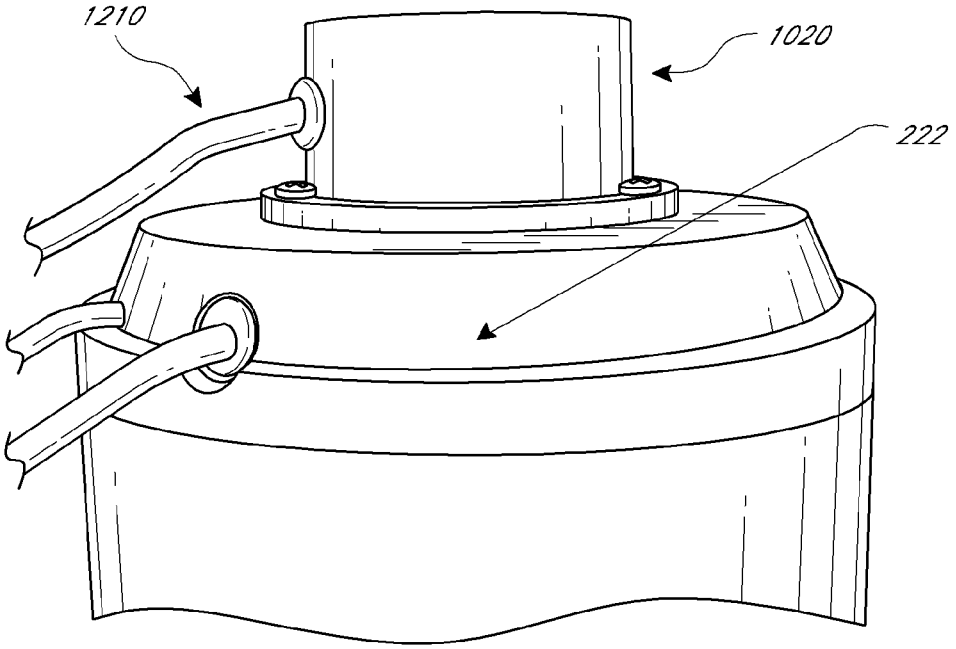
FIG. 12A is a perspective view of the cap and motor assembly of FIG. 10.
Figure 13:
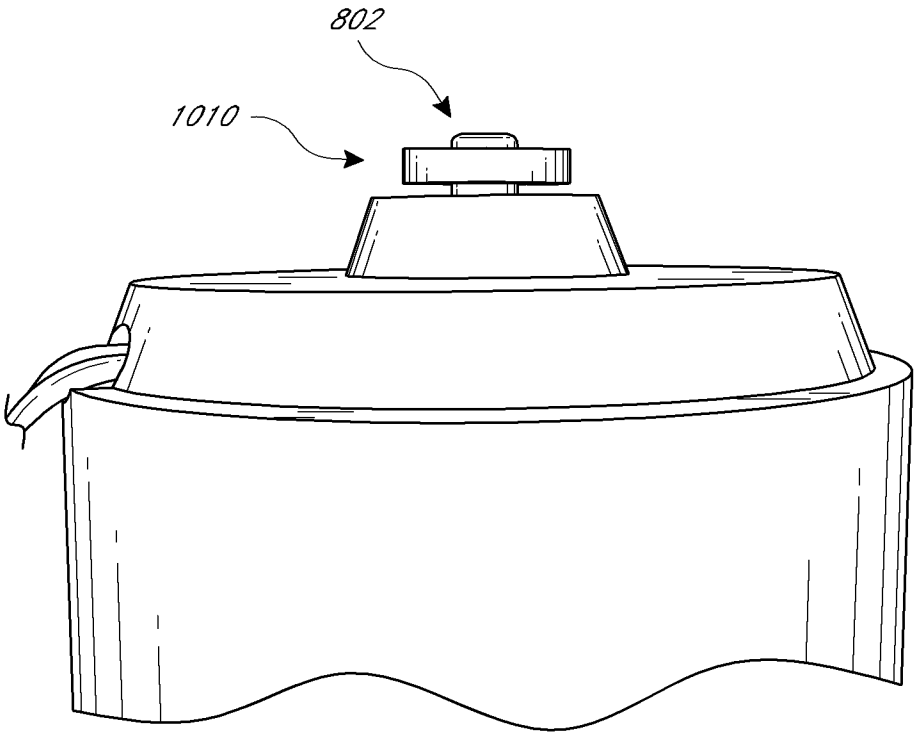
FIG. 13 is a perspective view of the motor and rotating disc of FIG. 10.

FIG. 12A shows cap 1020 attached to motor 222 via one or more screws, for example. It also shows a data communication line 1210 (e.g., a wire), capable of sending the sensor-derived information described above (the output of the sensor(s) 803 and associated control circuitry). Data communication line 1210 may be bidirectional, or there may be separate input and output lines. In addition to confirmation that output was received, data that might be input to a sensor 803 and/or its associated control circuitry includes configuration information such as data related to the number and positions of sources 801 and sensors 803, which a sensor 803 and/or associated control circuitry might use when formulating its output, for example.

Figure 12B:
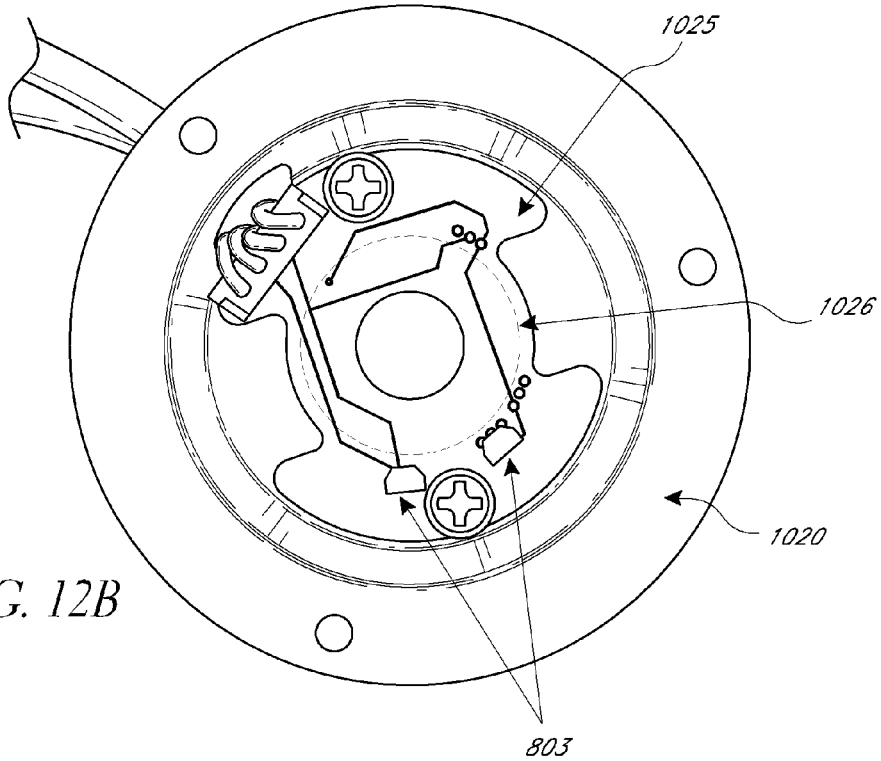
FIG. 12B is an interior view of the cap and sensor assembly of FIG. 10.
Figure 12C:
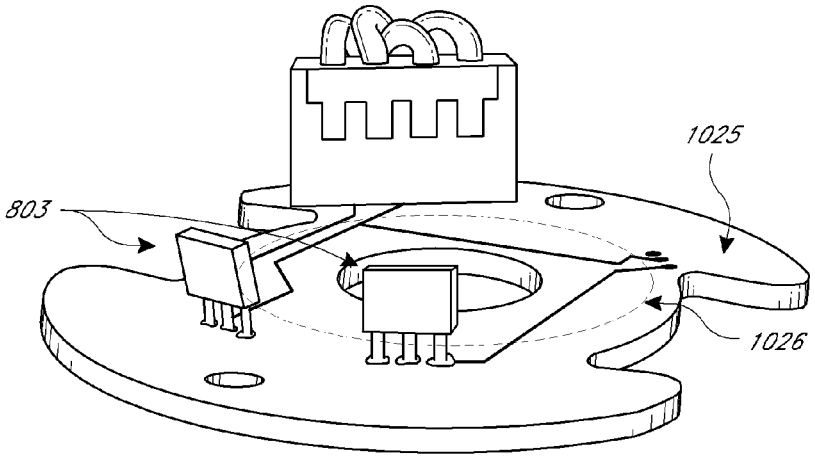
FIG. 12C is a perspective view of a sensor assembly insert mountable within the cap of FIG. 10.

FIG. 12B shows a sensor assembly insert 1025 mounted within an interior of the cap 1020. The insert 1025 supports one or more sensors 803 (such as Hall Effect sensors) and associated electronic circuitry and/or logic componentry. In certain embodiments, the insert 1025 comprises a circuit board. In the illustrated embodiment, two sensors 803 are used. The illustrated sensors 803 are not evenly or regularly distributed about the perimeter of the motor axis, but are instead positioned relatively near one another. Such a configuration, particularly when combined with appropriate logic in an associated controller, may be advantageously redundant in that if one sensor 803 should fail, another sensor 803 can take its place. In other embodiments, the sensor(s) 803 and associated electronic circuitry can be provided directly on the cap 1020, without a separate insert 1025. FIG. 12C shows the insert 1025 removed from the cap 1020. In other embodiments, the insert 1025 may be substantially permanently affixed to the cap 1020. Providing some degree of non-destructive access to the sensors 803 and associated circuitry, be it in the form of no cap 1020, a removable cap 1020, or otherwise, advantageously allows access to those components for repair, replacement, or maintenance, for example.

As illustrated in FIG. 13, disc 1010 may be attached (either removably or non-removably) to a shaft such as shaft 802, which is rotatably connected to the motor 222. Disc 1010 preferably includes one or more embedded or otherwise attached magnets, which are sources 801 (FIG. 8). In other embodiments, with appropriately configured sensors 803, different types and numbers of sources 801 may be used, as discussed above. Cap 1020, to which sensors 803 are attached (either removably or non-removably), is attached (either removably or non-removably) to motor 222 so that, for example, the shaft 802 can extend through a hole 1026 (FIG. 12B) in the insert 1025 and the disc 1010 is substantially aligned with the circle 1027 shown in FIG. 12B. In operation, the rotation of the disc 1010, which is indicative of the rotation of the motor 222, is detected and/or measured by the sensors 803. In the illustrated embodiment, the rotation of the magnets of the disc 1010 induces a voltage change across the Hall Effect sensors 803, and it is that voltage (or an associated current, for example) which is detected and reported by the sensors 803. In other embodiments, the sensors 803 may be photosensitive and the disc 1010 may contain appropriate light sources 801 instead of or in addition to magnets.

It will be understood that while disc 1010 with embedded magnets may have certain advantages in terms of rotational stability or mechanics, for example, the one or more sources 801 need not be embedded in or otherwise provided on such a disc 1010 and may, for example, be directly attached to shaft 802.

A sensor/source apparatus such as those illustrated and described herein may be configured to have a particular accuracy and/or precision in measuring rotational displacement and/or velocity. For example, it may detect full or partial revolutions, depending in part on the associated control logic and the number of sensors 803 and sources 801. An apparatus with a single sensor 803 and a single source 801 may detect only single revolutions. The use and positioning of sensors 803 and sources 801, as well as the configuration of associated control logic, may allow measuring of ½, ⅓, ¼ as well as many other fractions of a revolution. Further, the measurement accuracy may also depend in part on the speed of rotation as well as the type and quality of the components. Also, as illustrated above, some algorithms may yield precise measurements of the rate of rotation, while other algorithms may yield ranges. Embodiments may use one or both types of algorithms.

A controller 224 may also use information about rotation of the motor 222 or other components, such as from an appropriate sensor/source apparatus, to implement at least one of the features disclosed in U.S. Pat. No. 7,350,736 (issued Apr. 1, 2007), whereby the speed at which linear material is automatically wound-in is reduced when a distal end portion of the linear material (e.g., the end portion opposite to the end secured to the spool member 220) is being wound. In an embodiment, when the motor 222 is powered to rotate the spool member 220 to wind in the linear material, the motor controller 224 adjusts the operation of the motor 222 so as to slow the rate of rotation of the spool member 220 when a distal end portion of the linear material is being wound. Similarly to how the signals from the sensor 803 can be used to discontinue unwinding rotation of the spool member 220 when only the proximal end portion of the linear material remains wound on the spool member 220 (e.g., substantially all of the linear material other than the proximal end portion of the linear material is currently unspooled), the signals can also be used to determine when the distal end portion of the linear material is being wound onto the spool member 220 (e.g., substantially all of the linear material other than the distal end portion is currently spooled on the spool member).

Other embodiments may prevent deployment of the proximal end portion of the linear material by attaching a fitting to the linear material. For example, a fitting on the linear material may abut the interior surface of the body 102 of the device 100 because it is unable to pass through the aperture 114. In some embodiments, contact between the fitting and the body 102 may complete or open an electronic circuit or otherwise cause a signal which is detected by the controller, which in turn causes the motor to stop rotating.

In certain embodiments, the controller 224 operates in a voltage range from about 10 to about 14.5 volts and consumes up to approximately 450 watts. In an embodiment, the controller 224 consumes no more than approximately 42 amperes of current. To protect against current spikes that may damage the controller 224 and/or the motor 222 and pose potential safety hazards, certain embodiments of the controller 224 advantageously include a current sense shut-off circuit. In such embodiments, the controller 224 automatically shuts down the motor 222 when the current threshold is exceeded for a certain period of time. For example, the controller 224 may sense current across a single MOSFET or across another current sensing device or component. If the sensed current exceeds 42 amperes for a period of more than approximately two seconds, the controller 224 advantageously turns off the motor 222 until the user clears the obstruction and restarts the controller 224. In other embodiments, the current threshold and the time period may be selected to achieve a balance between safety and performance.

For example, a current spike may occur when the linear material encounters an obstacle while the automatic device 100 is retracting the linear material. For example, the linear material may snag on a rock, on a lounge chair or on other types obstacles, which could prevent the linear material from being retracted any further by the automatic device 100. At that point, the motor 222 (and spool member 220) may stop rotating and thereby cause a spike in the sensed current draw. As a safety measure, the controller 224 advantageously responds by shutting down the motor 222 until the controller 224 receives another retract command from the user, preferably after any obstacle has been removed. Also preferably, the maximum current limit is set so that small current spikes do not shut down the motor 222, for example, when the linear material encounters small obstacles during retraction that do not fully prevent the linear material from being retracted but that cause a temporary slowing of the retraction of the linear material with a commensurate temporary increase in current.

In certain embodiments, the controller 224 also uses the current sensor to determine when the linear material is fully retracted into the automatic device 100 and is wound onto the internal spool member 220. In particular, when a fitting at the end of the linear material is blocked from further movement by the linear material port 114, the linear material cannot be further retracted and the spool member 220 can no longer rotate in the retraction direction. The current applied to the motor 222 increases as the motor 222 unsuccessfully attempts to further rotate the spool member 220. The controller 224 preferably senses the current spike and responds by shutting down the motor 222. In certain embodiments, the controller 224 assumes that the current spike was caused by the completion of the retraction process, and the controller 224 establishes the current position of the linear material as the "home" position. Until a new "home" position is established, the length of the linear material extracted from the automatic device 100 is determined by the number of revolutions in the deployment direction, as discussed above, and the length of the linear material subsequently returned to the spool member 220 is determined by the number of revolutions in the retraction direction, as discussed above.

On the other hand, if the current spike was caused by an external obstruction, the user can release the linear material from the obstruction and press the home button on a remote control or activate a home function using the interface panel 106 on the automatic device 100. When the controller 224 is activated in this manner, the controller 224 again operates the motor 222 in the retraction direction to further retract the linear material. When the controller 224 senses another current spike, a new "home" position is established. By using the sensing of the current spike to establish the home position, the embodiments of the automatic device 100 described herein do not require a complex mechanical or electrical mechanism to determine when the linear material is fully retracted. The skilled artisan will recognize from the disclosure herein that there are a variety of alternative methods and/or devices for tracking the amount of linear material that is wound or unwound from the device 100 and/or the retraction or deployment speed of the linear material. For example, the device 100 may use an encoder, such as an optical encoder, or use a magnetic device, such as a reed switch, or the like.

One skilled in the art will recognize from the disclosure herein that the maximum current may be set for more than 42 amperes or set to less than 42 amperes depending upon the design of the controller 224 and the automatic device 100.

In certain embodiments, the controller 224 advantageously has two modes—a sleep mode and an active mode. The controller 224 operates in the active mode whenever an activity is occurring, such as, for example, the extension of the linear material by a user or the retraction of the linear material in response to a command from the user. The controller 224 also operates in the active mode while receiving commands from a user via the interface panel 106 or via a remote control. The current required by the motor control board during the active mode may be less than about 30 milliamperes, for example.

In order to conserve energy, the controller 224 is advantageously configured, in certain embodiments, to enter the sleep mode when no activity has occurred for a certain period of time, such as, for example, 60 seconds. During the sleep mode, the current required by the controller 224 is advantageously reduced. For example, the controller 224 may require less than about 300 microamperes in the sleep mode.

A remote control may enable a user to manually control the automatic device 100 without having to use the interface panel 106. In certain embodiments, the remote control operates a flow controller of the automatic device 100 (allowing and preventing the flow of a gas or liquid through a hose, for example) and also operates the motor 222 to wind and unwind the linear material onto and from the spool member 220. For example, the remote control may communicate with the controller 224 described above.

Preferably, the remote control operates on a DC battery, such as a standard alkaline battery. In other embodiments, the remote control may be powered by other sources of energy, such as a lithium battery, solar cell technology, or the like.

The remote control includes one or more controls (e.g., buttons or touch screen interfaces) for controlling device operation. For example, a remote control may include a valve control button, a "home" button, a "stop" button, a "jog" button, and a "kick" button. To the extent possible, symbols on these buttons may mimic standard symbols on tape, compact disc, and video playback devices.

Pressing the valve control button sends a signal to the electronics of the automatic device 100 to cause a flow controller therein to, e.g., toggle an electrically actuated valve between open and closed conditions to control the flow of a fluid (e.g., water) or a gas (e.g., air) through the linear material.

Pressing the home button causes the controller 224 to enable the motor 222 to fully wind the linear material onto the spool member 220 within the automatic device 100. In certain embodiments, the linear material is retracted and wound onto the device 100 at a quick speed after the home button has been pressed. For example, a 100-foot linear material is advantageously wound onto the spool member 220 in approximately thirty seconds.

Pressing the stop button causes the controller 224 to halt the operation of the motor 222 in the automatic device 100 so that retraction of the linear material ceases. In certain embodiments, the stop button provides a safety feature such that commands caused by the stop button override commands issued from the home button. In some embodiments, the stop button may also cause the controller to stop the motor 222 from powered assist and may enable the brake 228.

The jog button allows the user to control the amount of linear material that is spooled in by the device 100. For example, in an embodiment, pressing the jog button causes the linear material device 100 to reel in the linear material for as long as the jog button is depressed. When the user releases the jog button, the automatic device 100 stops retracting the linear material. In certain embodiments, the rate at which the device 100 retracts the linear material when the jog button is pressed is less than the initial rate at which the device 100 retracts the linear material after the home button is pressed. Because the linear material is only retracted during the time the jog button is pressed, the motor speed when retracting the linear material in response to pressing the jog button is preferably substantially constant.

In other embodiments, pressing the jog button advantageously causes the device 100 to retract the linear material a set length or for a set time period. For example, in one embodiment, each activation of the jog button advantageously causes the device 100 to retract the linear material approximately ten feet. In such embodiments, the jog button command may be overridden by the commands caused by pressing the home button or the stop button. Commands from the remote control may also be overridden by commands initiated by using the interface panel 106 on the automatic device 100.

A kick button may cause the controller to initiate the kick process of FIG. 3. This may be helpful when a user is unable to exert sufficient force to manually trigger the kick process, or if the user prefers to have additional slack introduced into the deployment.

In certain embodiments, the remote control advantageously communicates with the automatic device 100 via wireless technologies. For example in a preferred embodiment, the remote control communicates via radio frequency (RF) channels and does not require a line-of-site communication channel with the device 100. Furthermore, the remote control transmitter is advantageously able to communicate over a range that exceeds the length of the linear material. For example, for an automatic device 100 configured for a 100-foot linear material, the communication range is advantageously set to be at least about 110 feet. In other embodiments, the remote control is configured to communicate via other wireless or wired technologies, such as, for example, infrared, ultrasound, cellular technologies or the like.

In certain embodiments, the remote control is configured so that a button on the remote control must be pressed for a sufficient duration (e.g., at least about 0.1 second) before the remote control transmits a valid command to the automatic device 100. This feature precludes an unwanted transmission if a button is inadvertently touched by the user for a short time.

In certain embodiments, the remote control is configured so that if any button is pressed for more than three seconds (with the exception of the jog button), the remote control advantageously stops transmitting a signal to the automatic device 100. This conserves battery power and inhibits sending of mixed signals to the automatic device 100, such as when, for example, an object placed on the remote control causes the buttons to be pressed without the user's knowledge.

Preferably, the transmitter of the remote control and the receiver (e.g., wireless receiver) in the automatic device 100 are synchronized or "paired together" prior to use. In certain embodiments, the user advantageously receives confirmation that the synchronization is complete by observing a flashing LED on the automatic device 100 or the remote control or by hearing an audible signal generated by the automatic device 100 or the remote control.

In certain preferred embodiments, the remote control is advantageously configured to power down to a "sleep" mode when no button of the remote control has been pressed during a certain time duration. For example, if a period of 60 seconds has elapsed since a button on the remote control was last pressed, the remote control enters a "sleep" mode wherein the current is reduced from the current consumed during an "active" state. When any of the buttons on the remote control is pressed for more than a certain time period (e.g., 0.1 second), the remote control enters the "active" state and begins operating (e.g., transmitting a signal).

In an embodiment, the remote control is advantageously attachable to the linear material at or near the extended end of the linear material. In other embodiments, the remote control is not attached to the linear material. In the latter case, the user can operate the remote control to, e.g., stop the flow of fluid through a hose-type linear material and retract the linear material without entering the area where the linear material is being used. Embodiments of the remote may also take on any shape with similar and/or combined functions.

The skilled artisan will also readily appreciate from the disclosure herein numerous modifications that can be made to the electronics to operate the flow controller and an automatic device. For example, the above processes 300, 400, and/or 500 may be implemented in software, in hardware, in firmware, or in a combination thereof. In addition, functions of individual components, such as the controller 224, may be performed by multiple components in other embodiments.

Controller

FIGS. 6 and 7A-7H illustrate schematic diagrams of an illustrative embodiment of a controller, such as the controller 224 (FIG. 2), that can perform one or more of the functions described earlier. The following description and references to FIGS. 6 and 7A-7H are for illustrative purposes only and not to limit the scope of the disclosure. The skilled artisan will recognize from the disclosure hereinafter a variety of alternative structures, devices and/or processes usable in place of, or in combination with, the described embodiments.

Figure 6:
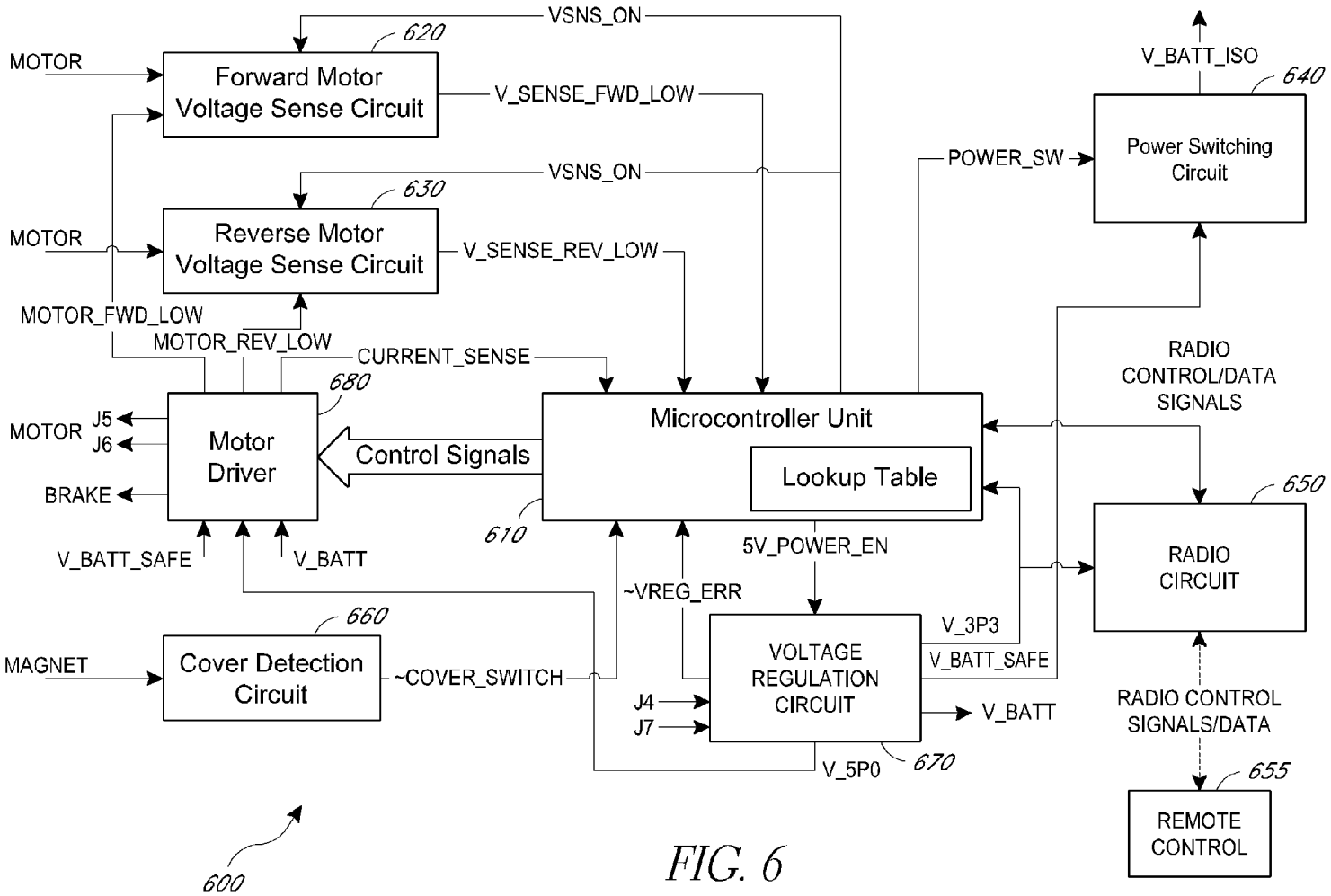
FIG. 6 illustrates a schematic diagram of an illustrative control circuit implementing a controller as shown in FIG. 2.

FIG. 6 illustrates an illustrative motor control system for implementing a controller 224 in an embodiment of the device 100. The illustrated motor controller 600 includes a microcontroller unit 610, a forward motor voltage sense circuit 620 including a transistor package U9 (FIG. 7B), a reverse motor voltage sense circuit 630 including a transistor package U6 (FIG. 7C), a cover detection circuit 660 including a hall effect sensor U1 (FIG. 7F), a voltage regulation circuit 670 including voltage regulators U11 and U2 (FIG. 7G), a power switching circuit 640 including a transistor package U7 (FIG. 7D), a radio circuit 650 including an RF transceiver U5 (FIG. 7E), and a motor driver 680. The motor controller 600 receives power through positive and negative power contacts J4, J7.

In one embodiment, each of the transistor packages U9, U6, U7 can include one NPN transistor and one PNP transistor that are not electrically coupled inside the package. The NPN transistor includes a base, an emitter, and a collector connected to pins B1, E1, and C1, respectively. The PNP transistor includes a base, an emitter, and a collector connected to pins B2, E2, and C2, respectively.

The microcontroller unit 610 serves to monitor and control the motor 222 (FIG. 2), and causes the motor to act as the braking mechanism 228 (FIG. 2). The microcontroller unit 610 can output motor driver control signals MTR_FWD_HI, MTR_FWD_LO, MTR_REV_HI, MTR_REV_LO; a voltage sense signal VSNS_ON; a 5-volt power enable signal 5V_POWER_EN; a power switch signal POWER_SW; radio control signals RF_SCLK, RF_~SEL, ~IRQ, RF_FFS, RF_FFIT, RF_VDI, and ~RESET; and radio data signals RF_SDI and RF_SDO. The microcontroller unit 610 can receive a current sense signal CURRENT_SENSE from the motor driver, a sensed forward motor voltage V_SENSE_FWD_LOW from the forward motor voltage sense circuit, a sensed reverse motor voltage V_SENSE_REV_LOW from the reverse motor voltage sense circuit, a cover detection signal ~COVER_SWITCH from the cover detection circuit, and a voltage regulation error signal ~VREG_ERR from the voltage regulation circuit.

The forward motor voltage sense circuit 620 can receive the voltage sense signal VSNS_ON from the microcontroller unit 610 and a forward motor terminal voltage MOTOR_FWD_LOW from the motor driver 680, and output the sensed forward motor voltage V_SENSE_FWD_LOW. The forward motor voltage sense circuit 620 can include the transistor package U9. When the voltage sense signal VSNS_ON is enabled, the forward motor voltage sense circuit 680 converts the forward motor terminal voltage MOTOR_FWD_LOW into the sensed forward motor voltage V_SENSE_FWD_LOW by reducing the voltage level and providing input pin protection.

Similarly, the reverse motor voltage sense circuit 630 can receive the voltage sense signal VSNS_ON from the microcontroller unit 610 and a reverse motor terminal voltage MOTOR_REV_LOW from the motor driver 680, and output the sensed reverse motor voltage V_SENSE_REV_LOW. The reverse motor voltage sense circuit 630 can include the transistor package U6. When the voltage sense signal VSNS_ON is enabled, the reverse motor voltage sense circuit 630 converts the reverse motor terminal voltage MOTOR_REV_LOW into the sensed reverse motor voltage V_SENSE_REV_LOW by reducing the voltage level and providing input pin protection.

The microcontroller unit 610 is configured to enable VSNS_ON in accordance, for example, with one or more of the processes in FIGS. 3, 4, and 5. When VSNS_ON is enabled, the microcontroller unit 610 will shortly receive back safely reduced voltages on V_SENSE_REV_LOW and V_SENSE FWD_LOW. A difference between these two voltages corresponds to an approximate rate (and direction) of rotation for the motor, which the microcontroller unit 610 can access via a lookup table (which can be part of or external to the microcontroller unit 610). That rotational velocity can be stored for later use, for example, in accordance with the previously described processes. It can be compared to a similarly calculated value based on the next enablement of VSNS_ON, and may be compared to stored values containing maximum, minimum, and threshold values for the motor's rotational velocity as appropriate to implement motor and brake control processes such as processes 300, 400, and 500 as well as any other processes described herein (e.g., processes related to docking and/or strain relief).

A skilled artisan will appreciate that the microcontroller unit 610 may be configured to determine the correspondence between voltage differential and rotational velocity of the motor dynamically (e.g., without the use of a lookup table), and that it may, instead of storing and testing determined rates of rotation of the motor, store and test the voltage differentials directly.

The cover detection circuit 660 detects whether the cover of the body 102 of the device 100 is in place and outputs the cover detection signal ~COVER_SWITCH. The cover detection circuit 660 detects a magnet attached to the cover via the hall effect sensor U1. When the lid is on, the cover detection signal ~COVER_SWITCH is low. When the ~COVER_SWITCH high signal is received by the microcontroller unit 610, it may promptly emit the appropriate signals to cease rotation of the motor, or, for example, stop sending the 5V_POWER_EN signal to the voltage regulation circuit 670.

The voltage regulation circuit 670 serve to condition power coming from the power input contacts J4, J7. The voltage regulation circuit 670 receives the 5-volt power enable signal 5V_POWER_EN from the microcontroller unit 610 and outputs power signals V_BATT, V_BATT SAFE, V__3P3, V__5P0 and the voltage regulation error signal ~VREG_ERR. The voltage regulation circuit 670 can include the first and second voltage regulators U11, U2. In one embodiment, the first voltage regulator U11 generates a 3.3-volt power signal V__3P3 from the power signal V_BATT_SAFE for use by, for example, the microcontroller unit 610 and the radio circuit 650. The unswitched 3.3 volts is generally available whenever the 12-volt source is active (e.g., the 12-volt source is connected to the controller and has a sufficient charge). When the 5-volt power enable signal 5V_POWER_EN is enabled, the second voltage regulator U2 generates a 5.0-volt power signal V__5P0 for use by, for example, the motor driver 680, from a power signal V_BATT_ISO (discussed below with respect to the power switching circuit). The voltage regulation circuit 670 enables the voltage regulation error signal ~VREG_ERR when there is an error in voltage regulation. A skilled artisan will appreciate that the voltage regulation circuit 670 can be configured to provide various voltages, depending on the needs of the other components of the controller 600.

The power switching circuit 640 allows the microcontroller unit 610 to control the power signal V_BATT_ISO. The power switching circuit 640 receives the power signal V_BATT_SAFE from the voltage regulation circuit 670 and receives the power switch signal POWER_SW from the microcontroller unit 610. The power switching circuit 640 can include the transistor package U7. When the microcontroller unit 610 enables the power switch signal POWER_SW, the power switching circuit 640 connects the power signal V_BATT_ISO to the power signal V_BATT_SAFE through the transistor package U7. When the microcontroller unit 610 disables the power switch signal POWER_SW, the power switching circuit 640 isolates V_BATT_ISO from the power signal V_BATT_SAFE. This can be used in conjunction with sleep and power saving modes.

The radio circuit 650 serves to transmit and receive radio signals for use with a remote control 655. The illustrated radio circuit 650 can receive radio control signals RF_SCLK, RF_~SEL, ~IRQ, RF_FFS, RF_FFIT, RF_VDI, ~RESET and radio data signals RF_SDI, RF_SDO from the microcontroller unit 610. The radio circuit 650 includes the RF transceiver U5. The radio circuit 650 can transmit and receive the radio data signals RF_SDI, RF_SDO.

Figures 1, 7A:
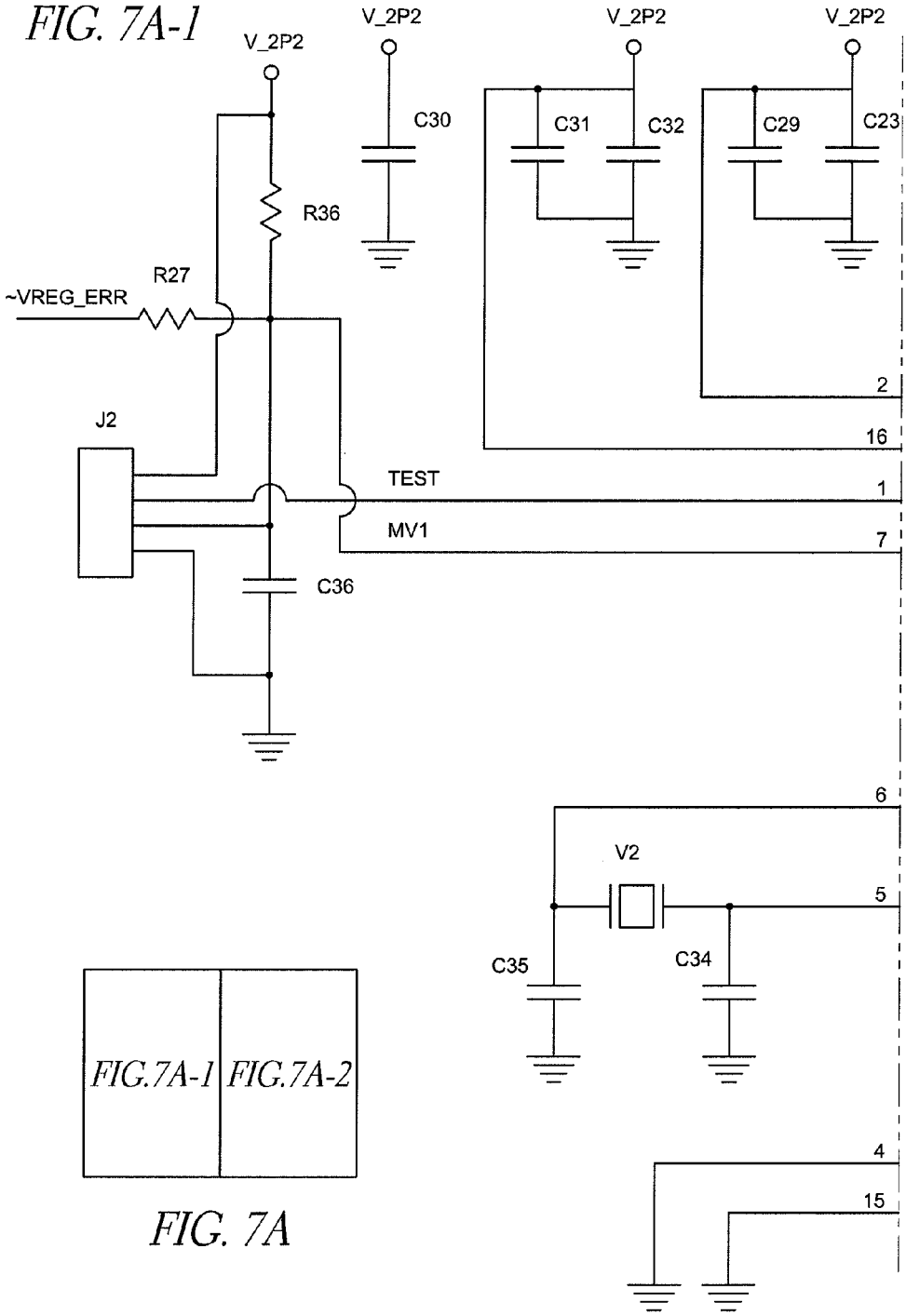
FIG. 7A is a circuit diagram of the microcontroller unit of FIG. 6 according to one embodiment.
Figures 2, 7A:
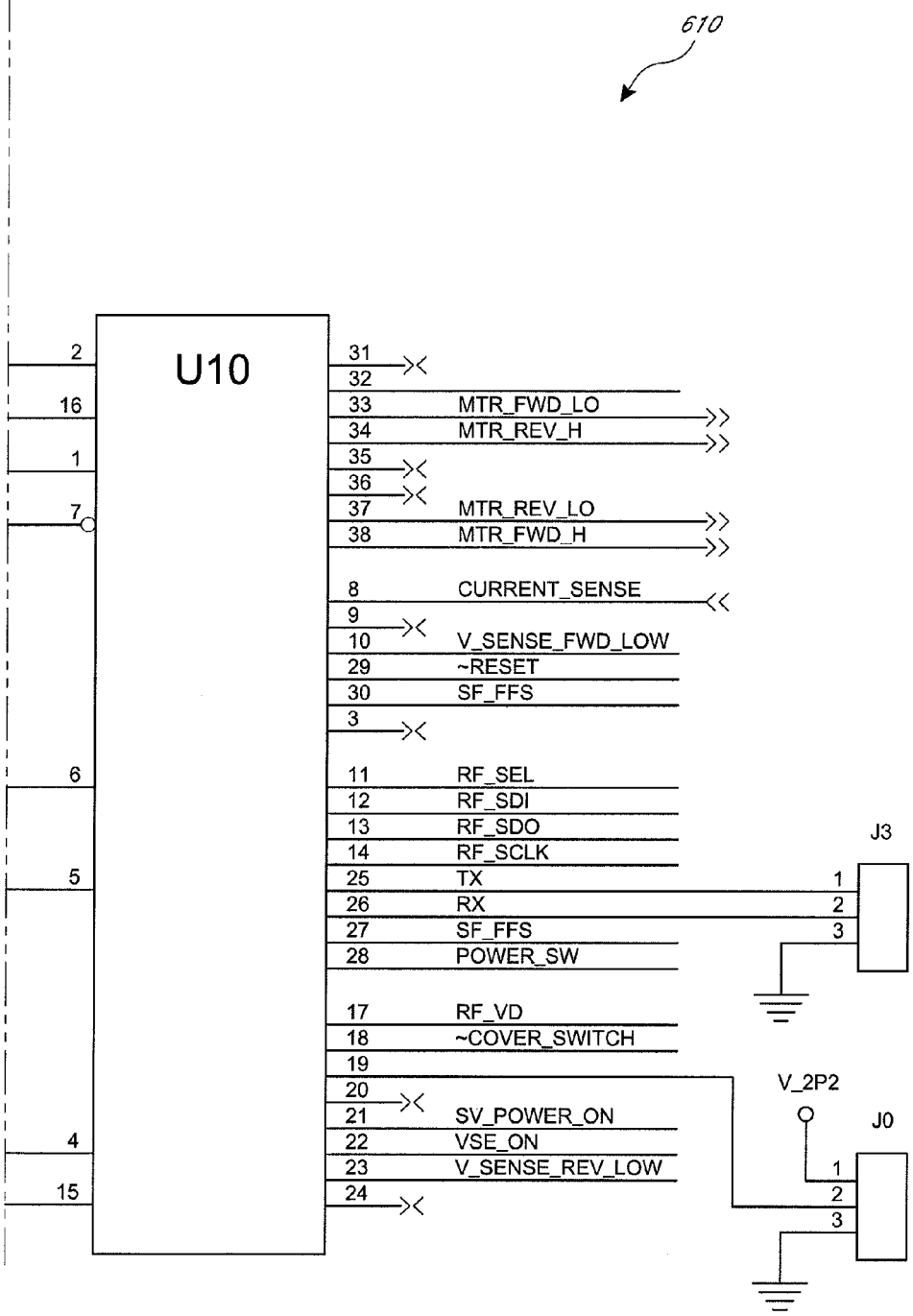
Figure 7B:
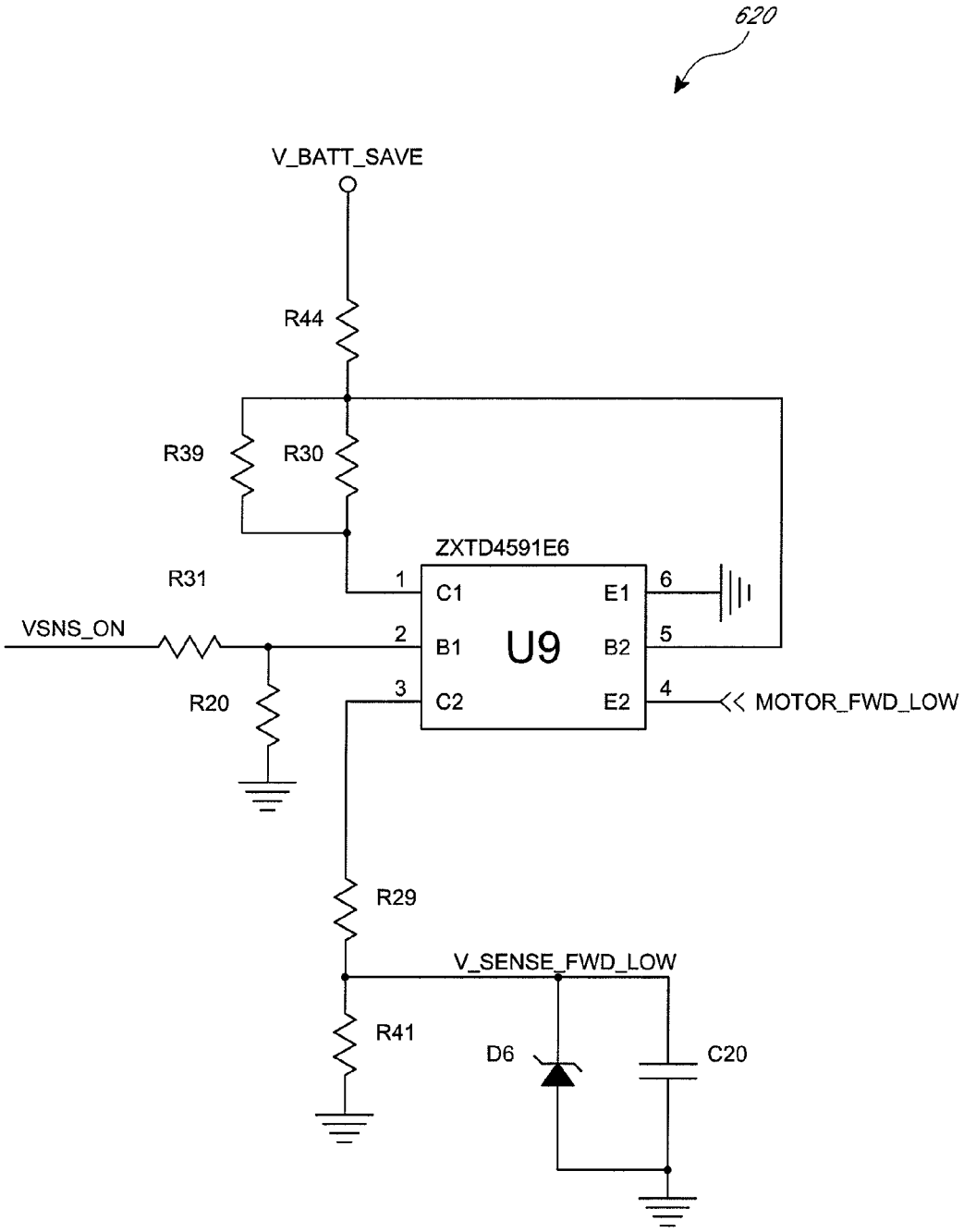
FIG. 7B is a circuit diagram of the forward motor voltage sense circuit of FIG. 6 according to one embodiment.
Figure 7C:
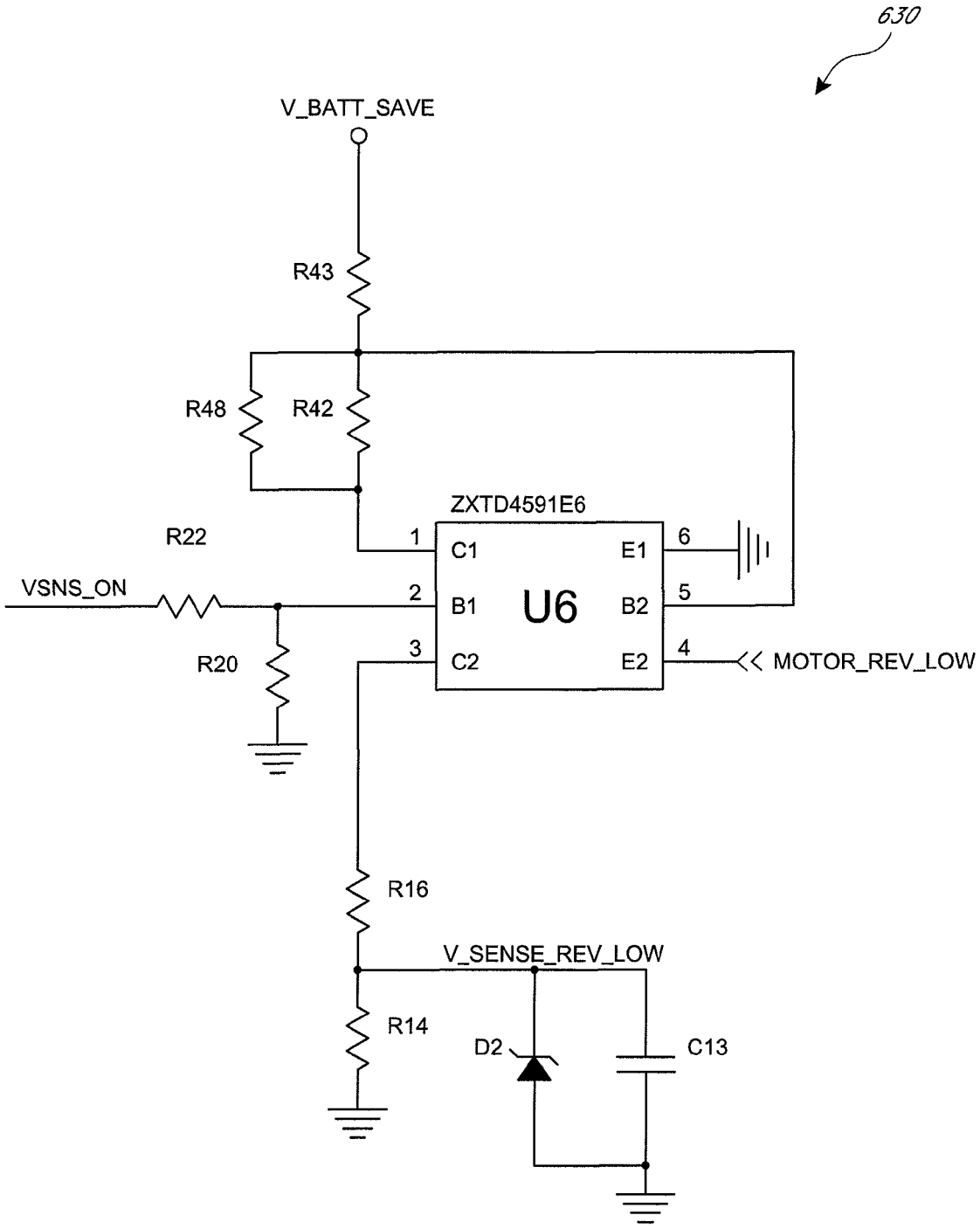
FIG. 7C is a circuit diagram of the reverse motor voltage sense circuit of FIG. 6 according to one embodiment.
Figure 7D:
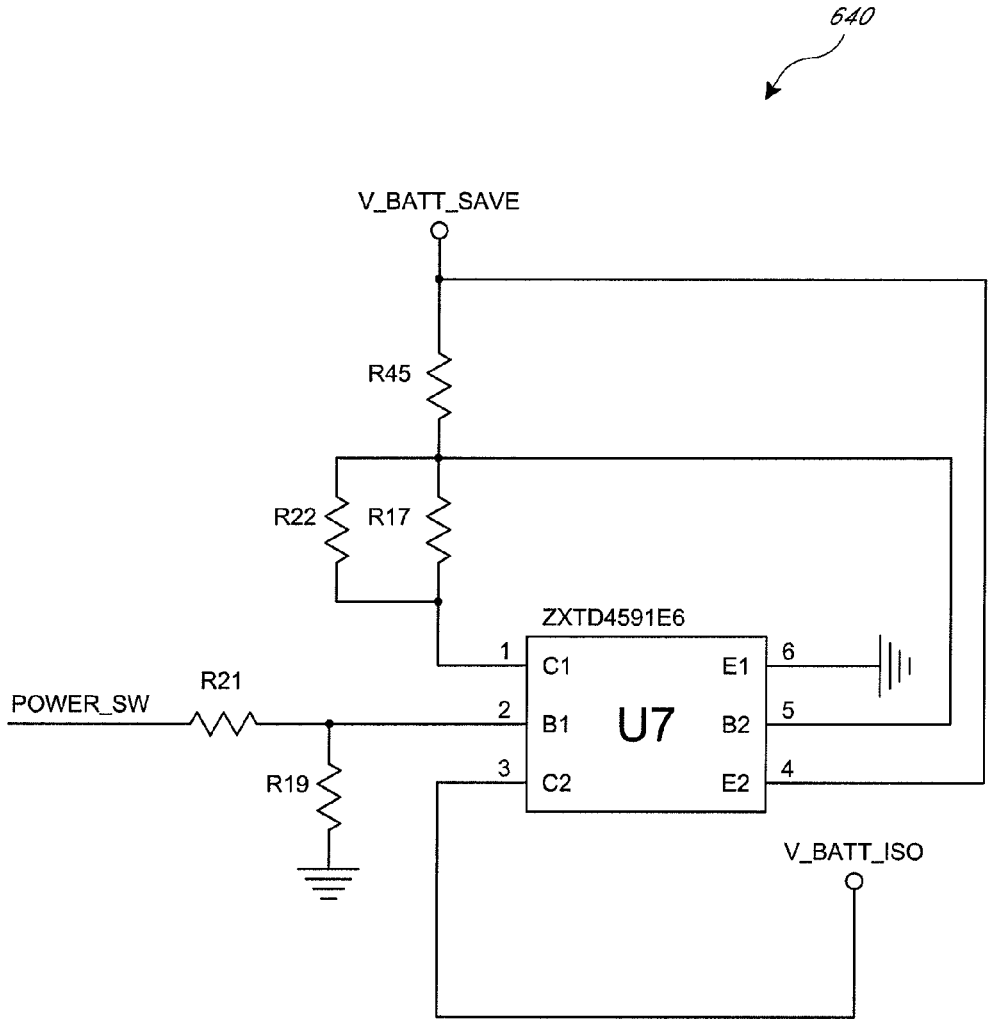
FIG. 7D is a circuit diagram of the power switching circuit of FIG. 6 according to one embodiment.
Figure 7E:
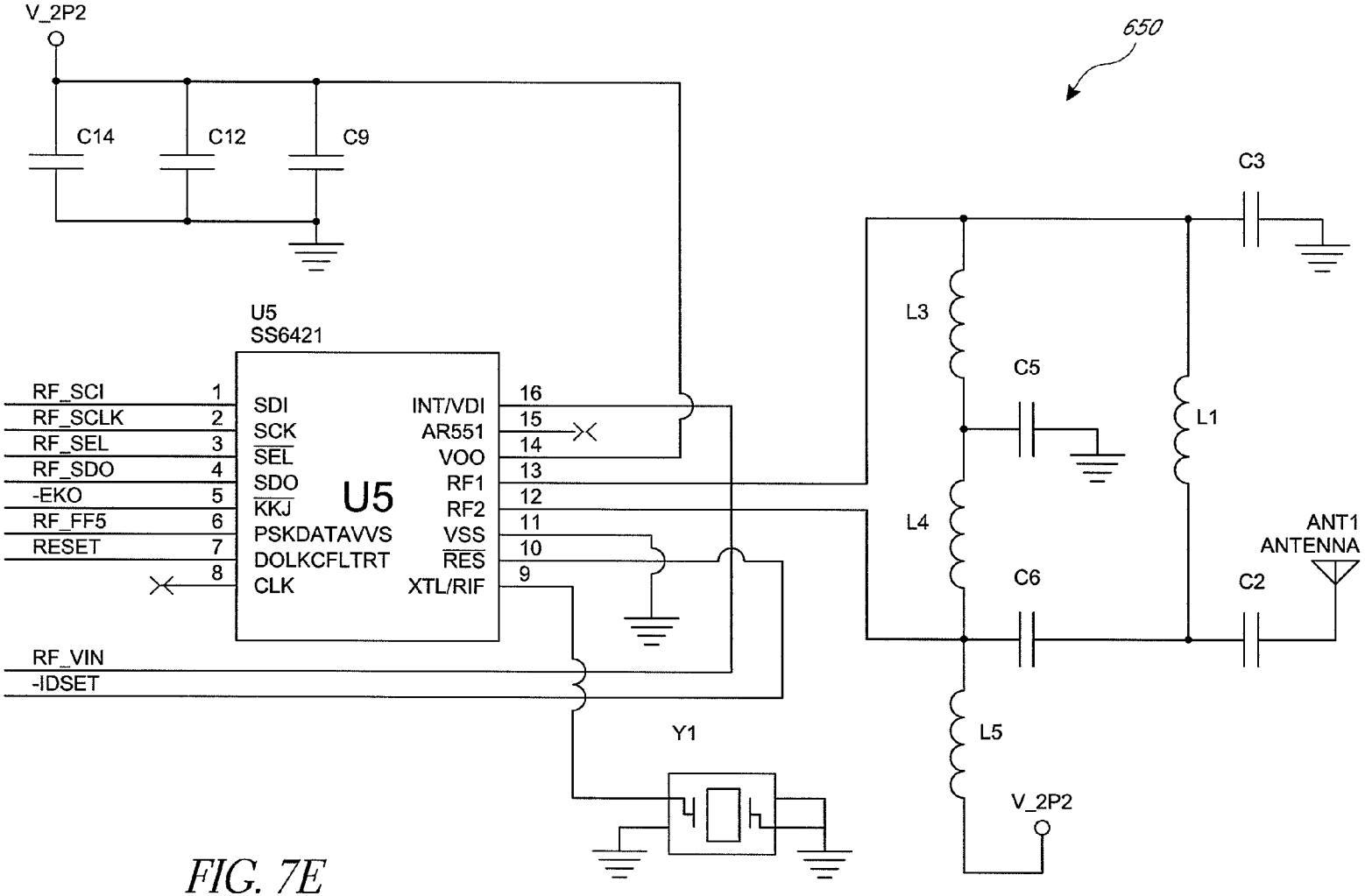
FIG. 7E is a circuit diagram of the RF transceiver of FIG. 6 according to one embodiment.
Figure 7F:
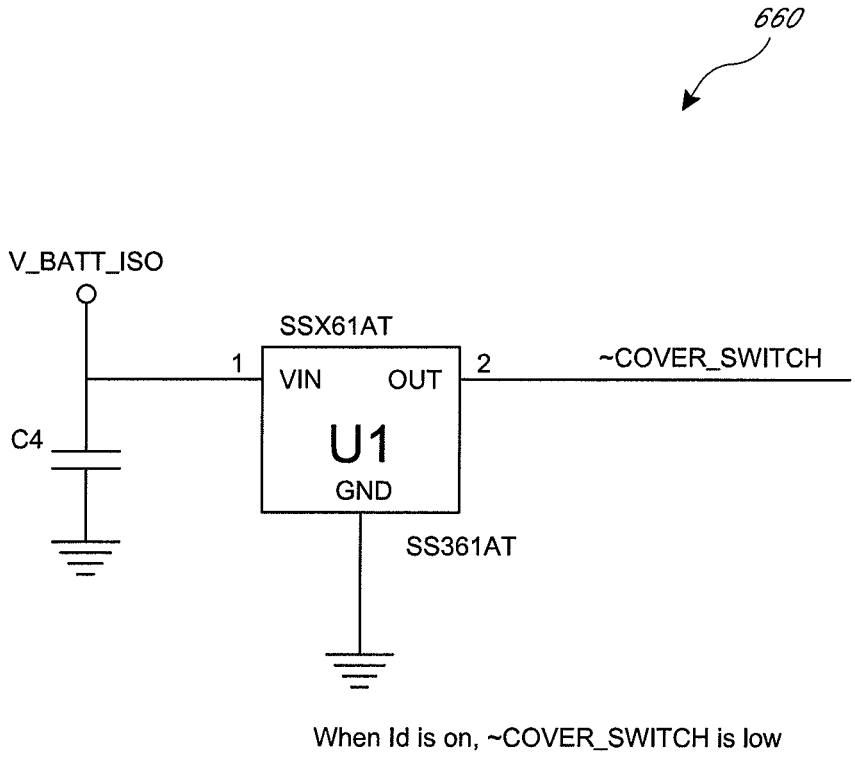
FIG. 7F is a circuit diagram of the Hall Effect sensor of FIG. 6 according to one embodiment.
Figures 1, 7G:
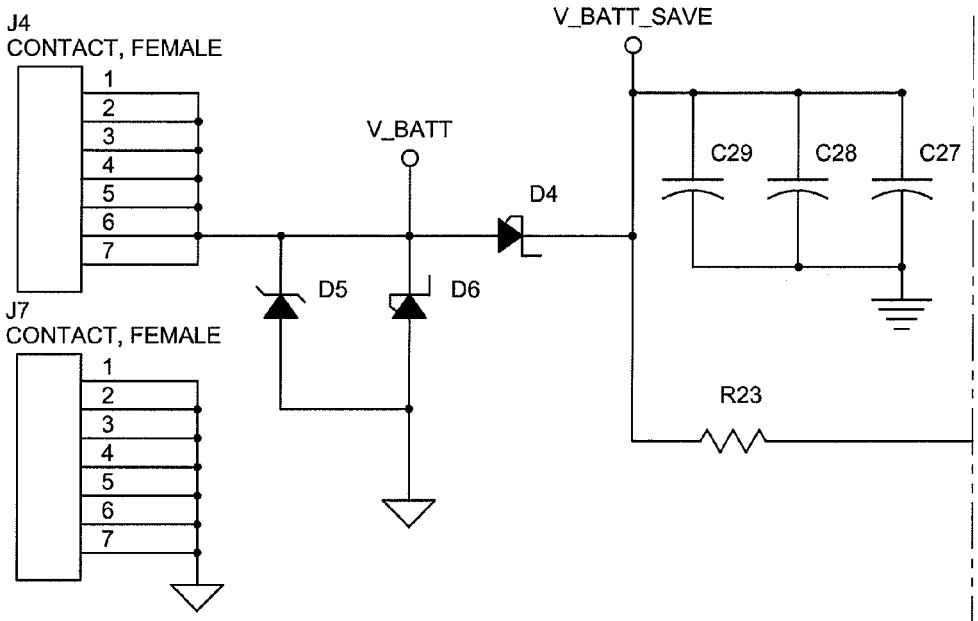
FIG. 7G is a circuit diagram of the voltage regulation circuit of FIG. 6 according to one embodiment.
Figures 2, 7G:
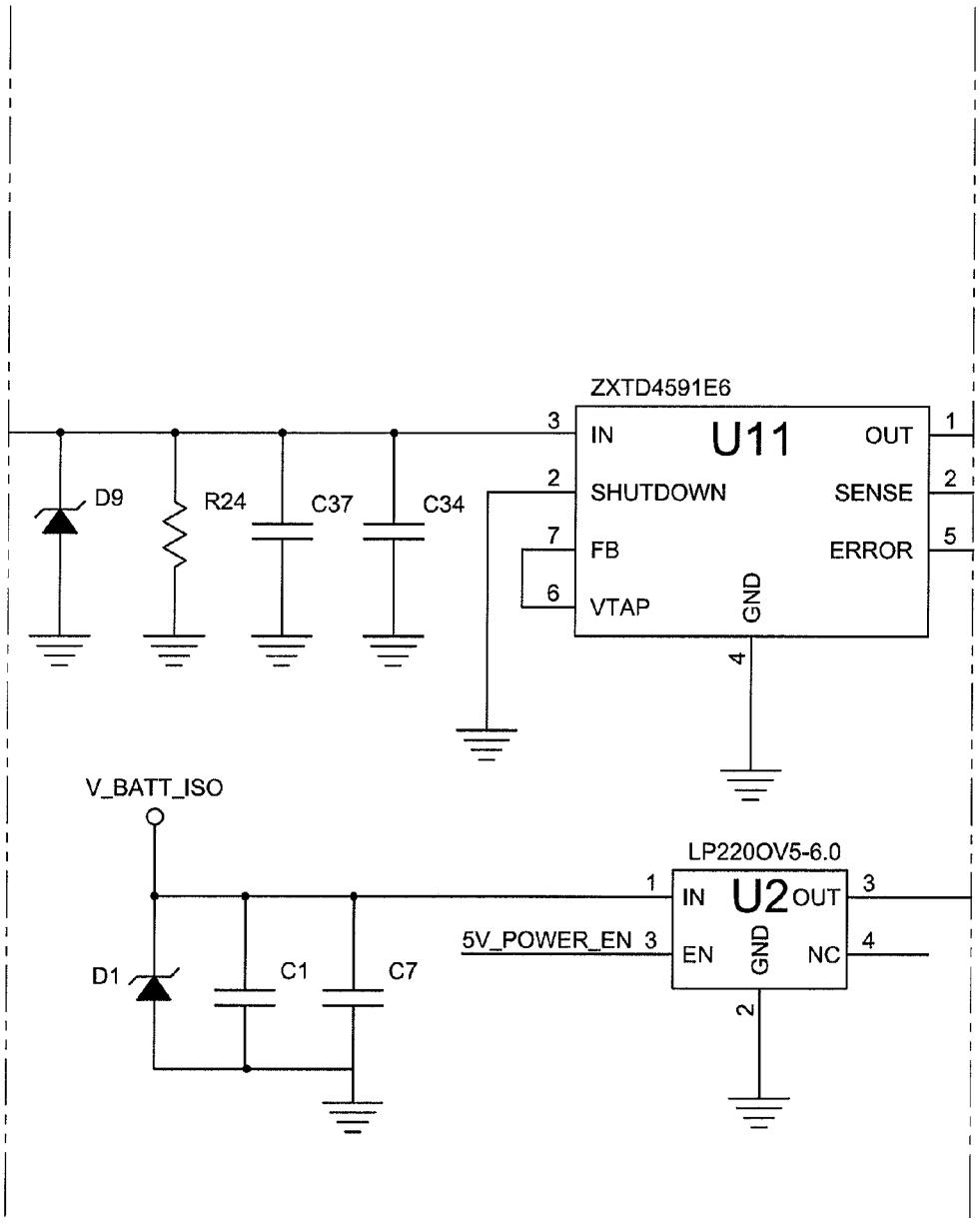
Figures 3, 7G:
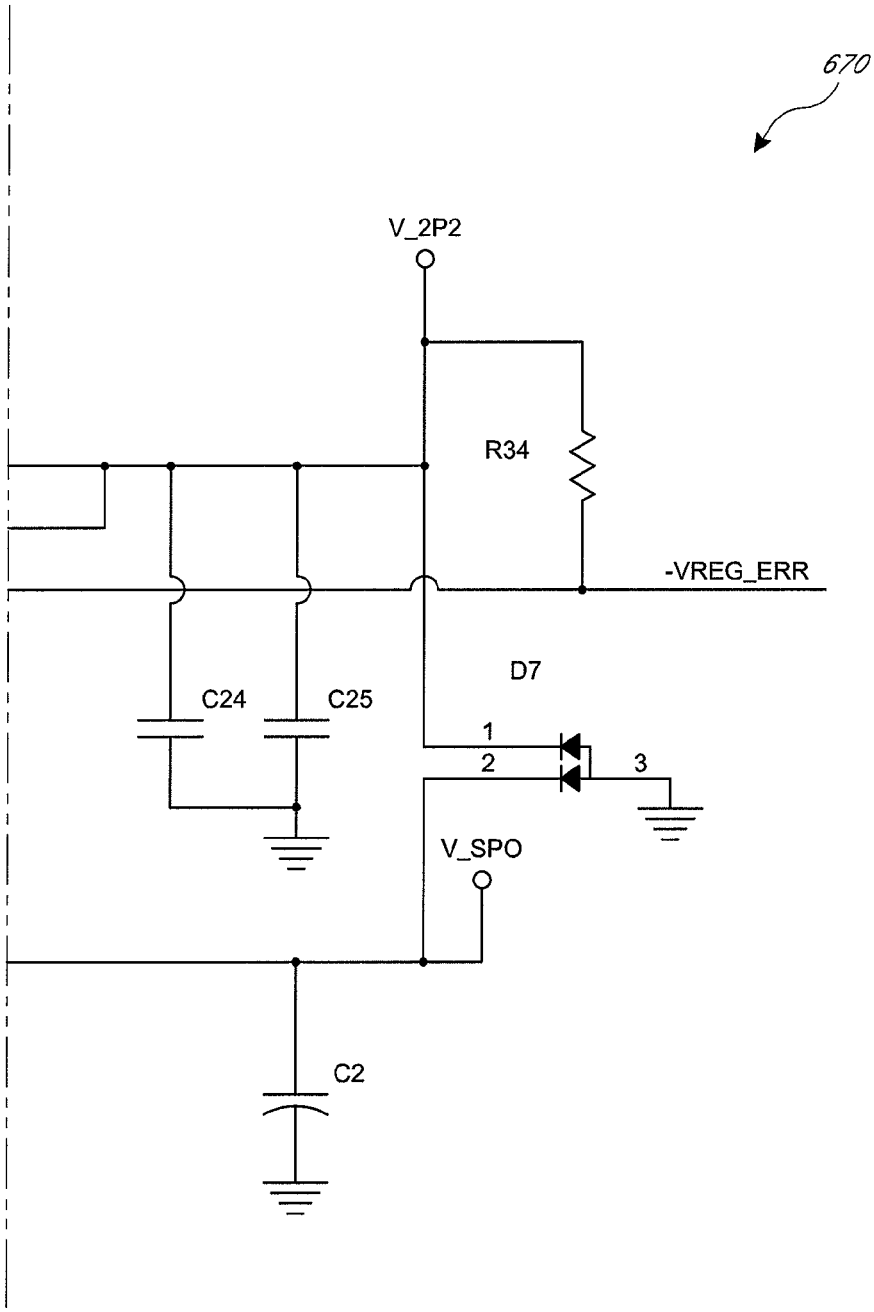
Figures 1, 7H:
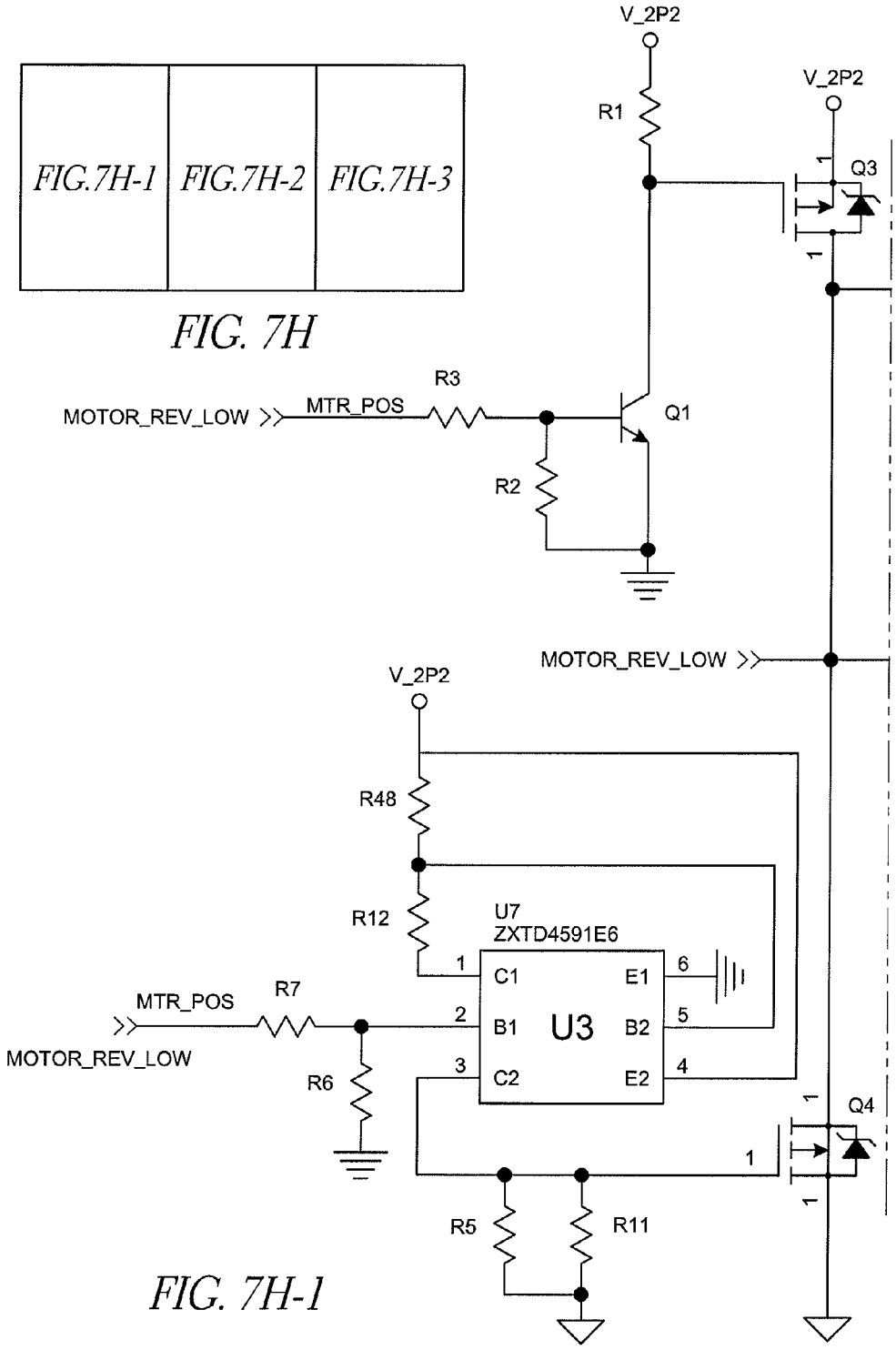
FIG. 7H is a circuit diagram of the motor driver of FIG. 6 according to one embodiment.
Figures 2, 7H:
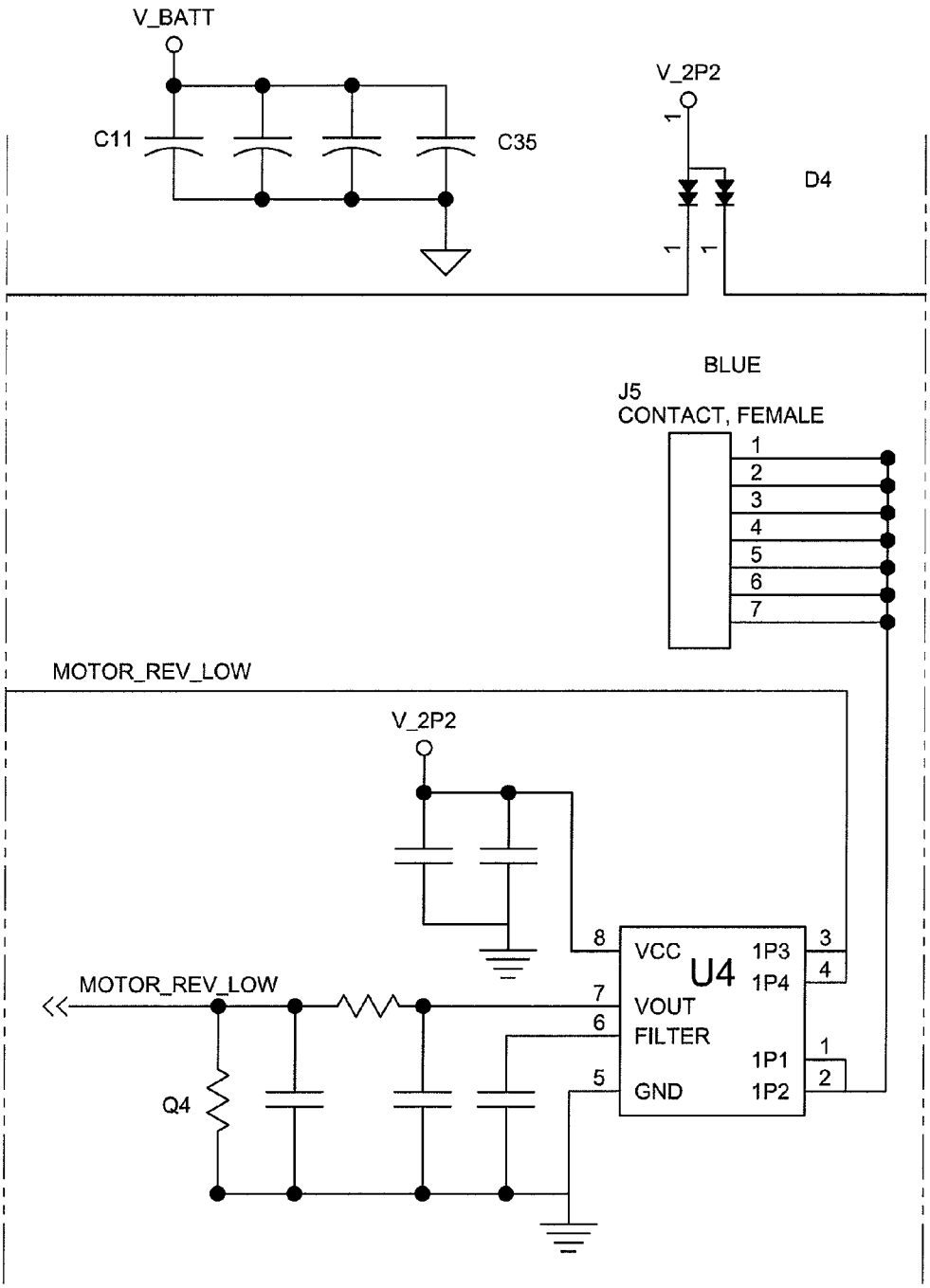
Figures 3, 7H:
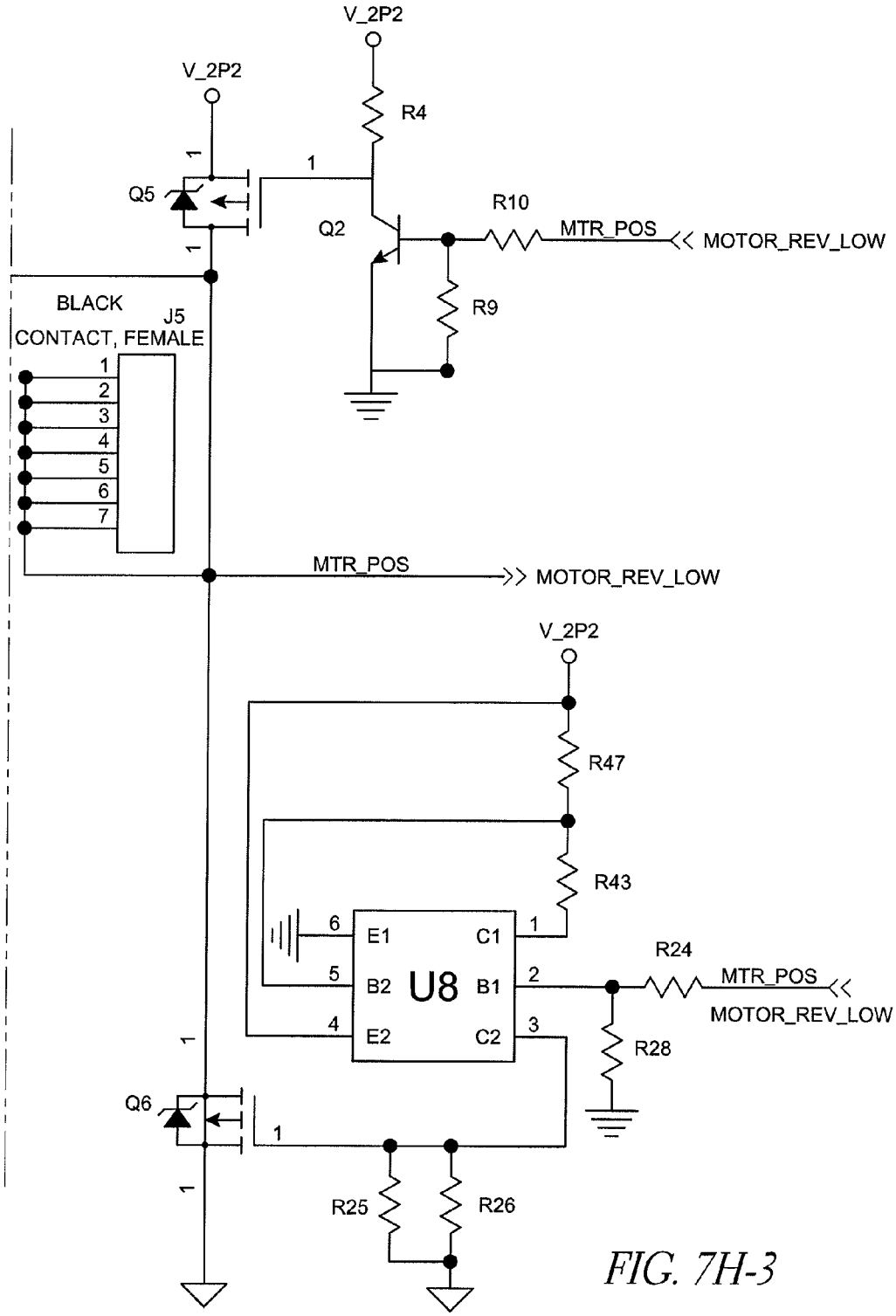

FIG. 7H illustrates one embodiment of the motor driver 680 of FIG. 6, which can be used to power the motor during forward (unwinding) and reverse (winding) operations. The motor driver 680 can be also used to brake the motor. The motor driver 680 can includes a positive motor contact J5; a negative motor contact J6; a current sense circuit; and power transistors Q3, Q4, Q5, and Q6. The motor driver 680 can receive supply voltages V_BATT and V_BATT SAFE from the voltage regulation circuit and receive motor driver controls MTR_FWD_HI, MTR_FWD_LO, MTR_REV_HI, and MTR_REV_LO from the microcontroller unit 610. The motor driver 680 can output motor terminal voltages MOTOR_REV_LOW, MOTOR_FWD_LOW and a motor current signal CURRENT_SENSE.

The motor driver 680 can receive, from the microcontroller unit 610, motor driver control signals MTR_FWD_HI, MTR_FWD_LO, MTR_REV_HI, and MTR_REV_LO to drive the power transistors Q3, Q6, Q5, and Q4, respectively, via power transistor drive circuits. The power transistors Q3, Q6, Q5, and Q4 can be arranged in an H-bridge configuration, which enables the motor driver to apply driving voltage across the motor contacts J5, J6 in either direction. Thus, during a forward assist operation, the power transistor Q3 is enabled via the motor driver control signal MTR_FWD_HI, and the power transistor Q6 is enabled via the pulse width modulation of the motor driver control signal MTR_FWD_LO. Likewise, the control signal MTR_REV_HI and the power transistor Q5 are enabled via the pulse width modulation of the motor driver control signal MTR_REV_LO. During a braking operation (e.g., applying an electrical brake), the power transistor Q3 is enabled via the motor driver control signal MTR_FWD_HI, and the power transistor Q5 is enabled via the pulse width modulation of the motor driver control signal MTR_REV_HI.

The motor driver 680 can also include a current sense circuit which includes a current sense module U4 and a current sense filter. The current sense module U4 detects a current flowing into and out of the positive motor contact J5 and generates a current sense signal CURRENT_SENSE that represents the current flowing into and out of the positive motor contact J5 as a voltage. The current sense filter sets the bandwidth of the current sense signal CURRENT_SENSE.

The microcontroller unit 610 can also compare the current value CURRENT_SENSE with an expected value that correlates to a desired motor speed. If the measured current does not correspond to the expected current for the desired motor speed, the microcontroller unit 610 advantageously adjusts the duty cycle of the appropriate output signals to selectively increase or decrease the motor speed while continuing to measure the current in accordance with the foregoing manner. Thus, the microcontroller unit 610 can use the feedback information provided by the current measuring technique to control the speed of the motor to a desired motor speed.

The microcontroller unit 610 can also use the value of CURRENT_SENSE to approximately determine the actual number of revolutions of the motor. The microcontroller unit 610 is able to calculate the amount of linear material that has been wound or unwound position based on the motor speed, as indicated by CURRENT_SENSE, and the amount of time during which the motor is running at a particular motor speed. A similar result can be obtained by using the voltage differences discussed above.

TERMINOLOGY

Unless the context clearly requires otherwise, throughout the description and the claims, the words "comprise," "comprising," "include," and the like are to be construed in an inclusive sense, as opposed to an exclusive or exhaustive sense; that is to say, in the sense of "including, but not limited to." The words "coupled" or connected", as generally used herein, refer to two or more elements that may be either directly connected, or connected by way of one or more intermediate elements. Additionally, the words "herein," "above," "below," "earlier," "later," and words of similar import, when used in this application, shall refer to this application as a whole and not to any particular portions of this application. Where the context permits, words in the Detailed Description using the singular or plural number may also include the plural or singular number, respectively. The word "or" in reference to a list of two or more items, is intended to cover all of the following interpretations of the word: any of the items in the list, all of the items in the list, and any combination of the items in the list.

Moreover, conditional language used herein, such as, among others, "can," "could," "might," "may," "e.g.," "for example," "such as" and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Furthermore, the verbs "spool," "wind," "rewind," "retract," and the like (and variants thereof) can refer to the rotation of the spool member in a direction that causes more of the linear material to become wound around the spool member. Conversely, the verbs "unspool," "unwind," "deploy," and the like (and variants thereof) can refer to the rotation of the spool member in a direction that causes less of the linear material to become wound around the spool member. Also, an "unwound" length and an "unspooled" length can be equivalent.

In addition, the words "duty cycle" can refer to a fraction of time that a system is in an active state. For example, a duty cycle can be 20% when a control signal is in an active state (e.g., high) for 20% of a cycle and in an inactive state (e.g., low) for 80% of the cycle. Thus, a first control signal that is in an active state for a larger percentage of a cycle can correspond to a greater duty cycle than a second control signal that is in the active state for a smaller percentage of the cycle.

The above detailed description of certain embodiments is not intended to be exhaustive or to limit the inventions to the precise form disclosed above. While specific embodiments of, and examples for, the inventions are described above for illustrative purposes, various equivalent modifications are possible within the scope of the inventions, as those skilled in the relevant art will recognize. For example, while processes or blocks are presented in a given order, alternative embodiments may perform routines, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings provided herein can be applied to other systems, not necessarily the systems described above. The elements and acts of the various embodiments described above can be combined to provide further embodiments.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

What is claimed is:

1. An apparatus for spooling a linear material, the apparatus comprising:

a spool member configured to rotate bidirectionally to spool and unspool the linear material with respect to the spool member;

a motor configured to rotate the spool member; and a controller configured to:

monitor a length of the linear material unspooled from the spool member based on an indicator of movement of the spool member generated by one or more sensors;

cause the motor to spool the linear material around the spool member at a first rate of spooling;

reduce the first rate of spooling to a second rate of spooling in response to detecting that the length of linear material unspooled from the spool member becomes less than a first threshold length; wherein the second rate of spooling is at a non-zero speed; and adjust the second rate of spooling to a third rate of spooling in response to detecting that the length of linear material unspooled from the spool member becomes less than a second threshold length, wherein the second threshold length is less than the first threshold length, and wherein the third rate of spooling is at a non-zero speed.

2. The apparatus of claim 1, further comprising a housing containing the spool member, the housing having a mounting element attached thereto, the mounting element configured to mount the housing with respect to a surface, wherein the linear material is a water hose.

3. The apparatus of claim 1, wherein the third rate of spooling is greater than the second rate of spooling.

4. The apparatus of claim 3, wherein the third rate of spooling is less than the first rate of spooling.

5. The apparatus of claim 1, wherein the controller is configured to program the second threshold length at the direction of a user.

6. The apparatus of claim 5, wherein the controller is configured to receive a command from the user to indicate a ground contact length between the spool member and a lower surface that can support the linear material, the controller further configured to determine the second threshold length based on the ground contact length.

7. The apparatus of claim 1, wherein the one or more sensors comprise at least one Hall Effect sensor configured to detect rotation of the spool member.

8. The apparatus of claim 1, further comprising at least two magnetic elements coupled to the spool member, and wherein the indicator of movement of the spool member comprises or is based on detection of instances of the at least two magnetic elements passing in proximity to individual sensors of the one or more sensors as the spool member rotates.

9. The apparatus of claim 1, further comprising at least two magnetic elements coupled to a rotating component configured to rotate when the spool member rotates, and wherein the indicator of movement of the spool member comprises or is based on detection of instances of the at least two magnetic elements passing in proximity to individual sensors of the one or more sensors as the rotating component rotates.

10. The apparatus of claim 1, wherein the controller is further configured to:

obtain a motor signal indicative of a torque that is exerted upon the spool member and not produced by the motor; and cause the one or more sensors to activate in response to sensing that the motor signal satisfies a threshold.

11. The apparatus of claim 1, wherein the controller is further configured to cause the motor to cease spooling the linear material in response to the one or more sensors detecting that the spool member is not rotating in the spooling direction.

12. The apparatus of claim 1, wherein the controller is further configured to control the motor so as to vary a rotational velocity of the spool member in an unspooling direction based on detecting a change in a pulling force applied to the linear material.

13. The apparatus of claim 12, wherein the controller is configured to vary a duty cycle of a signal provided to the motor based on the changes in the pulling force.

14. The apparatus of claim 12, wherein the controller is configured to vary the duty cycle using pulse width modulation.

15. The apparatus of claim 1, wherein the controller is further configured to control engagement of a brake to vary a degree to which the brake opposes the rotation of the spool member based on detecting a change in a pulling force applied to the linear material.

16. The apparatus of claim 15, wherein the controller varies a duty cycle of the engagement of the brake based on the changes in the pulling force.

17. The apparatus of claim 16, wherein the controller varies the duty cycle using pulse width modulation.

18. The apparatus of claim 1, wherein the controller is further configured to control the motor so as to stop rotation of the spool member or decrease rotational velocity of the spool member in the unspooling direction while unwinding a proximal end portion of the linear material.

19. The apparatus of claim 1, wherein the linear material comprises a water hose.

20. The apparatus of claim 19, wherein the third rate of spooling is greater than the second rate of spooling.

21. The apparatus of claim 19, wherein the one or more sensors comprise at least one Hall Effect sensor configured to detect rotation of the spool member.

22. The apparatus of claim 19, further comprising at least two magnetic elements coupled to the spool member, and wherein the indicator of movement of the spool member comprises or is based on detection of instances of the at least two magnetic elements passing in proximity to individual sensors of the one or more sensors as the spool member rotates.

23. The apparatus of claim 19, further comprising at least two magnetic elements coupled to a rotating component configured to rotate when the spool member rotates, and wherein the indicator of movement of the spool member comprises or is based on detection of instances of the at least two magnetic elements passing in proximity to individual sensors of the one or more sensors as the rotating component rotates.

24. The apparatus of claim 19, wherein the controller is further configured to:

obtain a motor signal indicative of a torque that is exerted upon the spool member and not produced by the motor; and cause the one or more sensors to activate in response to sensing that the motor signal satisfies a threshold.

25. The apparatus of claim 19, wherein the controller is further configured to cause the motor to cease spooling the water hose in response to the one or more sensors detecting that the spool member is not rotating in the spooling direction.

26. The apparatus of claim 19, wherein the controller is further configured to control the motor so as to vary a rotational velocity of the spool member in the unspooling direction based on detecting a change in a pulling force applied to the water hose.

27. The apparatus of claim 19, wherein the controller is further configured to control engagement of a brake to vary a degree to which the brake opposes the rotation of the spool member based on detecting a change in a pulling force applied to the water hose.

28. The apparatus of claim 19, wherein the controller is further configured to control the motor so as to stop rotation of the spool member or decrease rotational velocity of the spool member in the unspooling direction while unwinding a proximal end portion of the water hose.

29. The apparatus of claim 1, wherein the controller is further configured to automatically cause the motor to spool the linear material around the spool member at the first rate of spooling, reduce the first rate of spooling to second rate of spooling, and adjust the second rate of spooling to the third rate of spooling.

30. The apparatus of claim 1, wherein the controller is further configured to cause substantially all of the momentum of the linear material to be lost by causing the motor to spool the linear material at the second rate of spooling.

* * * * *